US007645214B2

(12) United States Patent
Lull

(10) Patent No.: US 7,645,214 B2
(45) Date of Patent: Jan. 12, 2010

(54) EXERCISE DEVICE WITH TREADLES

(75) Inventor: Andrew P. Lull, Boulder, CO (US)

(73) Assignee: Nautilus, Inc., Vancouver, WA (US)

( * ) Notice: Subject to any disclaimer, the term of this patent is extended or adjusted under 35 U.S.C. 154(b) by 759 days.

(21) Appl. No.: 11/065,891

(22) Filed: Feb. 25, 2005

(65) Prior Publication Data

US 2005/0209060 A1 Sep. 22, 2005

Related U.S. Application Data

(60) Provisional application No. 60/548,265, filed on Feb. 26, 2004, provisional application No. 60/548,787, filed on Feb. 26, 2004, provisional application No. 60/548,786, filed on Feb. 26, 2004.

(51) Int. Cl.
*A63B 22/00* (2006.01)
*A63B 22/02* (2006.01)

(52) U.S. Cl. ..... 482/51; 482/54; 482/52

(58) Field of Classification Search ..... 482/51–54, 482/111–113

See application file for complete search history.

(56) References Cited

U.S. PATENT DOCUMENTS

| | | | |
|---|---|---|---|
| 3,511,500 | A | 5/1970 | Dunn |
| 3,529,474 | A | 9/1970 | Olson et al. |
| 3,792,860 | A | 2/1974 | Seines |
| 3,814,420 | A | 6/1974 | Encke |
| 4,023,466 | A | 5/1977 | Strassheimer |
| 4,063,726 | A | 12/1977 | Wilson |
| 4,146,222 | A | 3/1979 | Hribar |
| 4,185,622 | A | 1/1980 | Swenson |
| 4,204,673 | A | 5/1980 | Speer, Sr. |
| 4,411,342 | A | 10/1983 | Katsumori et al. |
| 4,480,832 | A | 11/1984 | Bulmash et al. |
| 4,563,001 | A | 1/1986 | Terauds |
| 4,685,666 | A | 8/1987 | DeCloux |
| 4,726,583 | A | 2/1988 | Olsen et al. |
| 4,733,858 | A | 3/1988 | Lan |
| 4,799,676 | A | 1/1989 | Sheppard et al. |

(Continued)

FOREIGN PATENT DOCUMENTS

| | | | |
|---|---|---|---|
| CN | 2510102 | Y | 9/2002 |

(Continued)

OTHER PUBLICATIONS

"Nautilus Home Health & Fitness Catalog", Nautilus, Inc., pp. 1-56 (2004).

*Primary Examiner*—Steve R Crow
(74) *Attorney, Agent, or Firm*—Dorsey & Whitney LLP

(57) ABSTRACT

An exercise device including a first monoarm treadle assembly supporting a first tread belt and a second monoarm treadle assembly supporting a second belt. The tread belt is supported on a tread deck between a front roller on each treadle assembly, and a rear roller, which may be a distinct rear roller on each treadle assembly or a single rear roller for both treadle assemblies. The monoarm structure of each treadle assembly supports a plurality of deck supports in a cantilever fashion. The treadmill deck and the belt are supported on the deck supports. Further, the treadles are coupled with one or more hydraulic resistance structures, which may also function as an interconnect structure to coordinate pivotal movement of the treadle assemblies.

15 Claims, 51 Drawing Sheets

U.S. PATENT DOCUMENTS 4,830,362 A 5/1989 Bull
4,838,543 A 6/1989 Armstrong et al.
4,854,577 A 8/1989 Sims
4,860,634 A 8/1989 Hein
4,949,954 A 8/1990 Hix
4,989,858 A 2/1991 Young et al.
5,026,046 A 6/1991 DeCloux
5,048,821 A 9/1991 Kuo-Liang
5,054,770 A 10/1991 Bull
5,058,882 A 10/1991 Dalebout et al.
5,062,627 A 11/1991 Bingham
5,071,115 A 12/1991 Welch
5,114,389 A 5/1992 Brentham
5,129,872 A 7/1992 Dalton et al.
5,129,873 A 7/1992 Henderson et al.
5,139,255 A 8/1992 Sollami
5,139,470 A 8/1992 Wang
5,163,888 A 11/1992 Stearns
5,180,353 A 1/1993 Snyderman
5,183,449 A 2/1993 DeCloux
5,188,577 A 2/1993 Young et al.
5,232,471 A 8/1993 Chen et al.
5,236,407 A 8/1993 Wang
5,238,462 A 8/1993 Cinke et al.
5,246,410 A 9/1993 Fun
5,277,677 A 1/1994 Terauds
5,322,491 A 6/1994 Wanzer et al.
5,330,397 A 7/1994 Prince et al.
5,336,146 A 8/1994 Piaget et al.
5,370,592 A * 12/1994 Wu ..... 482/53
5,538,489 A 7/1996 Magid
5,626,539 A 5/1997 Piaget et al.
5,645,512 A 7/1997 Yu
5,665,033 A 9/1997 Palmer
5,669,856 A 9/1997 Liu
5,803,874 A 9/1998 Wilkinson
5,816,372 A * 10/1998 Carlson et al. ..... 188/267.2
6,113,518 A 9/2000 Maresh et al.
6,413,195 B1 7/2002 Barzelay
6,461,279 B1 * 10/2002 Kuo ..... 482/54
6,743,153 B2 6/2004 Watterson et al.
6,811,517 B1 11/2004 Eschenbach
6,811,519 B2 11/2004 Kuo
6,893,383 B1 * 5/2005 Chang et al. ..... 482/54
7,097,593 B2 * 8/2006 Chang ..... 482/54
7,306,546 B2 12/2007 Lo
7,316,632 B2 1/2008 Rodgers, Jr.
2001/0016542 A1 * 8/2001 Yoshimura ..... 482/54
2004/0192514 A1 9/2004 Piaget et al.
2004/0214693 A1 10/2004 Piaget et al.
2005/0202939 A1 9/2005 Lull et al.
2005/0209059 A1 9/2005 Crawford et al.
2005/0209061 A1 9/2005 Crawford et al.
2005/0233864 A1 10/2005 Smith et al.
2005/0245359 A1 11/2005 Lo
2006/0223680 A1 10/2006 Chang
2008/0070758 A1 3/2008 Lull et al.

FOREIGN PATENT DOCUMENTS

CN 2675190 Y 2/2005
TW 515306 Y 12/2002
TW 547102 Y 8/2003
TW M249682 11/2004
WO WO 95/16502 A1 6/1995
WO WO 2004/108225 A1 12/2004

* cited by examiner

EXERCISE DEVICE WITH TREADLES

CROSS REFERENCE TO RELATED APPLICATIONS

The present application is a non-provisional application claiming priority to U.S. Provisional Patent Application No. 60/548,265 titled "Exercise Device with Treadles" filed on Feb. 26, 2004, and to U.S. Provisional Patent Application No. 60/548,787 titled "Hydraulic Resistance, Arm Exercise, and Non-Motorized Dual Deck Treadmills" filed on Feb. 26, 2004, and to U.S. Provisional Patent Application No. 60/548,786 titled "Control System and Method for an Exercise Apparatus" filed on Feb. 26, 2004, all of which are hereby incorporated in their entirety by reference herein.

The present application is related to: U.S. patent application Ser. No. 10/789,182 titled "Dual Deck Exercise Device" and filed on Feb. 26, 2004; U.S. patent application Ser. No. 10/789,294 titled "Exercise Device with Treadles" and filed on Feb. 26, 2004; and U.S. patent application No. 10/789,579 titled "System and Method for Controlling an Exercise Apparatus" and filed on Feb 26, 2004, all of which are hereby incorporated by reference herein.

The present application also incorporates by reference in its entirety, as if fully described herein, the subject matter disclosed in the following U.S. applications:

U.S. Provisional Patent Application No. 60/451,104 titled "Exercise Device with Treadles" filed on Feb. 28, 2003;

U.S. Provisional Patent Application No. 60/450,789 titled "Dual Deck Exercise Device" filed on Feb. 28, 2003;

U.S. Provisional Patent Application No. 60/450,890 titled "System and Method for Controlling an Exercise Apparatus" filed on Feb. 28, 2003;

U.S. Provisional Patent Application No. 60/548,811 titled "Dual Treadmill Exercise Device having a Single Rear Roller" filed on Feb. 26, 2004;

U.S. Design Patent Application No. 29/176,966 titled "Exercise Device with Treadles" filed on Feb. 28, 2003.

The present application is related to and incorporates by reference in its entirety, as if fully described herein, the subject matter disclosed in the following U.S. applications, filed on the same day as this application:

U.S. patent application No. 11/067,538 entitled "Control System and Method for an Exercise Apparatus" and filed on Feb. 25, 2005.

U.S. patent application Ser. No. 11/065,770 entitled "Dual Treadmill Exercise Device Having a Single Rear Roller" and filed on Feb. 25, 2005.

U.S. patent application Ser. No. 11/065,746 entitled "Upper Body Exercise and Flywheel Enhanced Dual Deck Treadmills" and filed on Feb. 25, 2005.

FIELD OF THE INVENTION

The present invention generally involves the field of exercise devices, and more particularly involves an exercise device including interconnected treadles with moving surfaces provided thereon. The present invention also involves various treadle interconnection mechanisms, treadle dampening mechanisms, and treadle reciprocation enhancement mechanisms.

BACKGROUND

The health benefits of regular exercise are well known. Many different types of exercise equipment have been developed over time, with various success, to facilitate exercise.

Examples of successful classes of exercise equipment include the treadmill and the stair climbing machine. A conventional treadmill typically includes a continuous belt providing a moving surface that a user may walk, jog, or run on. A conventional stair climbing machine typically includes a pair of links adapted to pivot up and down providing a pair of surfaces or pedals that a user may stand on and press up and down to simulate walking up a flight of stairs.

Various embodiments and aspects of the present invention involve an exercise machine that provides side-by-side moving surfaces that are pivotally supported at one end and adapted to pivot up and down at an opposite end. With a device conforming to the present invention, two pivotal moving surfaces are provided in a manner that provides some or all of the exercise benefits of using a treadmill with some or all of the exercise benefits of using a stair climbing machine. An exercise machine conforming to aspects of the present invention provides additional health benefits that are not recognized by a treadmill or a stair climbing machine alone.

SUMMARY OF THE INVENTION

One aspect of the present invention involves an exercise device including a first monoarm treadle assembly including a first moving surface and a second monoarm treadle assembly including a second moving surface. In one implementation, the moving surface is a tread belt supported on a tread deck between a front roller on each treadle assembly, and a rear roller, which may be a distinct rear roller on each treadle assembly or a single rear roller for both treadle assemblies. The monoarm structure of each treadle assembly supports a plurality of deck supports in a cantilever fashion. The treadmill deck and the belt are supported on the deck supports. Being a monoarm assembly, it is possible to position the tread belt of each treadle assembly in close proximity.

Another aspect of the present invention involves an exercise device including a first treadle assembly, which may or may not be a monoarm assembly, including a first moving surface and a second treadle assembly, which also may or may not be a monoarm assembly, including a second moving surface. A hydraulic resistance structure is coupled between the treadle assemblies to resist up-and-down pivotal movement. The hydraulic resistance structure may include one or more piston-cylinder arrangements operably coupled with the treadles and/or operably coupled with an interconnect structure coupling the treadle assemblies.

Various other aspects of the present invention are discussed and described in detail below with reference to the drawings.

BRIEF DESCRIPTION OF THE DRAWINGS

The detailed description will refer to the following drawings, wherein like numerals refer to like elements, and wherein.

DETAILED DESCRIPTION

Figure 1:
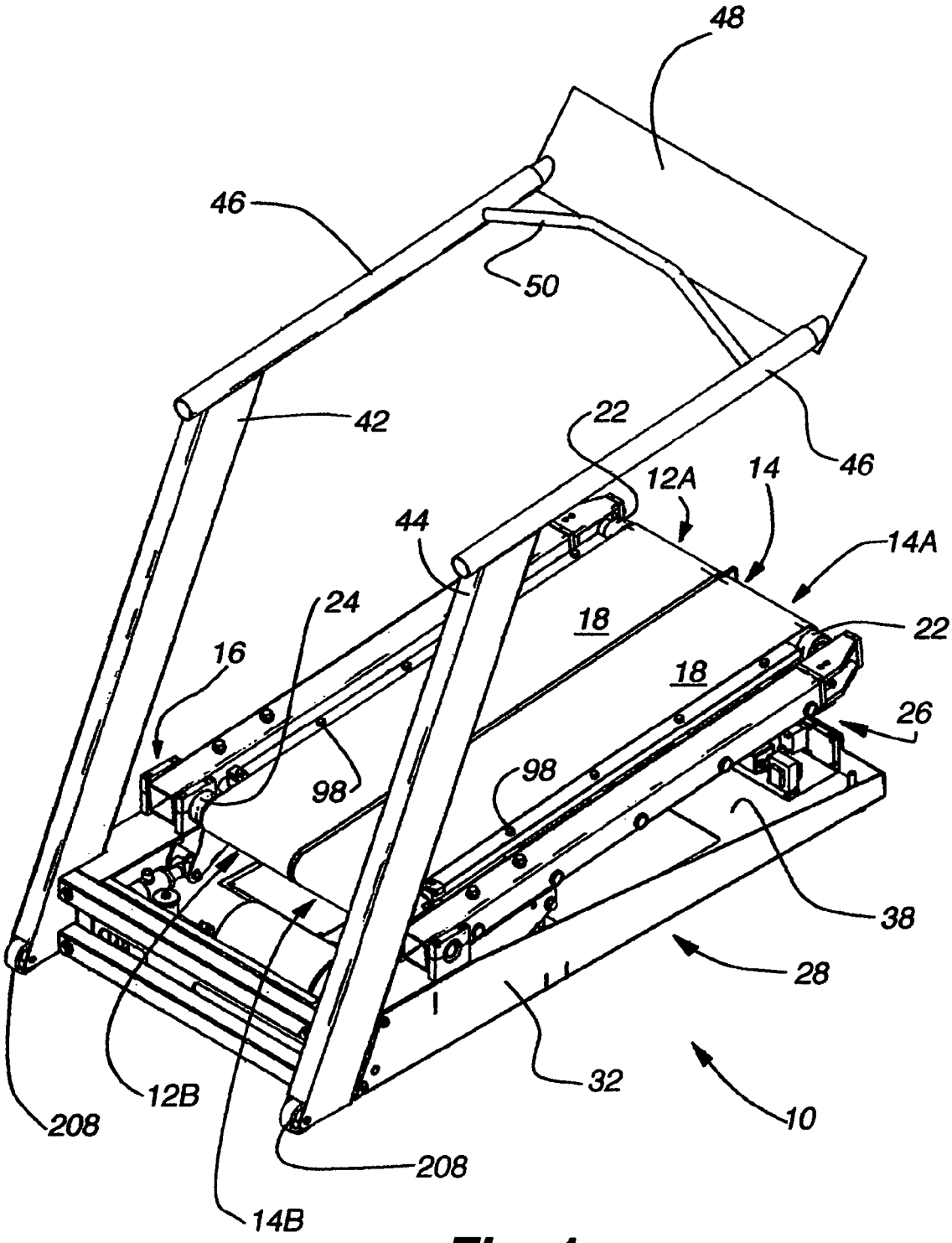
FIG. 1 is a rear isometric view of one embodiment of an exercise device, in accordance with aspects of the present invention.

Referring to FIG. 1, an exercise device 10 conforming to aspects of the present invention may be configured to provide a user with a walking-type exercise, a stepping-type exercise or a climbing-like exercise that is a combination of both walking and stepping. The exercise device generally includes two treadmill-like assemblies (12, 14) (referred to herein as a "treadle" or a "treadle assembly") pivotally connected with a frame so that the treadles may pivot up and down about a common axis 16 or in the region of a common axis. Each treadle includes a moving surface, such as a belt 18 in a treadmill-like configuration. Generally, the rear of each treadle is pivotally supported on the frame, and the front of each treadle is supported in a way to reciprocate up and down. In use, a user will walk, jog, or run on the treadles and the treadles will pivotally reciprocate about the common axis.

The treadles (12, 14) are arranged in a manner so that upward movement of one treadle is accompanied by downward movement of the other treadle. In some embodiments, the treadles are interconnected so that upward or downward pivotal movement of one treadle is linked to downward or upward movement, respectively, of the other treadles. It is possible, however, that the reciprocal movement is a function of user input and not a linking arrangement between the treadles. In one implementation, the treadles (12, 14) are interconnected by an interconnection member or assembly so that upward/downward movement of one treadle is accompanied by downward/upward movement of the other treadle. Further, one implementation of the invention includes a resistance structure (or structures), such as a hydraulic shock, associated with each treadle to provide a resistance or dampening of the downward movement of the treadle. It is also possible to achieve a reciprocal movement of one treadle moving upward and the other treadle moving downward (either coordinated or independent) by incorporating a return component, such as a spring, with the resistance element. The combination of moving surface provided by the tread belts 18 and the reciprocation of the treadles (coordinated or uncoordinated) provides an exercise that is similar to climbing on a loose surface, such as walking, jogging, or running up a sand dune where each upward and forward foot movement is accompanied by the foot slipping backward and downward. Extraordinary cardiovascular and other health benefits are achieved by such a climbing-like exercise. Moreover, as will be recognized from the following discussion, the extraordinary health benefits are achieved in a low impact manner. Embodiments of the invention may also be fitted with a lock-out arrangement that substantially prohibits pivotal movement so that the exercise device 10 provides a non-pivoting pair of moving surfaces for walking, jogging, and running.

Figure 2:
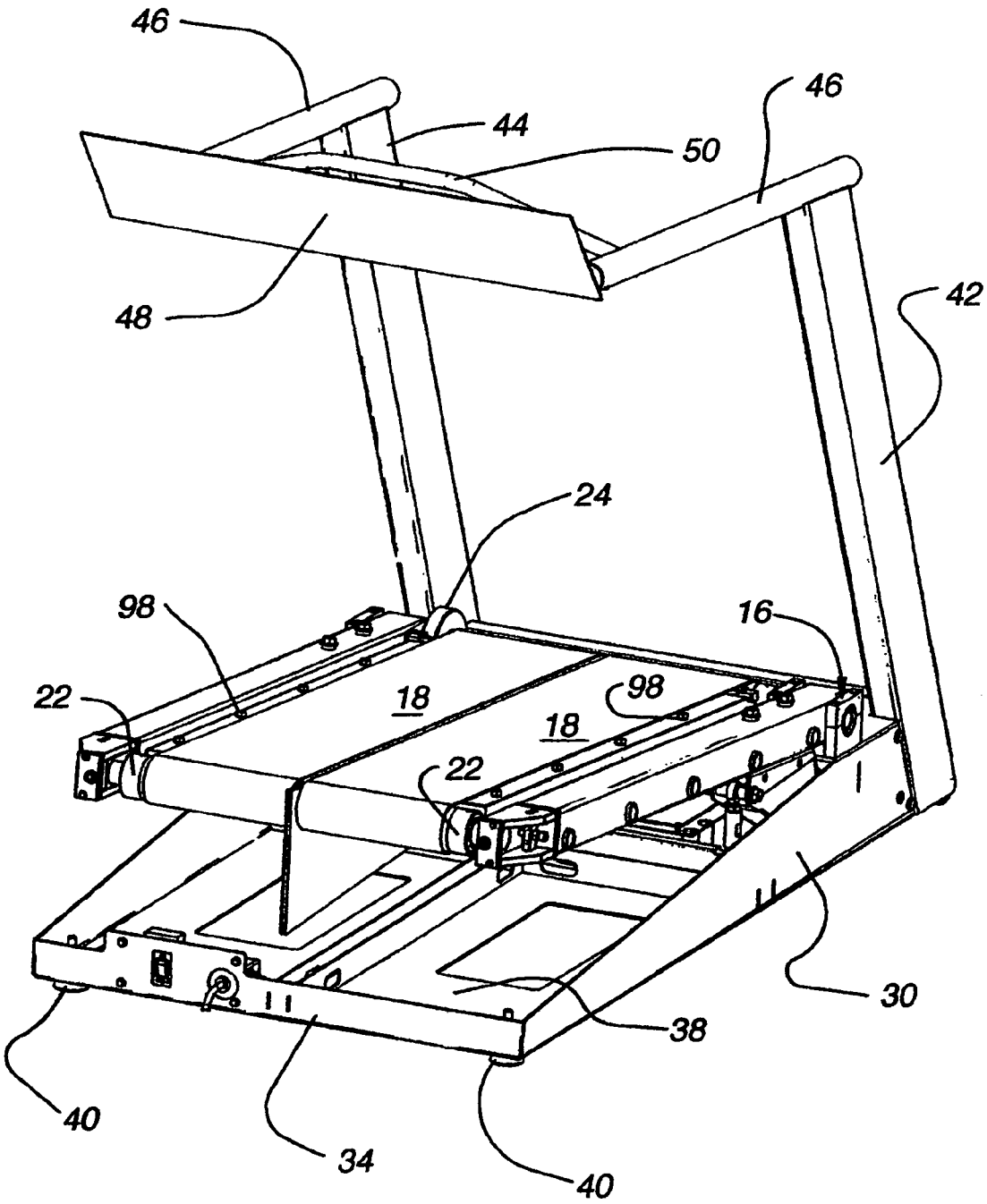
FIG. 2 is a front isometric view of the exercise device shown in FIG. 1.
Figure 3:
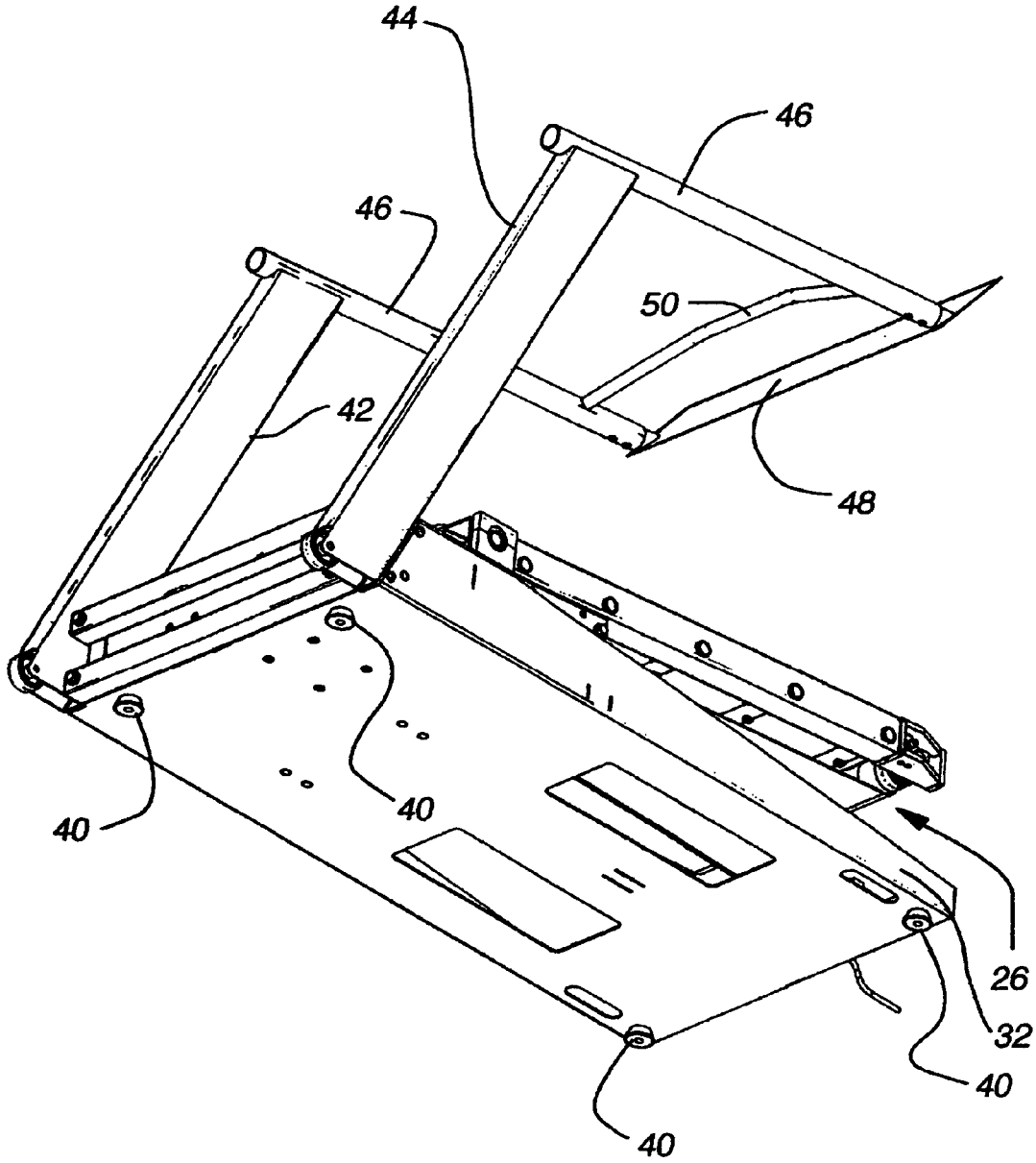
FIG. 3 is a bottom isometric view of the exercise device shown in FIG. 1.

The embodiment of the exercise device 10 illustrated in FIG. 1 does not illustrate various protective and decorative panels as might be used in a device for sale. FIG. 2 is a front isometric view of the exercise device shown in FIG. 1. FIG. 3 is a bottom isometric view of the exercise device of FIGS. 1 and 2. FIGS. 1-9 illustrate left side, right side, top, front, rear, and bottom views, respectively, of the exercise device shown in FIGS. 1-3.

Referring to FIGS. 1-9, and others, the exercise device includes a first treadle assembly 12 and a second treadle assembly 14, each having a front portion (12A, 14A) and a rear portion (12B, 14B). The rear portions of the treadle assemblies are pivotally supported at the rear of the exercise device. The front portions of the treadle assemblies are supported above the frame, and are configured to reciprocate in a generally up and down manner during use. It is also possible to pivotally support the treadles at the front of the exercise device, and support the rear of the treadle assemblies above the frame. Each treadle assembly also supports an endless belt or "tread belt" that rotates over a deck 20 and about front 22 and rear 24 rollers to provide either a forward or rearward moving surface. The tread belt may be of conventional treadmill belt construction and material. Alternatively, the belt may be a polyester fabric with a PVC coating. The belt may be further impregnated with silicone for lubrication. Such a belt is manufactured by Siegling.™ Other moving surfaces beside a tread belt may be provided in embodiments conforming to the present invention. Such moving surfaces include a plurality of rollers between the front and rear rollers, and others described in various applications incorporated by reference.

A user may perform exercise on the device facing toward the front portions (12A, 12B) of the treadle assemblies (referred to herein as "forward facing use") or may perform exercise on the device facing toward the rear portions (12B, 14B) of the treadle assemblies (referred to herein as "rearward facing use"). The term "front," "rear," and "right" are used herein with the perspective of a user standing on the device in the forward facing typical use of the device. During any type of use, the user may walk, jog, run, and/or step on the exercise device in a manner where each of the user's feet contact one of the treadle assemblies, although at times both feet may be elevated above the treadle assembles when the user is exercising vigorously. In forward facing use, the user's left foot will typically only contact the left treadle assembly 12 and the user's right foot will typically only contact the right treadle assembly 14. Alternatively, in rearward facing use, the user's left foot will typically only contact the right treadle assembly and the user's right foot will typically only contact the left treadle assembly.

An exercise device conforming to aspects of the invention may be configured to only provide a striding motion, only provide a stepping motion, or provide a combination of striding and stepping. For a striding motion, the treadle assemblies (12, 14) are configured to not reciprocate and the endless belts 18 configured to rotate. The term "striding motion" is meant to refer to any typical human striding motion such as walking, jogging and running. For a stepping motion, the treadle assemblies are configured to reciprocate and the endless belts are configured to not rotate about the rollers. The term "stepping motion" is meant to refer to any typical stepping motion, such as when a human walks up stairs, uses a conventional stepper exercise device, walks up a hill, etc.

As mentioned above, the rear (12B, 14B) of each treadle assembly is pivotally supported at the rear of the exercise device 10. The front (12A, 14A) of each treadle assembly is supported above the front portion of the exercise device so that the treadle assemblies may pivot upward and downward. When the user steps on a treadle, it (including the belt) will pivot downwardly. As will be described in greater detail below, the treadle assemblies may be interconnected such that downward or upward movement of one treadle assembly will cause a respective upward or downward movement of the other treadle assembly. Thus, when the user steps on one treadle, it will pivot downwardly while the other treadle assembly will pivot upwardly. With the treadle assemblies configured to move up and down and the tread belts configured to provide a moving striding surface, the user may achieve an exercise movement that encompasses a combination of striding and stepping.

Referring to FIGS. 1-3, 9, and others, the exercise device includes a framework 26 with an underlying main frame 28. The framework provides the general structural support for the moving components and other components of the exercise device. The underlying main frame components include an integral left side panel 30, right side panel 32, front panel 34, back panel 36, and a bottom panel 38. The frame may be set directly on the floor or a may be supported on adjustable legs, cushions, bumpers, or combinations thereof. In the implementation of FIGS. 1-9, adjustable legs 40 are provided at the bottom front left and front right corners of the bottom frame panel.

A left upright 42 is connected with the frame at rearward end region of the left side panel 30. A right upright 44 is connected with the frame at the forward end region of the right side panel. The uprights extend generally upward from the frame, with a forward angular orientation. Handles 46 extend transversely to the top of each upright. In the implementation of FIGS. 1-3, etc., the handles are straight tubular structures. The handles are arranged generally in the same plane as the respective underlying side panels (30, 32) and extend about the full length of the treadles. The handles are adapted for the user to grasp during use of the exercise device 10. A console 48 is supported between the forward sections of the handles. The console may include one or more cup holders, an exercise display, and one or more depressions adapted to hold keys, a cell phone, or other personal items. An additional transverse handle 50 extends between the forward sections of each side panel. An additional transverse handle extends between the forward sections of each side panel. The transverse handle may include heart rate pick-ups for supplying heart beat signals to a heart rate monitor and display in the console.

Figure 9:
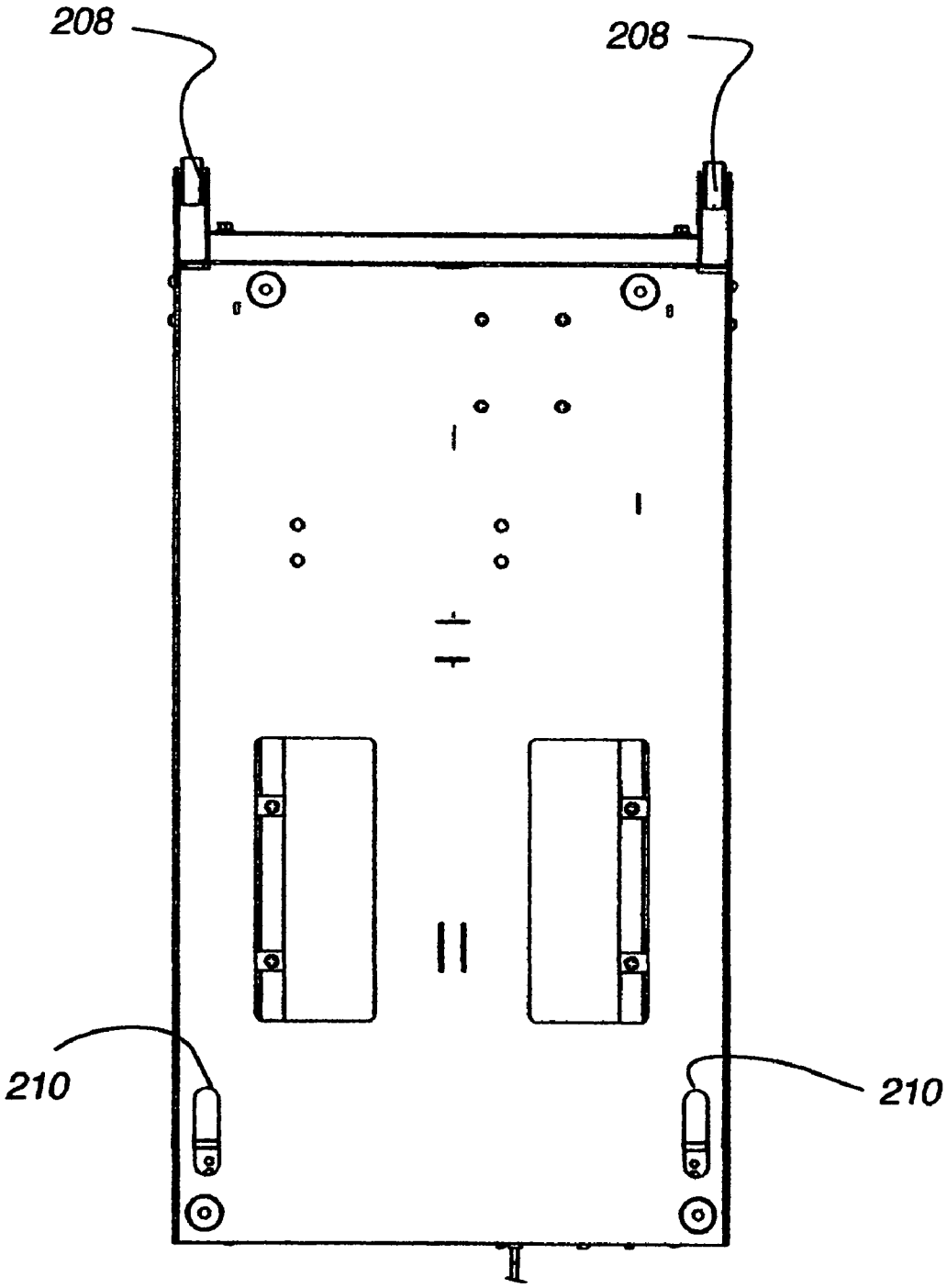
FIG. 9 is a bottom view of the exercise device shown in FIG. 2.
Figure 10:
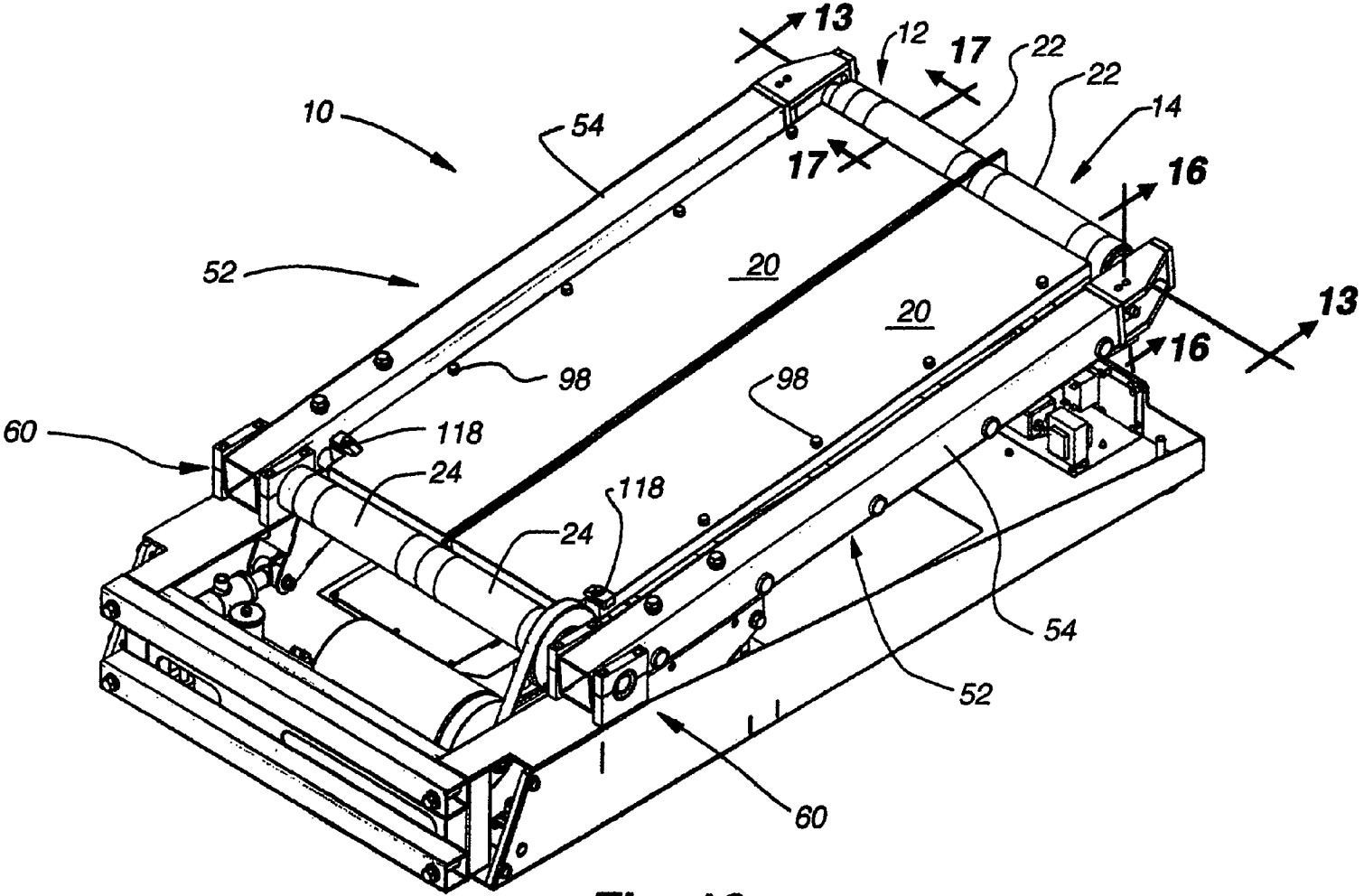
FIG. 10 is an isometric view of the exercise device shown in FIG. 1 with upright, decorative panels, tread belts, and other components removed to better illustrate underlying structures.
Figure 11:
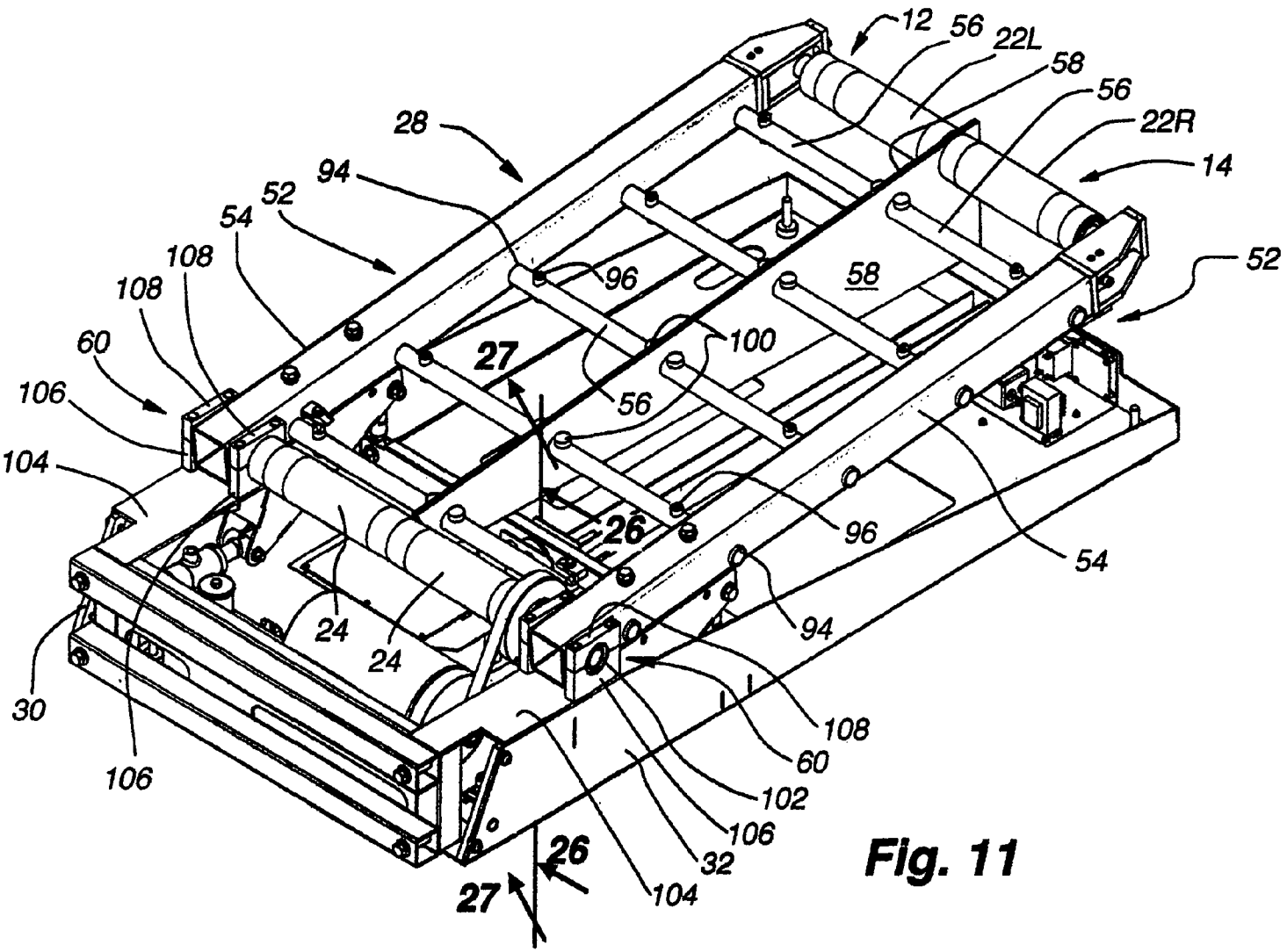
FIG. 11 is an isometric view similar to FIG. 10 with tread decks and other components removed to further illustrate underlying structures.

FIG. 10 is an isometric view of the exercise device 10 shown in FIGS. 1-9 with the uprights (42, 44) and the tread belts 18 removed to better illustrate components otherwise partially or completely hidden from view. With the tread belts removed, decks 20 arranged to underlie and support each tread belt may be seen. FIG. 11 is an isometric view of the exercise device shown in FIG. 10 with the tread decks 20 further removed to illustrate a treadle frame assembly 52. Each treadle assembly includes a treadle frame having an outside member 54 and a plurality of deck support members 56 extending inwardly from the outside members to support the decks. The outside member and deck support members are steel, but may be fabricated with other material, such as aluminum. A shield 58 or "curtain" is connected to the inside ends of the deck support members. The shield is also steel, but may be other material, such as aluminum or plastic.

The outside members 54 of each treadle frame assembly 52 are pivotally supported at the rear region of the exercise device. The outside members extend forwardly from a rear pivotal support 60 along a substantial portion of the length of the underlying frame. There is not an inner frame member arranged generally parallel with the outside members. In a conventional treadmill, there is typically an outside frame member and an inside frame member, and deck supports are arranged and supported between the inside and outside frame members. In some of the implementations of the present invention shown herein, the treadle frame assemblies have an outside frame member but do not have an inside frame member. Moreover, the deck support members 56 are connected with and supported by the outside frame members 54, but are not supported by an inner frame member. As such, the deck support members are supported at one point or along only one discrete length, such as at one end region of the deck support.

In the arrangement shown in FIG. 11, the deck support members are supported at one end area by the outside treadle frame members and carry the load of the deck along their lengths. It is also possible to support the deck support members other than at the ends. In any event, in one implementation, the deck support members 56 may define a cantilever in that the deck support members are supported at one end or at a fulcrum and carry a load (i.e., the deck) along their length or beyond at one side of the fulcrum.

By not having a frame member at the inner ends of the deck supports 56, the treadle assemblies (12, 14) may be arranged with little clearance or gap between the inside edges of the corresponding tread belts 18. Many users have very little lateral separation between their feet and legs during a striding motion. Arranged with the treadles in very close proximity helps to ensure that such users are able to maintain a natural stride and have their feet properly engage the tread belts 18 during use. Moreover, by eliminating two forwardly extending inner frame rails (one for each treadle assembly) through cantilever deck supports 56 it is possible to reduce the overall width of the exercise device 10 without substantially reducing the tread belt width, which is advantageous in both home and fitness clubs where floor space is a premium.

Figure 7:
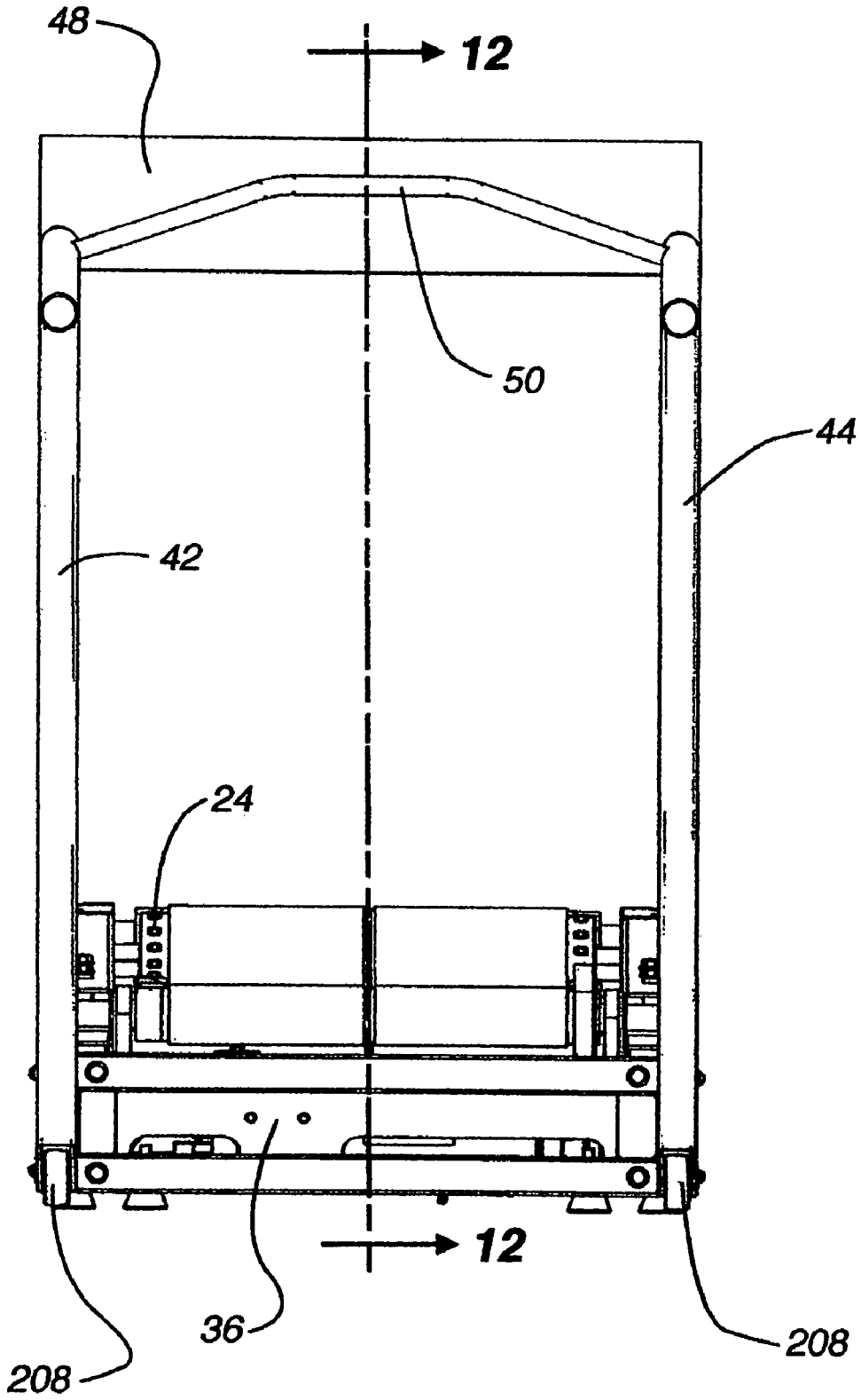
FIG. 7 is a front view of the exercise device shown in FIG. 2.
Figure 8:
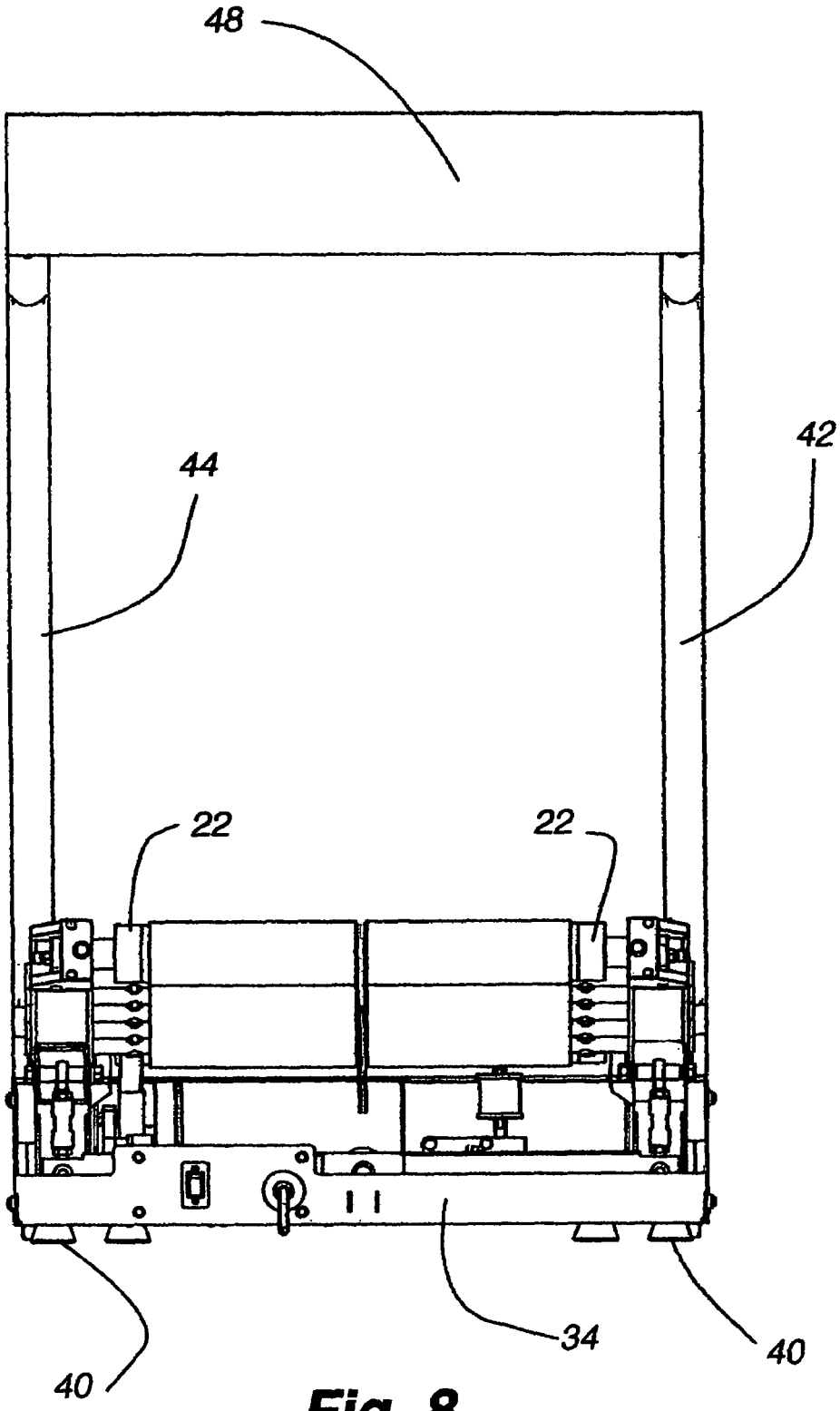
FIG. 8 is a rear view of the exercise device shown in FIG. 2.
Figure 12:
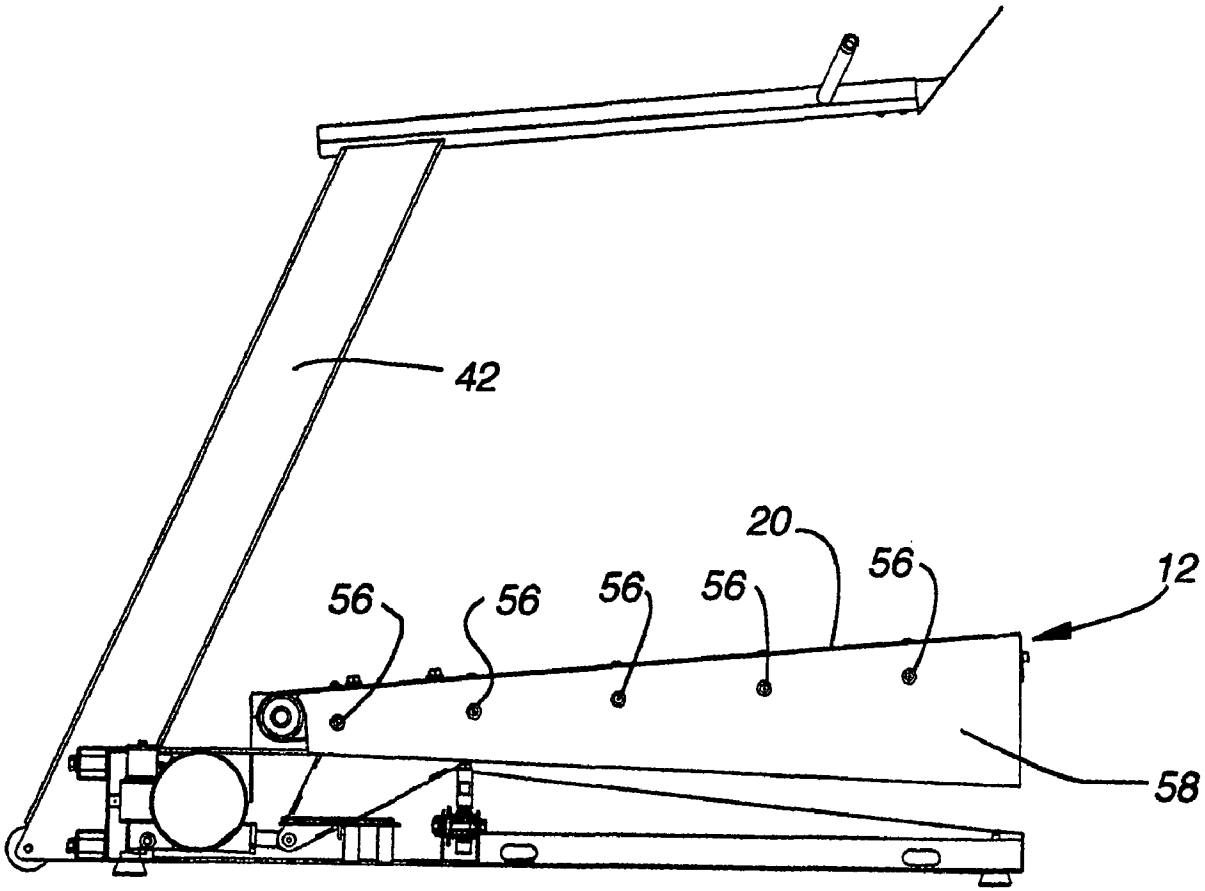
FIG. 12 is a section view taken along line 12-12 of FIG. 7.

FIG. 12 is a section view taken along line 12-12 of FIG. 7. As shown in FIGS. 11, 12, and others, each treadle assembly includes a shield 58 or "curtain." In one implementation, the shield, which may be fabricated with steel, aluminum, polymer, or other suitable material, defines a fairly thin generally triangular or trapezoidal plate. The shield is connected to the inner ends of the deck support members 56 distal the connection with the outer frame members 54. The shield may be welded or bolted to the deck support members, or connected with an intermediate member (not shown) that is connected with deck support members. Generally, the shields extend somewhat upwardly and downwardly from the inside ends of the deck support members. The top edge of the shield is generally aligned with the top of the respective deck 20. The forward edge of the shield extends downward and generally perpendicular to the front of the treadle assembly (12, 14). The shield does not provide longitudinal support for the treadle assemblies or longitudinal support for the deck support members, but rather blocks a user's foot or lower leg from slipping off of one tread belt and being pinched under the other treadle assembly or between the treadle assemblies. The shield does provide very minor fore and aft support for the deck supports. However, the shield is not connected with the rear roller or any other structures at the shield's rear end. FIGS. 36-39 (discussed in more detail below) show the left treadle in a lower position and the right treadle in an upper position, further illustrating the relationship between the curtains and the adjacent treadle during operation. The lower edge of the shield is arranged below the top edge of the opposite treadle assembly when one treadle assembly is in its uppermost position and the other treadle assembly is in its lowermost position. Due to the close arrangement of the treadle assemblies to each other, the curtains are arranged in very close proximity and may be touching, at times.

Referring again to FIG. 11, the front rollers 22 are rotatably supported at the front (12A, 14A) of each treadle frame 52 and the rear rollers 24 are rotatably supported at the rear (12B, 14B) of each treadle frame 52. Like the deck support members 56, the front rollers 22 are supported in a cantilever arrangement. Particularly, the right front roller is rotatably supported at the outer side of the right treadle assembly 14 by the outside member 54, and the left front roller is rotatably supported at the outer side of the left treadle assembly 12 by the left outside member 54. The inside edges of each front roller 22 are arranged adjacent each other. The curtains 58 (left and right) are supported at the inside edges of the respective front rollers. The curtains provide no significant longitudinal (vertical or horizontal) support for the rollers. The inside end of each roller is otherwise unsupported.

Figure 13:
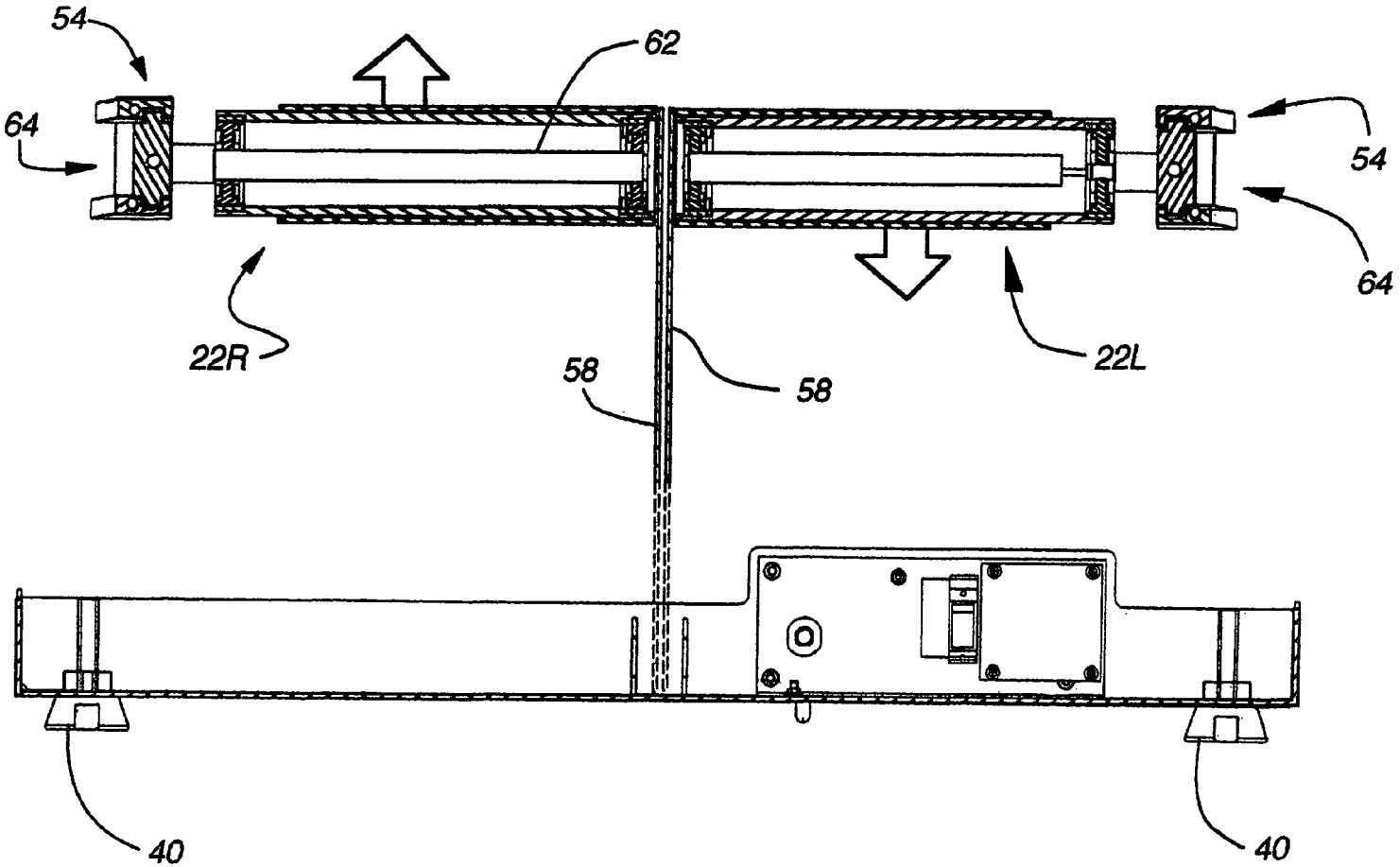
FIG. 13 is a section view taken along line 13-13 of FIG. 4.

FIG. 13 is a section view taken along line 13-13 of FIG. 10. Referring to the right roller 22R (the left roller 22L, etc. is a mirror image of the right roller), the roller includes a roller axle 62 rotatably supported in a belt adjustment assembly 64 at the forward end of the outside member 54 of the treadle frame. Note, in some instances, the designation "R" or "L" is used with an element number to designate a right (R) or left (L) component when it will be helpful to aid understanding. In many instances, there are two similar or some members of each component and/or assembly but only one of the members are discussed in significant detail. For example, there are two treadle assemblies 54, right and left, but each are very similar and are discussed as one or only one is discussed in significant detail. The roller further includes an elongate generally cylindrical outer surface rotatably supported on the axle by radial bearings. The tread belt engages the outer surface of the roller.

Figure 14:
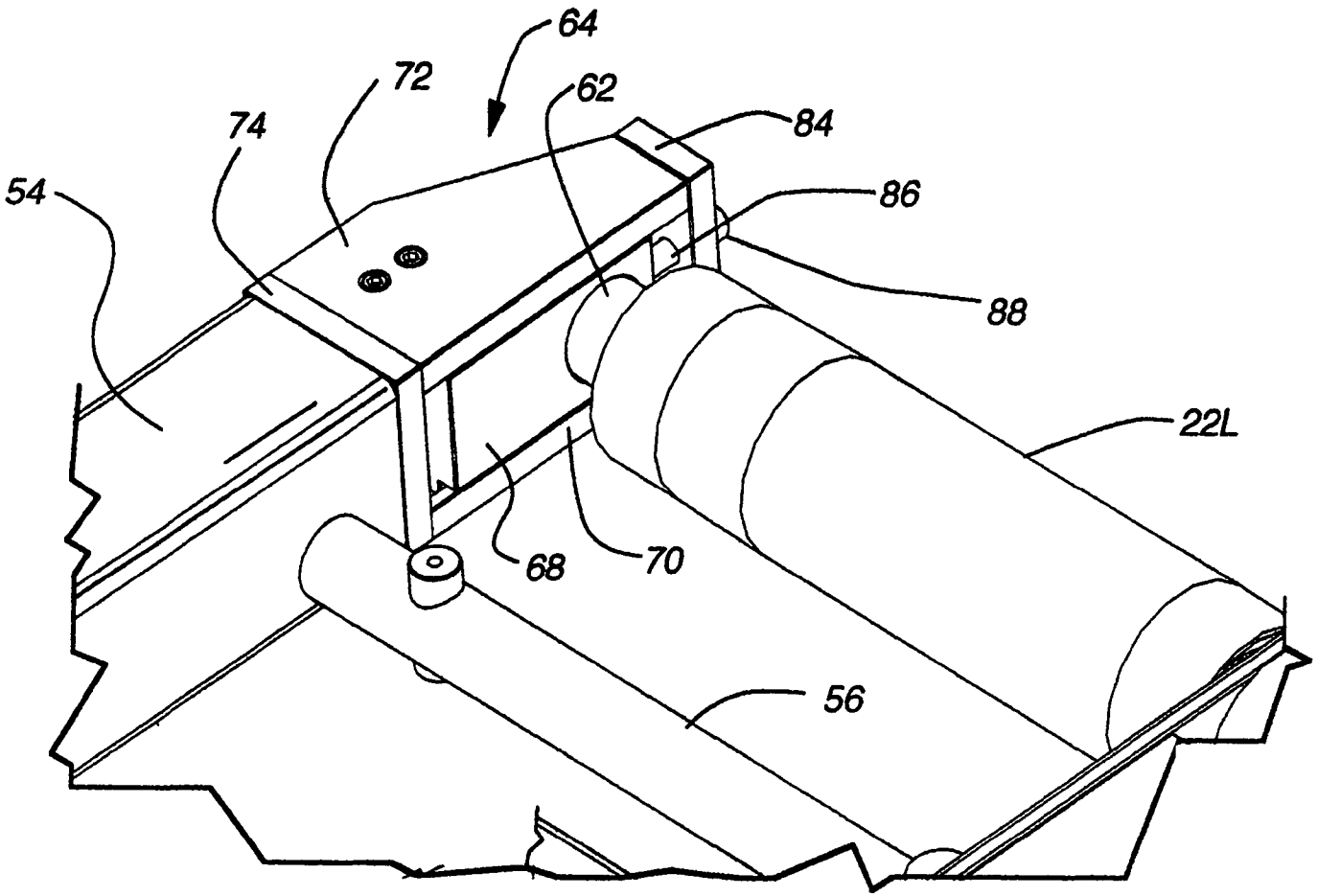
FIG. 14 is a close-up isometric view of the front portion of the left treadle and left front roller.
Figure 15:
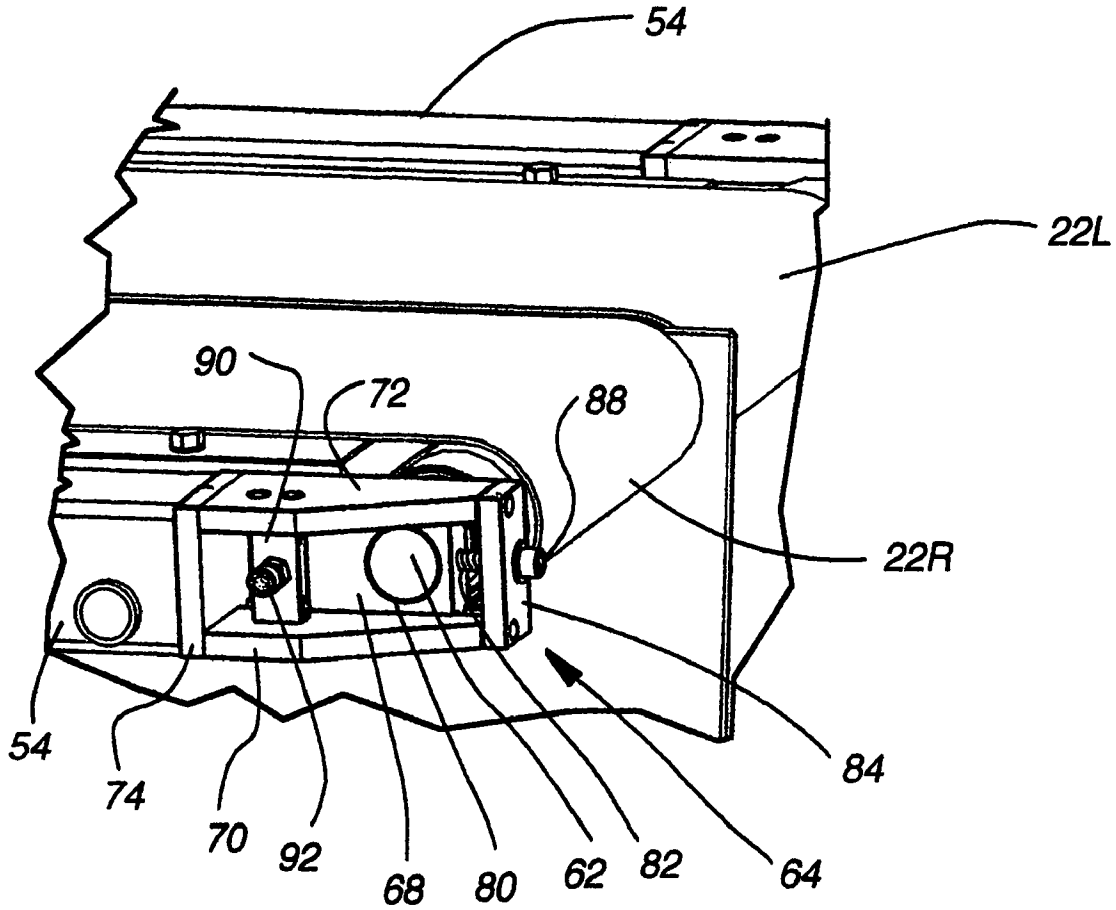
FIG. 15 is a close-up isometric view of the front portion of the right treadle particularly illustrating the belt adjustment assembly.
Figure 16:
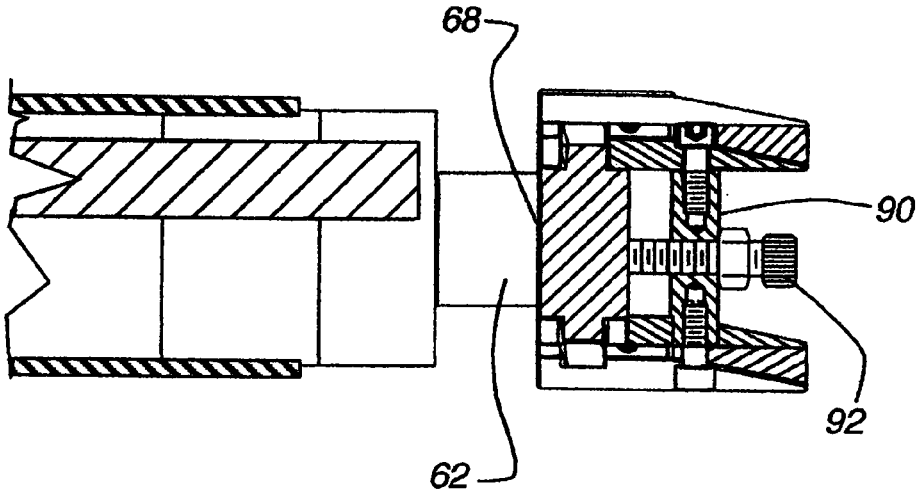
FIG. 16 is a section view taken along line 16-16 of FIG. 10.
Figure 17:
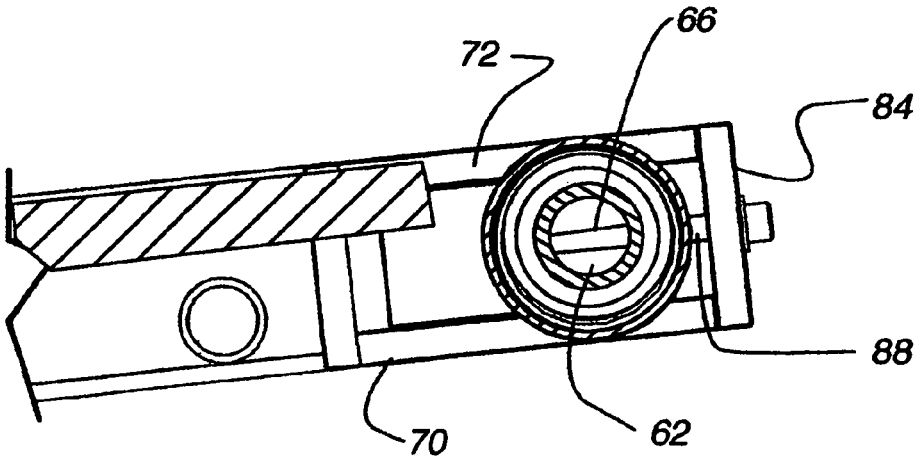
FIG. 17 is a section view taken along line 17-17 of FIG. 10.
Figure 18:
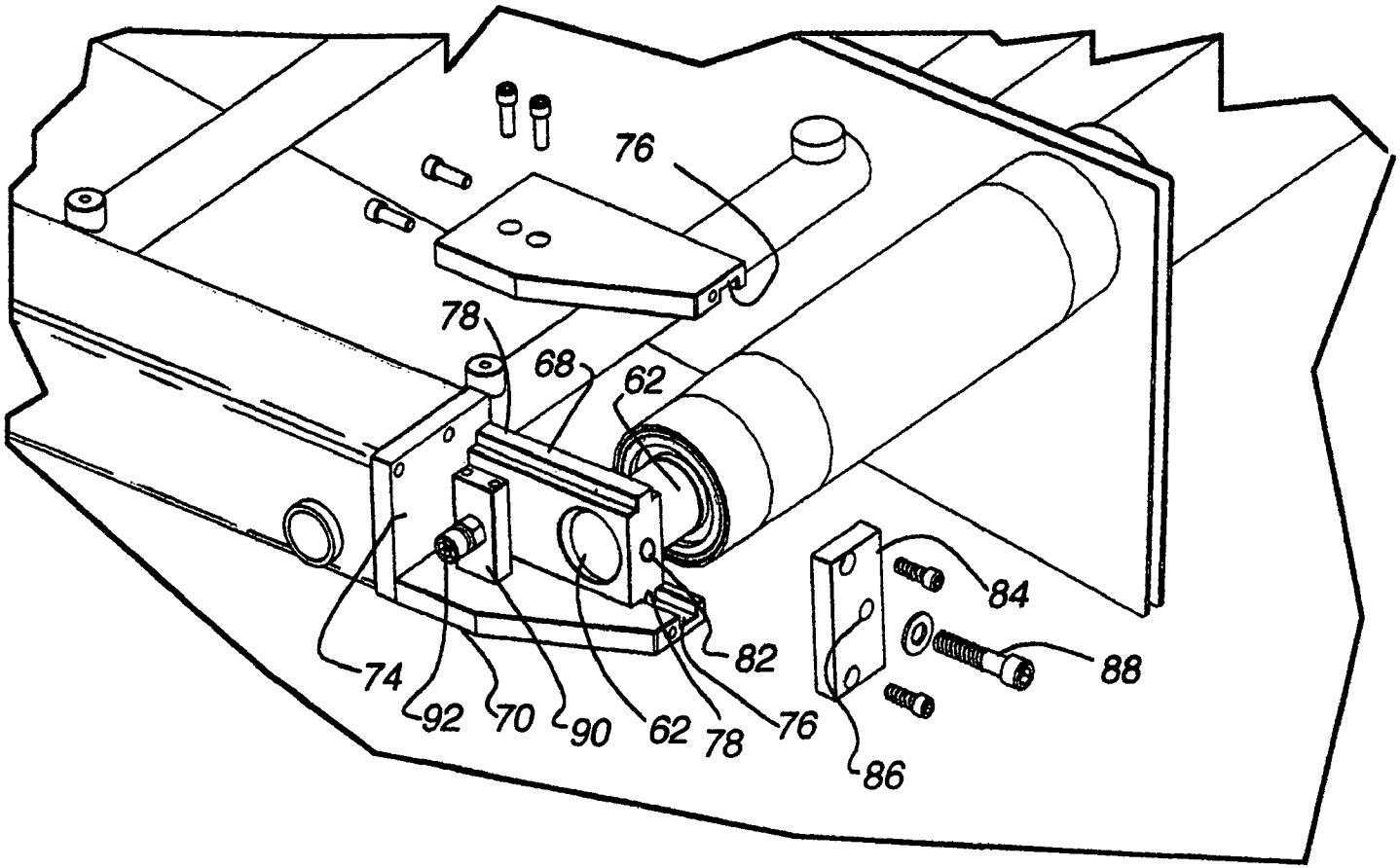
FIG. 18 is an exploded view of the belt adjustment assembly.

To adjust the tread belt tension and tracking, the front 22 or rear 24 rollers may be adjustably connected with the treadle frame. In one particular implementation, each front roller 22 is adjustably connected with the front of each outer treadle frame member 54. FIGS. 14-18 illustrate the belt adjustment assembly 64 deployed in one particular implementation of the present invention. Particularly, FIG. 14 is partial isometric view of the belt adjustment assembly arranged at the front end region of the outer frame member of the left treadle assembly. FIG. 14 also shows the front roller of the left treadle assembly and the most forwardly positioned deck support member. FIG. 15 is an isometric view of the belt adjustment assembly arranged at the front region of the outer frame member of the right treadle assembly. The left and right belt adjustment assemblies, like many other features of the exercise device, are basically mirror images of each other, and thus this discussion while at times referring to one of the belt adjustment assemblies will be recognized as equally applying to the other belt adjustment assembly. FIGS. 16 and 17 are section views of the belt adjustment assembly taken along lines 16-16 and 17-17, respectively, of FIG. 10. FIG. 18 is an exploded view of the belt adjustment assembly of FIG. 15.

Referring to FIGS. 14-18 and others, each front roller has an axle 62 extending outwardly from the outside end of the roller. The outwardly extending end of the axle defines a threaded aperture 66 transverse to the longitudinal axis of the axle. The belt adjustment assembly includes a belt tensioner plate 68 slidably supported in a lower 70 and upper 72 plate. The lower and upper plates are bolted to a face plate 74 at the front end of the outside frame member. The upper and lower plates extend forwardly from the outside member and are arranged in generally parallel planes. Channels 76 are defined along the length of the lower 70 and upper 72 plates. The tensioner plate 68 defines a tongue 78 extending outwardly from the upper edge and a second tongue extending outwardly from the lower edge. The tongues are slidably supported in the corresponding channels of the lower and upper plates. Further, the tensioner plate defines an axle aperture 80, preferably circular and of only slightly larger diameter than the axle 62 of the front roller 22. The axis of the aperture is arranged generally perpendicular to the outside member and is adapted to receive and support the axle of the front roller. The tensioner plate further defines a threaded aperture 82 in communication with the axle aperture and adapted to be in alignment with the threaded aperture 66 in the front axle when the axle is positioned in the axle aperture 80.

An axle bolt support plate 84 is fixed to the forward end of the adjustment assembly 64, preferably by a pair of bolts threaded into corresponding holes in the front of the lower and upper plates. The axle bolt support plate defines a threaded aperture 86 adapted to receive an axle bolt 88. As mentioned above, a threaded aperture 66 is defined in the front roller axle. When the axle 62 is arranged in the axle aperture 80, the axle bolt is threaded into the aperture of the bolt tensioner plate and the roller axle to move the bolt tensioner plate fore and aft and to secure the axle within the aperture. In this manner, the front roller may be adjusted fore and aft to assist loading the belts 18 about the front and rear rollers and to adjust the belt tension once the bolt is around the rollers and anytime thereafter.

Figure 19A:
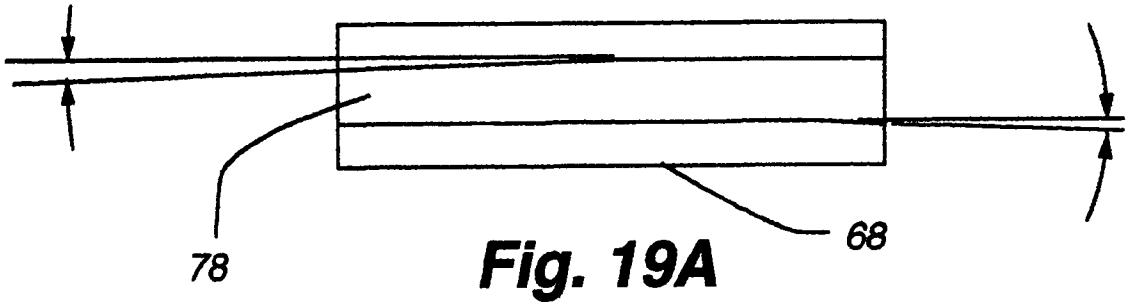
FIG. 19A is a top view of an angular adjustment plate.
Figure 19C:
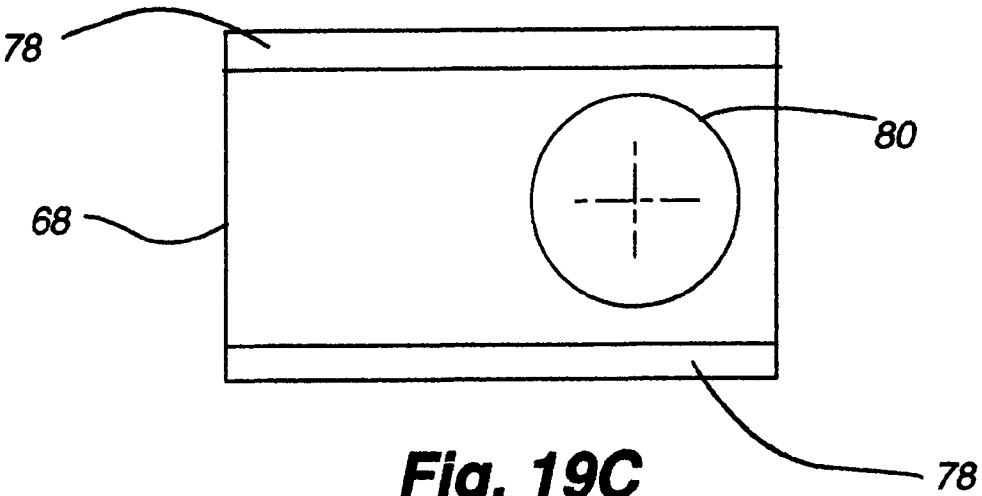
FIG. 19C is a side view of the angular adjustment plate of FIG. 19A.
Figure 19B:
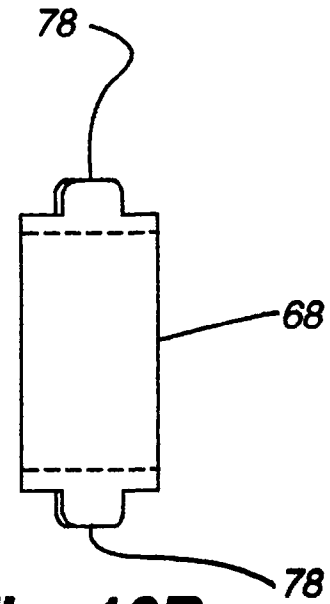
FIG. 19B is a front view of the angular adjustment plate of FIG. 19A.

The front roller may also be angularly adjusted with regard to the outside member. FIGS. 19A, 19B, and 19C illustrate a top view, a front view, and a side view, respectively, of the belt tensioner plate 68. As shown, the tongues 78 protruding from the upper and lower portions of the belt tensioner plate are not rectangular. Instead, the rear inner surface (the surface facing the roller) and the front outer surface (the surface away from the roller) of the upper and lower tongues are slightly angled or cambered. In one example as shown in FIG. 19A, the camber is about 2°. Other cambers are, however, possible. Referring to FIGS. 16 and 18, an angular adjustment plate 90 is bolted between the lower and upper plates (70, 72). The angular adjustment plate defines a threaded aperture adapted to receive an angular adjustment bolt 92. The angular adjustment bolt engages the outside surface of the belt tensioner plate 68 to angularly orient the tensioner plate in the channels 76. In this way, the angular orientation of the front roller may be adjusted. When the belt 18 is placed around the front and rear roller (22, 29), several hundred pounds of force may be exerted against the rollers urging the front roller rearwardly. Increasing the engagement of the angular adjustment bolt against the tensioner plate causes the outer end of the roller to pivot forwardly against the rearward force from the belts. In contrast, as the front roller is counteracting a rearward force imparted by the belt tension, decreasing the engagement of the adjustment bolt against the tensioner plate allows the belt to swing the roller rearwardly. In this way, the roller may be angularly oriented to ensure that it is square to the direction of belt travel, which helps to ensure that the belt stays properly centered on the rollers during use.

The tension imported on the treadle frame 52 by the belts may also cause a slight inward deflection of the outside members 54. To counteract the deflection, the outside frame members may be manufactured with an outward camber. As such, when the treadle is under tension from the belt, the outside member will deflect to a fairly straight or square orientation to the rear axle 16. The deflection may vary slightly as a result of material and manufacturing tolerances of the outside members and variations in belt tension. The angular adjustment of the front rollers allows the roller orientation to be fine-tuned to be square to the rear rollers and belt travel. In one particular implementation, the camber of each cantilevered outside member is between 0.25° and 0.5° with respect to the rear axis. The camber angles the treadles (12, 14) slightly away from each other before the belts are secured about the rollers.

Referring again to FIG. 10, the belt decks 20 are located on the top of each treadle frame. In one particular implementation, the decks are supported in a cantilever arrangement on the deck support members 56 extending laterally from the outer treadle frame members 54. The deck may be directly bolted to the deck support members, may be secured to the frame in combination with deck cushioning or a deck suspension system, or may be loosely mounted on the treadle frame. Each belt deck 20 is located between the respective front 22 and rear 24 rollers of each treadle assembly (12, 14). The belt decks are dimensioned to provide a landing platform for most or all of the upper run of the tread belts 18 between the rollers. In one embodiment, the decks are about 1" thick, with an MDF core and a phonolic laminate on the upper and lower runs of the deck. The edges of the decks may include a chamber to help prevent damage during shipping and assembly.

Figure 4:
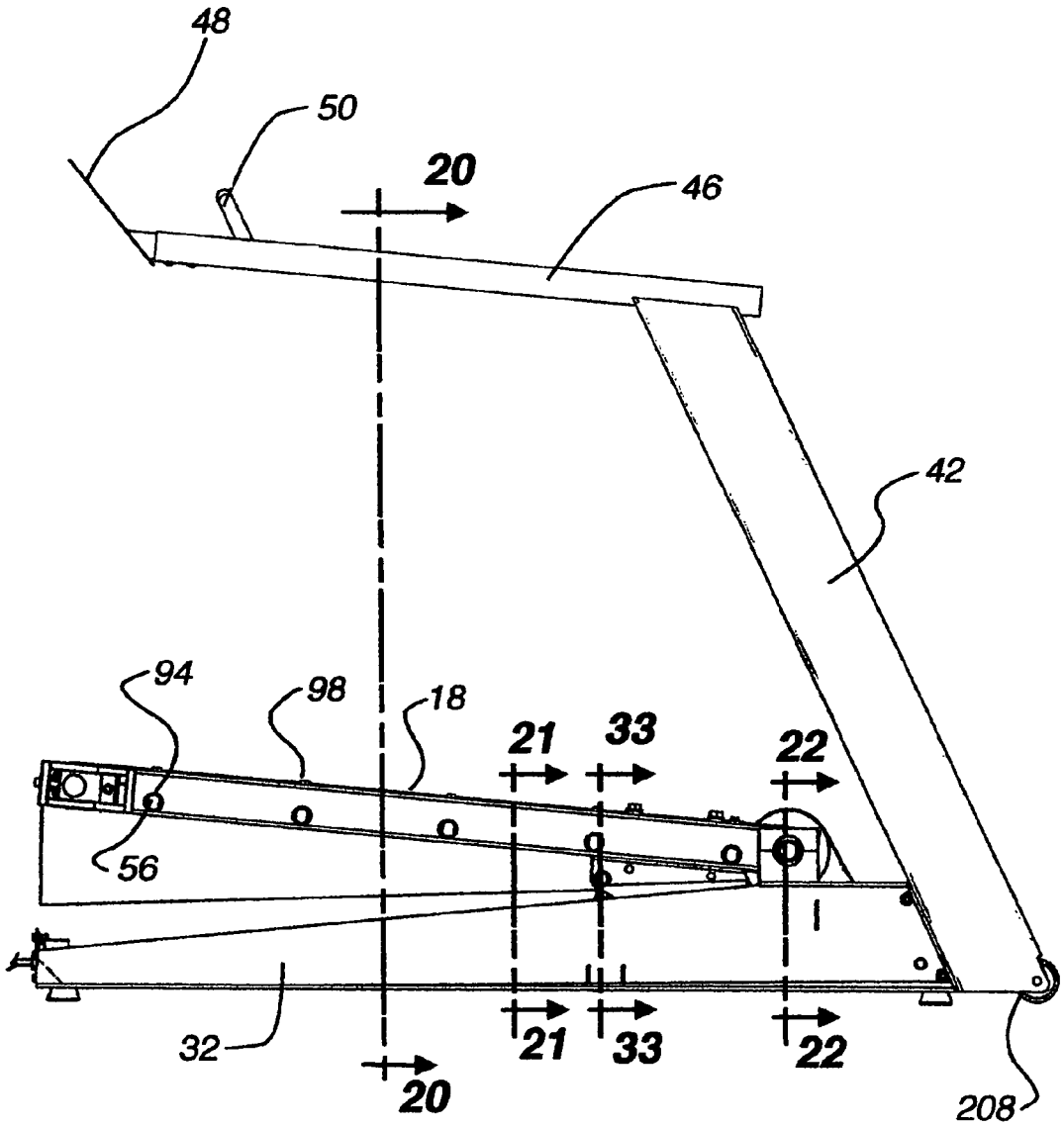
FIG. 4 is a left side view of the exercise device shown in FIG. 2.
Figure 5:
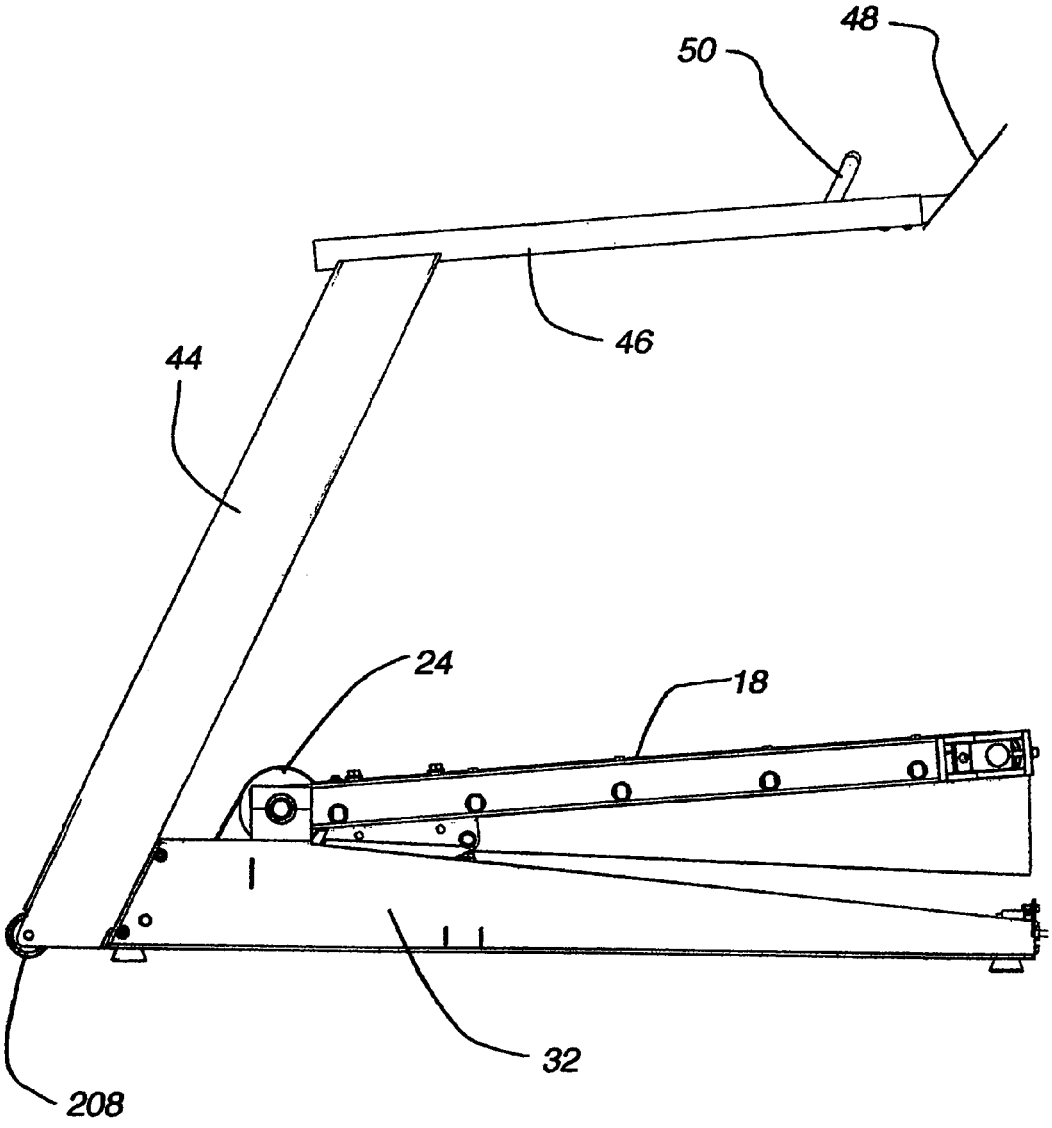
FIG. 5 is a right side view of the exercise device shown in FIG. 2.
Figure 20:
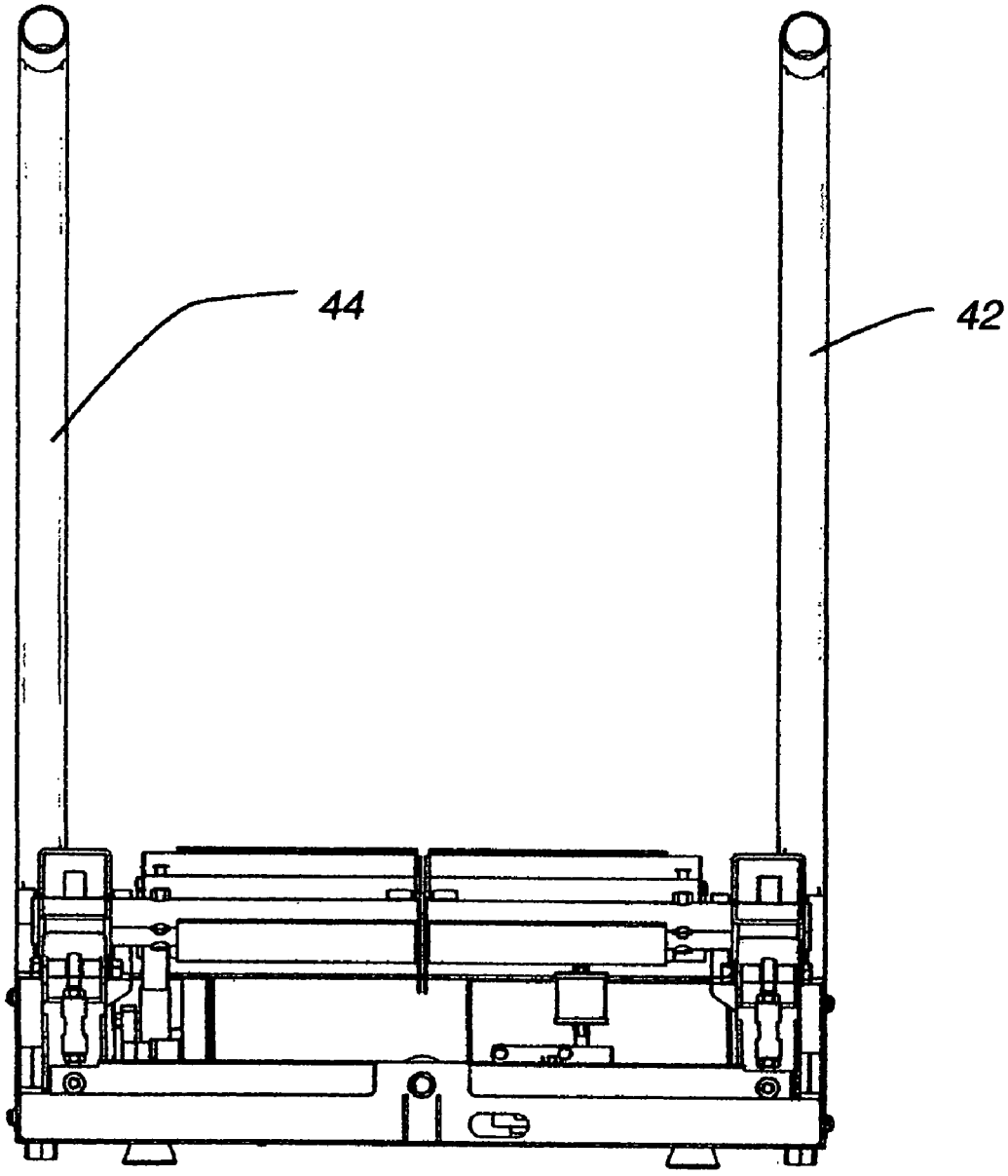
FIG. 20 is a section view taken along line 20-20 of FIG. 4.
Figure 21:
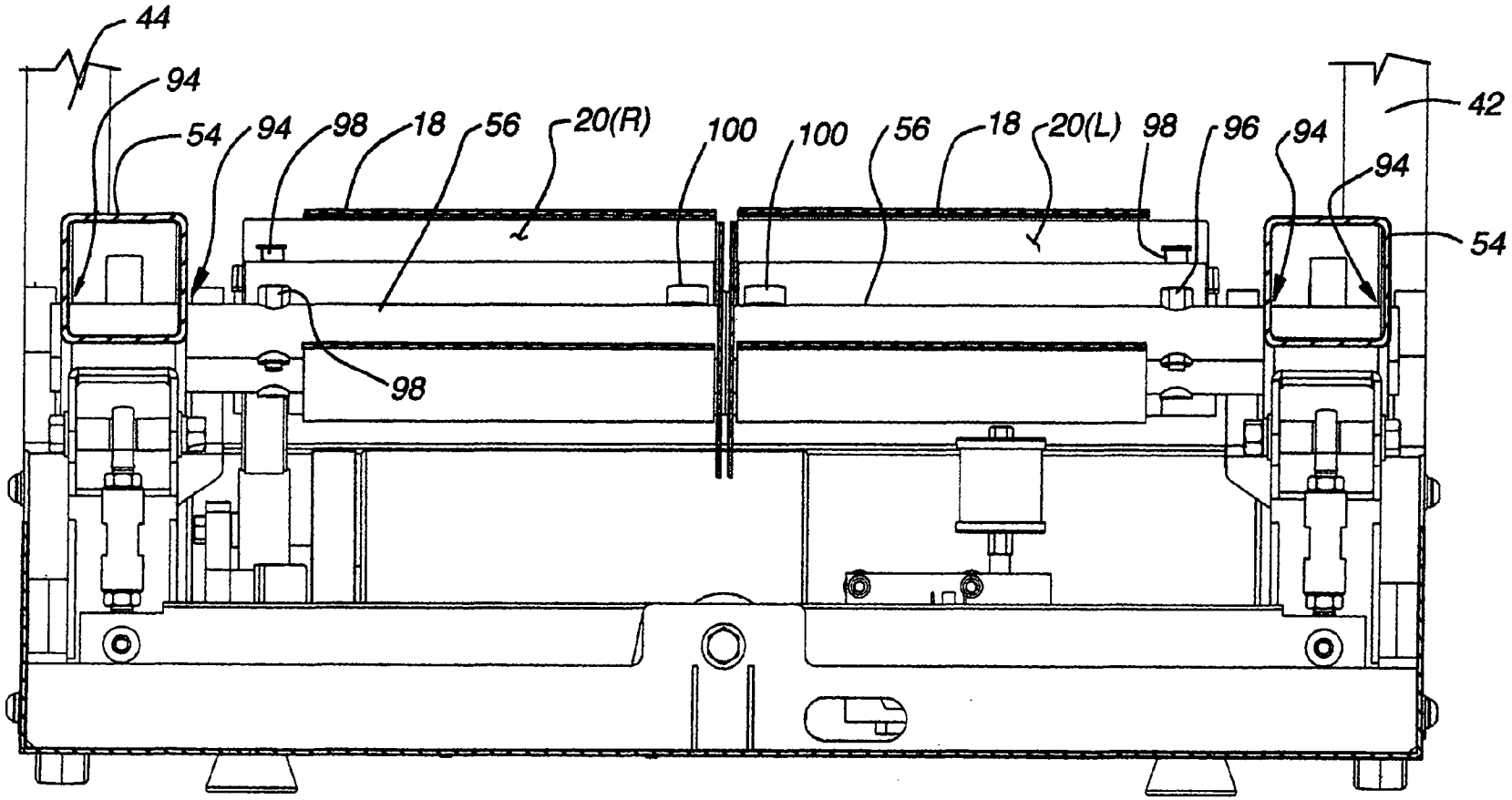
FIG. 21 is a section view taken along line 21-21 of FIG. 4.

FIG. 20 is a section view take along line 20-20 of FIG. 4, and FIG. 21 is a section view taken along line 21-21 of FIG. 4. Referring to FIGS. 11, 20 and 21, the outer or outside treadle frame members 54 are preferably square tubular members with inner, outer, upper, and lower walls. Alternatively, round tubular members or other shaped members may be used. Sets of deck support apertures 94 are defined in the inner and outer wall of each outer frame member. The deck support apertures in the inner and outer walls are aligned and arranged to support the deck support members generally perpendicular to the outer frame members. In one implementation, the deck support members are press fit into the apertures. The deck supports may also be welded to the outer members. As shown in FIGS. 20, 21, and others, the outside end region of the deck supports are positioned in an aperture in both the inner and outer wall of the outside members. In this way the deck supports are supported at two locations, but the arrangement may be still considered a cantilever as the deck support is supported generally in one region (between the inner and outer walls of the outside member) and a portion of the deck supports (in this case the inner majority of the supports) extends from the region of support. In the particular exercise device implementation shown in FIGS. 1-20 and others, the deck support members are generally cylindrical members. Other shapes, such as square tubular members, are possible.

Figure 6:
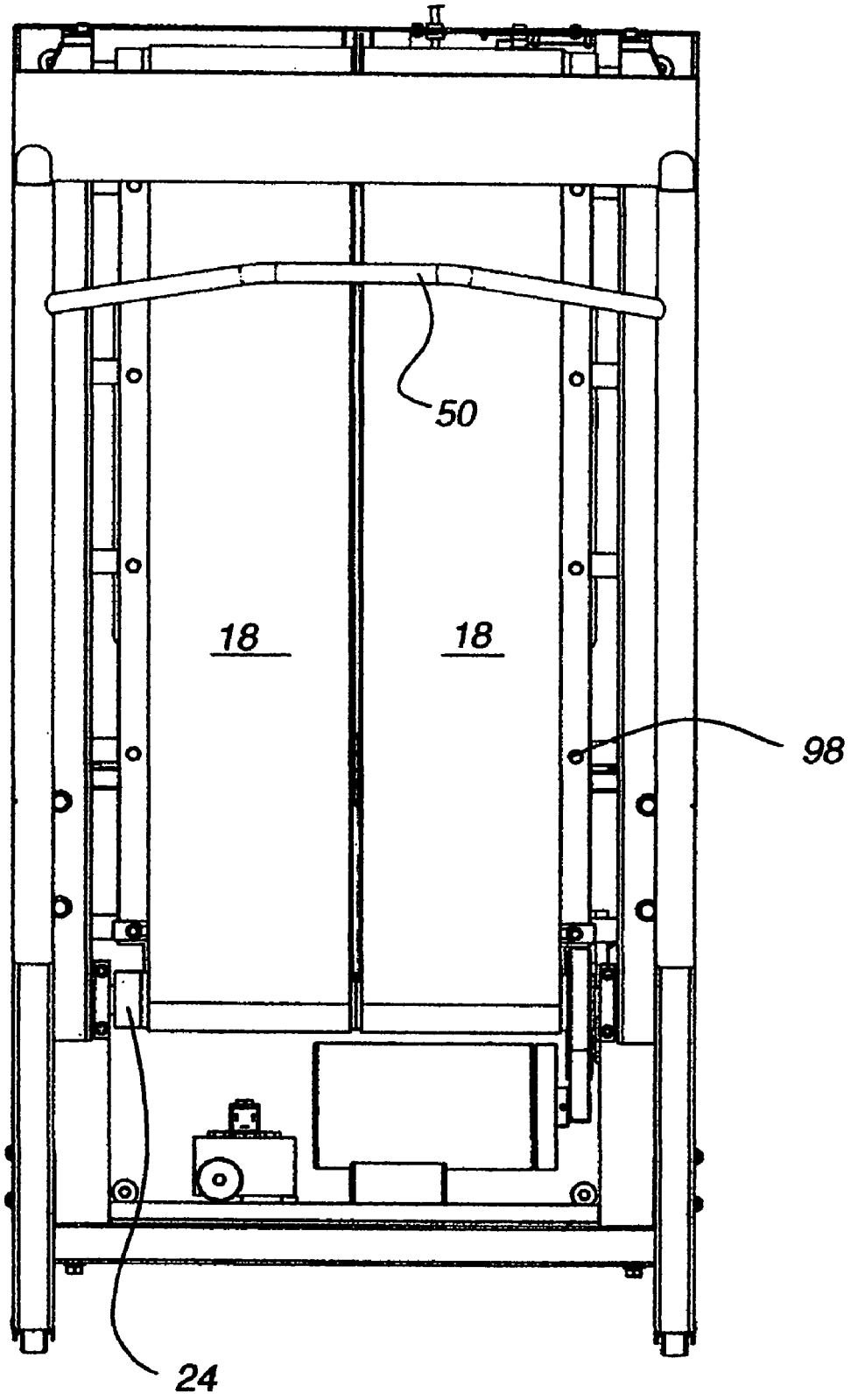
FIG. 6 is top view of the exercise device shown in FIG. 2.

Referring again to FIG. 11 as well as FIG. 21 and others, adjacent the outer treadle frame members 54, each deck support member 56 includes a boss 96. Each boss defines a threaded aperture generally perpendicular to the overlying deck 20. The threaded apertures receive corresponding bolts 98 that secure the deck to the deck support members. The bolt heads protrude upwardly from the top of the deck. As best shown in FIGS. 1, 2, and 6, the outer edge of the belts 18 are arranged slightly inward of the bolt heads so as not to interfere with or rub on the bolt heads. Alternatively, the bolt heads may be countersunk in the top surface of the deck, in which case the belt may overly the bolts.

Still referring to FIGS. 11, 21, and others, a rubber, neoprene, polyurethane, or other flexible resilient deck suspension member 100 is located adjacent the inner end of each deck support member. The deck suspension member is generally cylindrical, but other shapes and sizes may be employed. The deck suspension members are arranged between the deck and the respective deck suspension member. During use, the landing force of a user is translated through the belt and deck to compress the suspension member. In this way, the suspension member helps reduce impact stresses and provides a slightly softer foot landing during use. Additionally, on impact, the deck support members 56 may deflect slightly downward to provide some additional measure of impact stress reduction. The upper surface of each deck suspension member is generally flat and aligned with the upper edge of the corresponding boss 96, to evenly support the deck. Although not shown, a pin extends from the lower surface of the deck suspension member. To secure the suspension member to the deck support member, the pin is pressed into a corresponding hole (also not shown) in the deck support member. The pin may be threaded, press fit, snap fit, or otherwise secured in the holes.

The deck suspension member may also comprise a flexible resilient suspension sleeve or band. In one example, the sleeve is of a lesser diameter than the deck support member. To secure the sleeve to the deck support member, the sleeve is stretched over the deck support member and held in place by the restrictive forces of the sleeve. The sleeve may be of any width such that it may only be deployed along a portion of the deck support member or along the entire length of the deck support member. The deck support member may also define a circumferential groove or notch to laterally retain the suspension sleeve. Alternatively, the deck support may include a hard (non-compressible) member located on the deck support member in place of the suspension member.

The rear of each treadle assembly (12, 14) is pivotally supported at the rear of the frame so that each treadle assembly may pivot up and down. The front of each treadle assembly is supported above the frame by one or more dampening or "resistance" elements, an interconnection member, or a combination thereof. Depending on the configuration, the treadle assemblies may pivot independently, or may pivot in relation to the other (i.e., one pivots up, the others pivot down).

Figure 22:
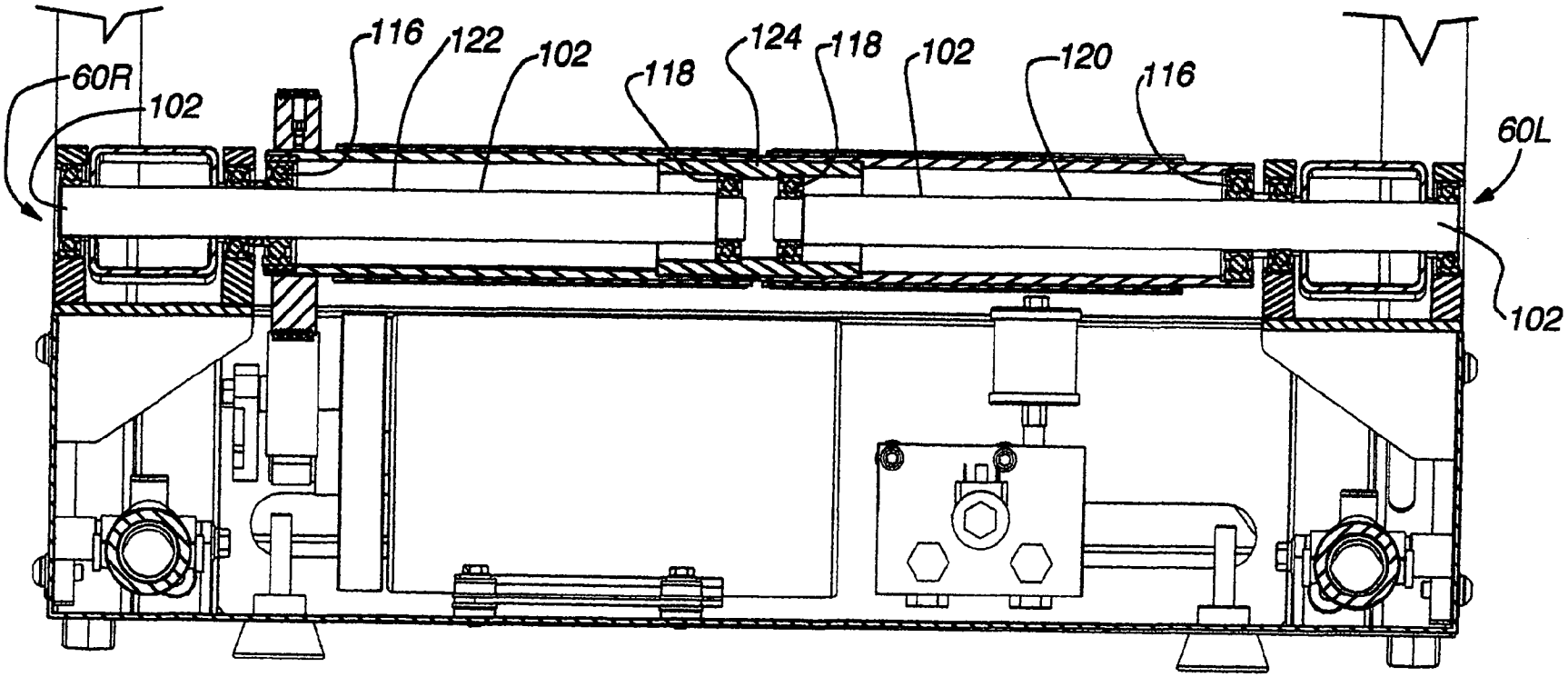
FIG. 22 is a section view taken along line 22-22 of FIG. 4.
Figure 23:
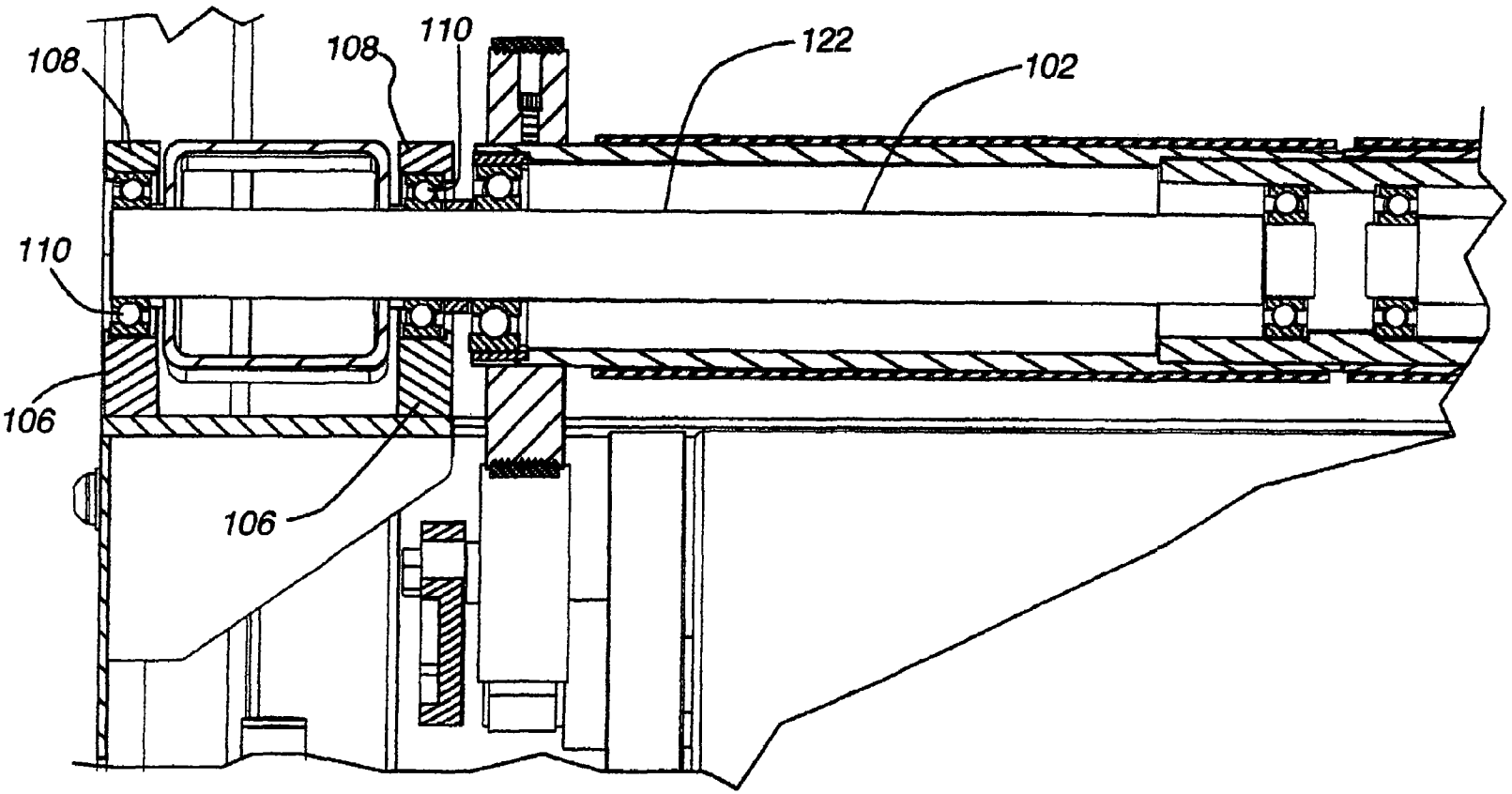
FIG. 23 is a close-up section view of FIG. 21.

FIG. 22 is a section view taken along line 22-22 of FIG. 4. FIG. 23 is an enlarged partial section view of FIG. 22. Referring to FIGS. 7, 11, 22, 23 and others, each treadle assembly (12, 14) is pivotally supported near the rear of the frame. In one particular implementation, left and right rear axle support assemblies 60 are positioned at or near the left rear and right rear of each respective treadle assembly and generally the exercise device. The rear axle support assembly pivotally supports a rear axle 102 (the common pivot axis of the treadles, in one implementation). The rear axle extends between the left and right support assemblies and pivotally supports the left and right treadle assemblies. The rear axle may be a contiguous member, or may be an assembly of distinct pieces.

Referring particularly to FIG. 11, at the rear of the exercise device, shelves 104 extend inwardly from the top surface of each side panel (30, 32) at the rear of the device. The rear axle support assemblies are fixed to each corresponding shelf. Each rear axle support assembly 60 includes a pair of laterally offset lower bearing supports 106 and a pair of corresponding laterally offset upper bearing supports 108. The lower and upper bearing supports define semicircular features, respectively, that cooperate to define a circular aperture for supporting radial ball bearing assemblies 110. The end portions of the rear axle are rotatably supported in respective rear axle support assemblies. Each rear axle support assembly includes two spaced apart radial ball bearings 110. As shown best in FIGS. 22 and 23, each end region of the rear axle is rotatably supported by a pair of laterally offset radial ball bearings.

Figure 24:
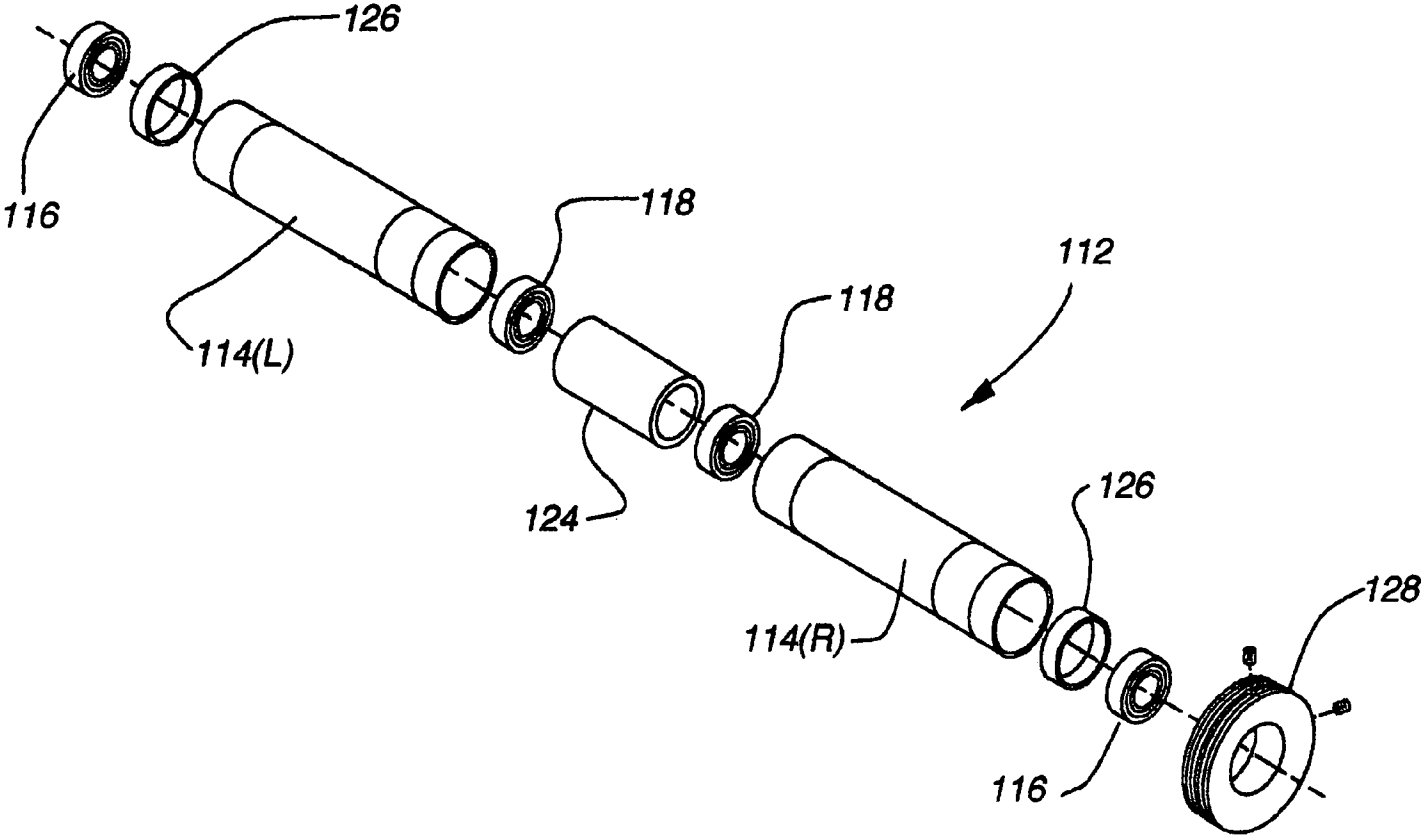
FIG. 24 is an exploded view of a rear roller assembly, in accordance with aspects of the present invention.

Referring to FIGS. 22, 23, and FIG. 24 (an exploded view of a rear roller assembly), a rear roller assembly 112 includes the left and right rear rollers 24. The rear roller assembly is shown with two distinct belt engagement surfaces (the left roller and right rollers); the roller assembly, however, presents a single continual outer surface. It is possible to have a single rear roller with a single axle, a pair of distinct rollers on a single axle or pair of axles. Further, it is possible to have a common axle line between the rollers and the treadles, or have distinct axle lines between the roller and treadles. For example, the treadles may pivot about a line forward, forward and below, etc. of the roller axle.

Each rear roller section comprises an outer cylindrical member 114 rotatably supported on the rear axle 102 by an inner and an outer radial bearing (116, 118). The tread belt for each treadle assembly engages the corresponding outer cylindrical members. In one implementation, each cylindrical member defines a slightly bulging outer contour, with the apex of the bulge circumferentially arranged at about a midpoint of the cylindrical member. The bulge-shape helps to keep the tread belt centered on the rear rollers. In one particular implementation, the outer cylindrical member has an increasing radial dimension from the outside edges toward the longitudinal center of the outer cylindrical members. The increasing radial dimension may be uniform or may be stepped such that there in an increasing radial dimension and a generally uniform radial dimension centered about the midpoint of the outer cylindrical members. Alternatively, the outer cylindrical members 114 may define a uniform radial dimension along the length of the cylinders.

In addition to the crowned or bulging shape of the rear rollers (it is also possible to provide crowned front rollers), one implementation of the present invention, includes a belt guide 118 (see FIGS. 10, 25, 27, and others) fixed to the deck just forward the rear roller assembly 112, to help maintain alignment of the belts 18. The belt guide defines a tapered or ramped surface configured to engage the outside edge of the tread belt. The stride of people primarily has a longitudinal force component which causes forward propulsion during striding. However, most people also have a slight outward or lateral force component in their stride. This lateral force component acts on the belts, which can misalign the belts. Particularly, the rear of the belts may be forced outwardly on the rear rollers. Thus, the belt guides are placed on the treadles to engage the outside rear surface of the tread belts. The interaction of the belt guides on the belts helps to keep the belts appropriately aligned between the rollers, and to counteract the lateral striding force of most users.

Referring again to FIGS. 22, 23, and 24, the rear axle 102 supports the rear roller assembly for each treadle assembly, in one particular embodiment. Thus, the left and right rear rollers are rotatably supported about a common rear axis, which is also the common rear pivot axis of the treadles. In one particular implementation, the rear axle 102 has a first (left) section 120 and a second (right) section 122. Each rear axle section includes an axle rod, with the axle outer ends protruding from the associated rollers and supported by the respective axle support assemblies 60. The inner ends of each axle section are coupled together by a sleeve 120 (also referred to herein as a "collar"). The outer cylinders of each roller are pressed over the sleeve, effectively intercoupling the outer cylinders (and intercoupling the rollers) so that the they rotate in unison. The sleeve is rotatably supported by the pair of radial ball bearings 118 positioned at the inner ends of each section of the rear axle. The outside ends of each roller are also supported by the radial ball bearing 116 adjacent the respective axle support assemblies. Thus, each roller is rotatably supported on the rear axle by radial ball bearings oriented to each side of the roller. Additionally, through the sleeve, the rollers rotate together about the rear axis.

Unified by the sleeve 124, the roller assembly rotatably supported on the axle sections (120, 124) provide a structurally rigid support along the back of both treadle assemblies (12, 14). Particularly, the rollers and sleeve are rotatably supported on the rear axle rods by four radial ball bearings (116, 118). Thus, the rollers are rotatably coupled with the rear axle. Additionally, each outer end region of each section of the rear axle is supported by a pair of bearings 110 in the respective support assemblies 60. The roller assembly avoids having some type of axle support bracket or the like coupled with the frame along the length of the axle between the ends.

During use, when each treadle pivots, the respective axle sections (120, 122) also pivot. However, the axle sections pivot oppositely; thus, when one is pivoting clockwise the other is pivoting counterclockwise, and vice versa. Through the configuration of the roller assembly and axle sections, the axles may pivot in opposite directions while the rollers rotate together. The sleeve provides the connection between the rollers while at the same time supporting the rear axle sections to provide a virtual unified rear axle.

As mentioned above, the outside treadle frame members pivot about the same axle 102 as the rollers. Referring to FIG. 22, the outside treadle frame members 54 are connected to the rear axle between the inner and outer bearing support assemblies (106, 108) of the respective support assemblies 60. The axle sections (120, 122) are fixed to respective outside treadle frame member 54. The axle extends outwardly from the outside treadle frame member. The outwardly extending axle section is supported in the outer bearing support assembly. Further, the rod extends inwardly from the outside treadle frame member. The inwardly extending section is supported in the inner bearing support assembly. The radial ball bearings of the rear support assemblies, rotatably support the rear axle in two locations to either side of the outside member. The inwardly extending portion of the respective axle sections also support the respective rollers. Thus, the treadles may pivot up and down with the rear axle and the rollers may rotate about the axle.

In order to maintain the proper tolerances, a roller may be machined in three parts, the center sleeve section 124 and the two outer roller sections 114. To assemble the roller the inner bearings 118 are pressed into the center section, then the left and right outer sections are pressed onto the center section. To complete the roller assembly, the outer bearings 116 are pressed into bearing holders 126 and in turn these are pressed into the ends of the outer sections. Some embodiments do not include bearing holders. A roller may be made from one piece, but the machine time and cost would likely be greater than a three piece assembly.

The three-piece roller assembly provides several additional advantages. First, the rear roller assembly provides a virtual axle, allowing the axle sections to independently pivot with the treadle assemblies, and also support the roller assembly, which rotate in one direction. As discussed further below, the drive motor is attached via a belt to a drive pulley 128 connected directly to the roller assembly to drive the walking belts. Second, the rear roller assembly acts as one of the mechanisms to resist the belt tension and torsion of the treadles caused by the user. This is one reason for inner and outer bearings in the rear roller. The contact points of the bearings create a long lever arm to resist the above mentioned forces. The bearings fit over the axle rods welded on the treadle arms mentioned above. The rear rollers rotate freely about the axle rods.

There are also bearings 10 located to the inside and outside of each treadle member 54. These four bearing locations do multiple things. First, they support the treadle assembly vertically. Second, they allow the treadles to rotate up and down through 10 degrees of motion, in one example. Third, they provide a second mechanism to resist the belt tension and user applied torsion on the treadles. This design provides one o the strength aspects that allow a monoarm treadle (e.g., the outside members 54) and allows them to interact as a structure yet perform their primary functions independently.

Figure 25:
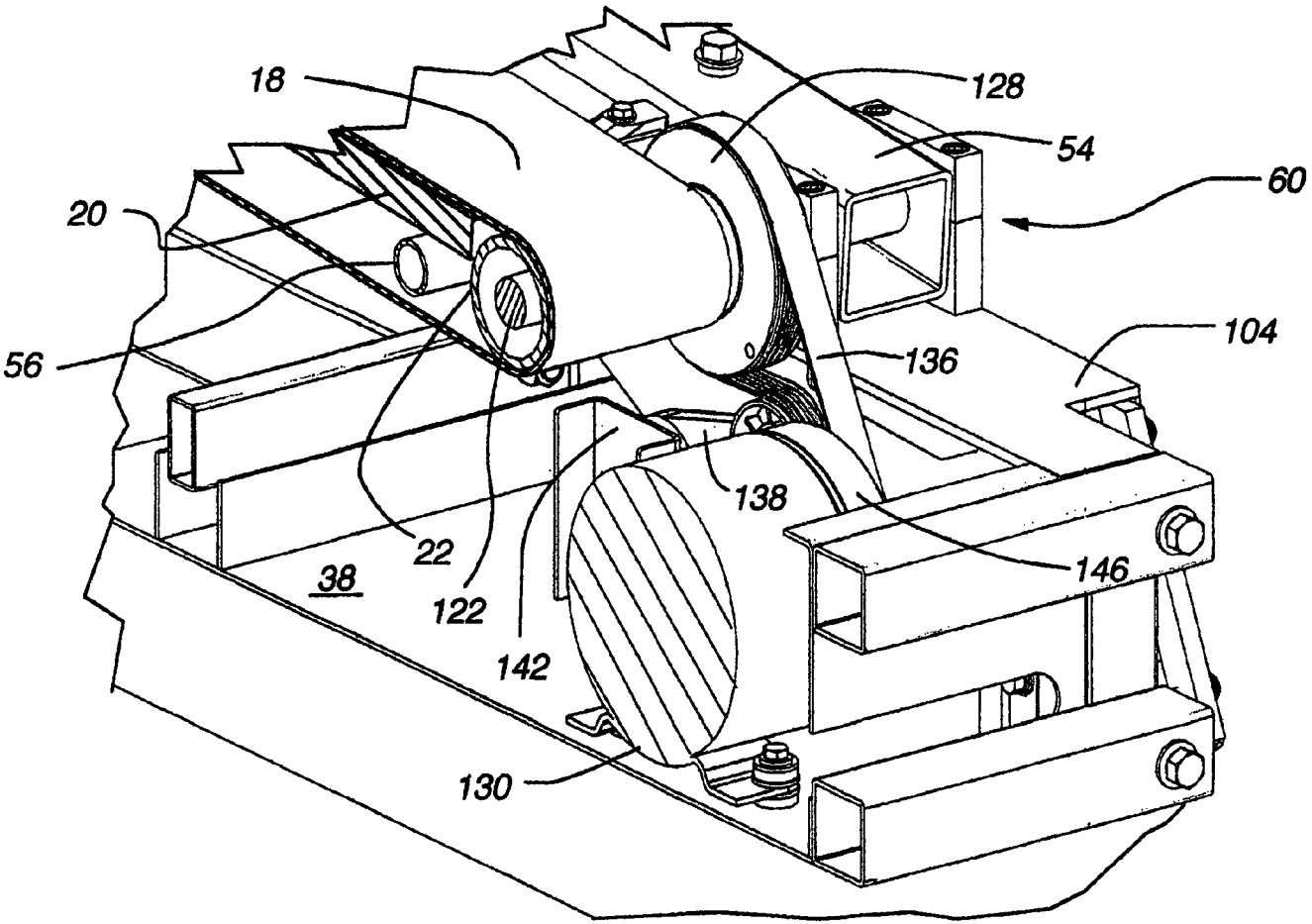
FIG. 25 is a section view taken along line 25-25 of FIG. 11.
Figure 26:
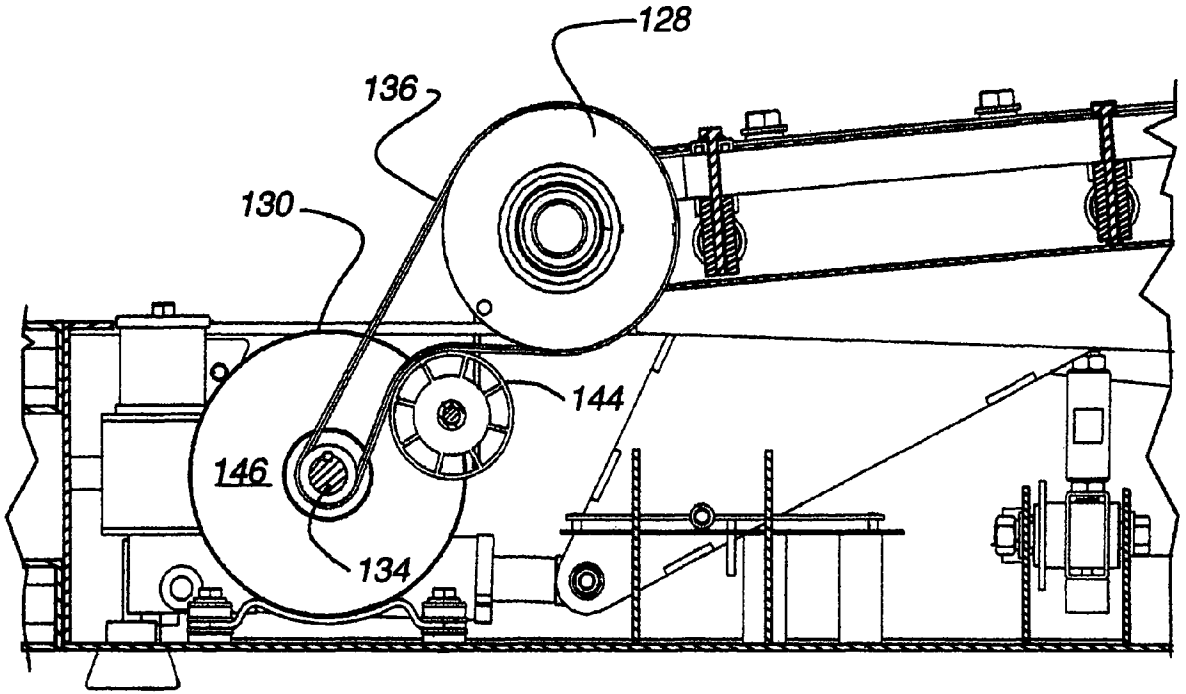
FIG. 26 is a section view taken along line 26-26 of FIG. 11.

To drive the rollers 24, which in turn drives each tread belt 18, the drive pulley 128 is secured to one of the rollers. FIG. 25 is a section view taken along line 25-25 of FIG. 11. FIG. 26 is a section view taken along line 26-26. As shown in FIGS. 25, 26, and others, in one particular implementation, the drive shaft pulley is secured to the outside surface of the right roller. More particularly, the drive pulley is secured to the outside surface near the outside end of the right roller adjacent the rear axle support assembly 60. However, the drive pulley may be secured to the left end region adjacent the left axle support assembly, or somewhere along the length of the rollers between the left and right end regions, such as between the rollers which would require slightly more separation between the treadles. A motor 130 is secured to the bottom frame panel. Just forwardly of the motor, is a motor control platform 132 for supporting the motor control, processors, and other electronic elements for controlling the motor speed and other functionality. The bottom view of FIG. 9 shows the motor mount holes and electronic control platform mounts in the bottom frame panel.

Figure 27:
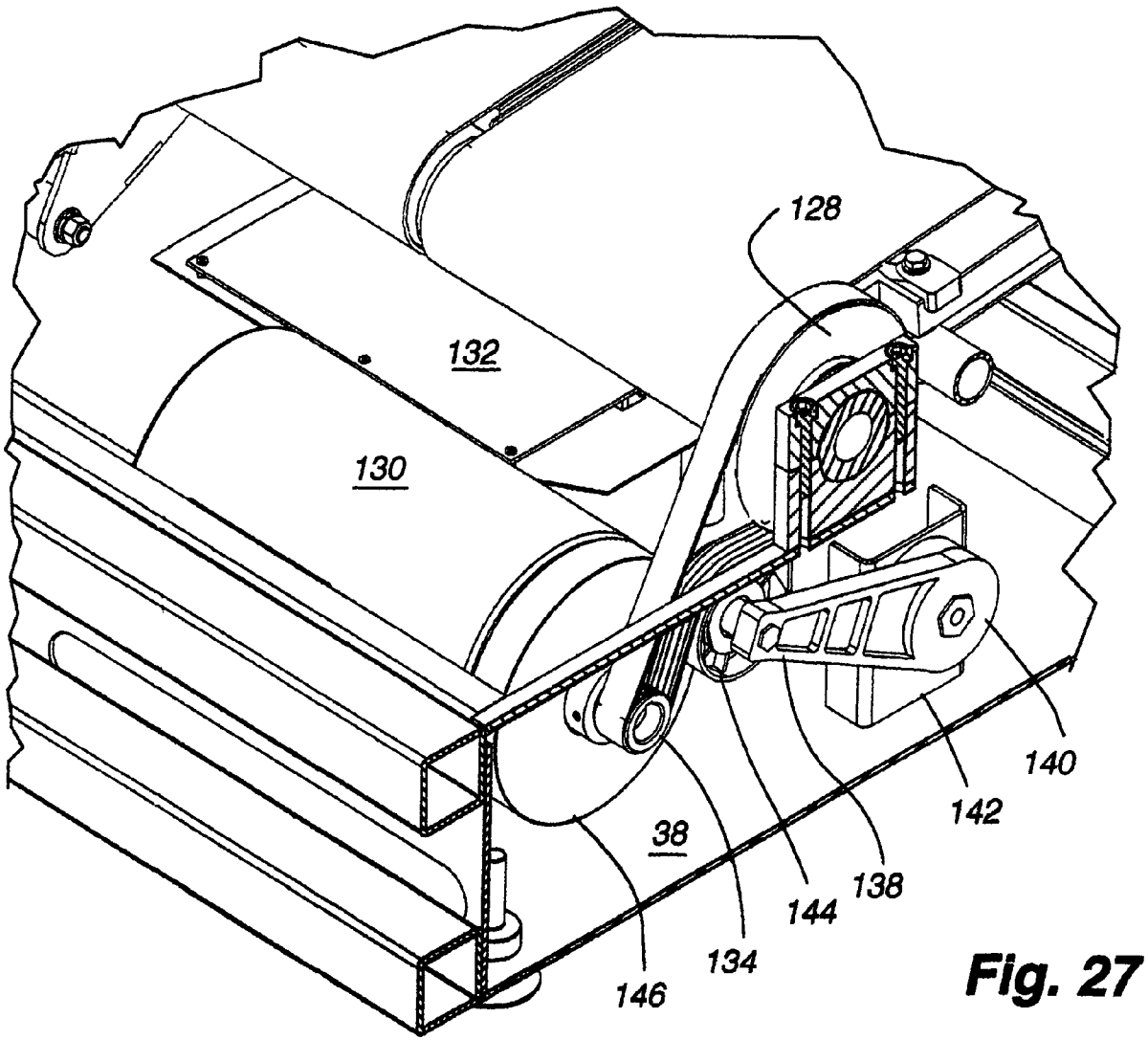
FIG. 27 is a section view taken along line 27-27 of FIG. 11.

FIG. 27 is a section view taken along line 27-27. As shown in FIG. 26, 27, and others, a motor shaft 134 extends outwardly from the side of the motor. The motor is mounted so that the motor shaft is generally parallel to the drive shaft 102 (e.g., the rear axle or the rear roller assembly). Additionally, different diameter pulleys may be connected with the motor shaft. A drive belt 136 is connected between the drive pulley and the motor shaft (or the motor shaft pulley should one be used). Accordingly, the motor is arranged to cause rotation of the rear roller assembly 112. The rollers, in turn, cause rotation of the tread belts of each treadle.

Figure 28:
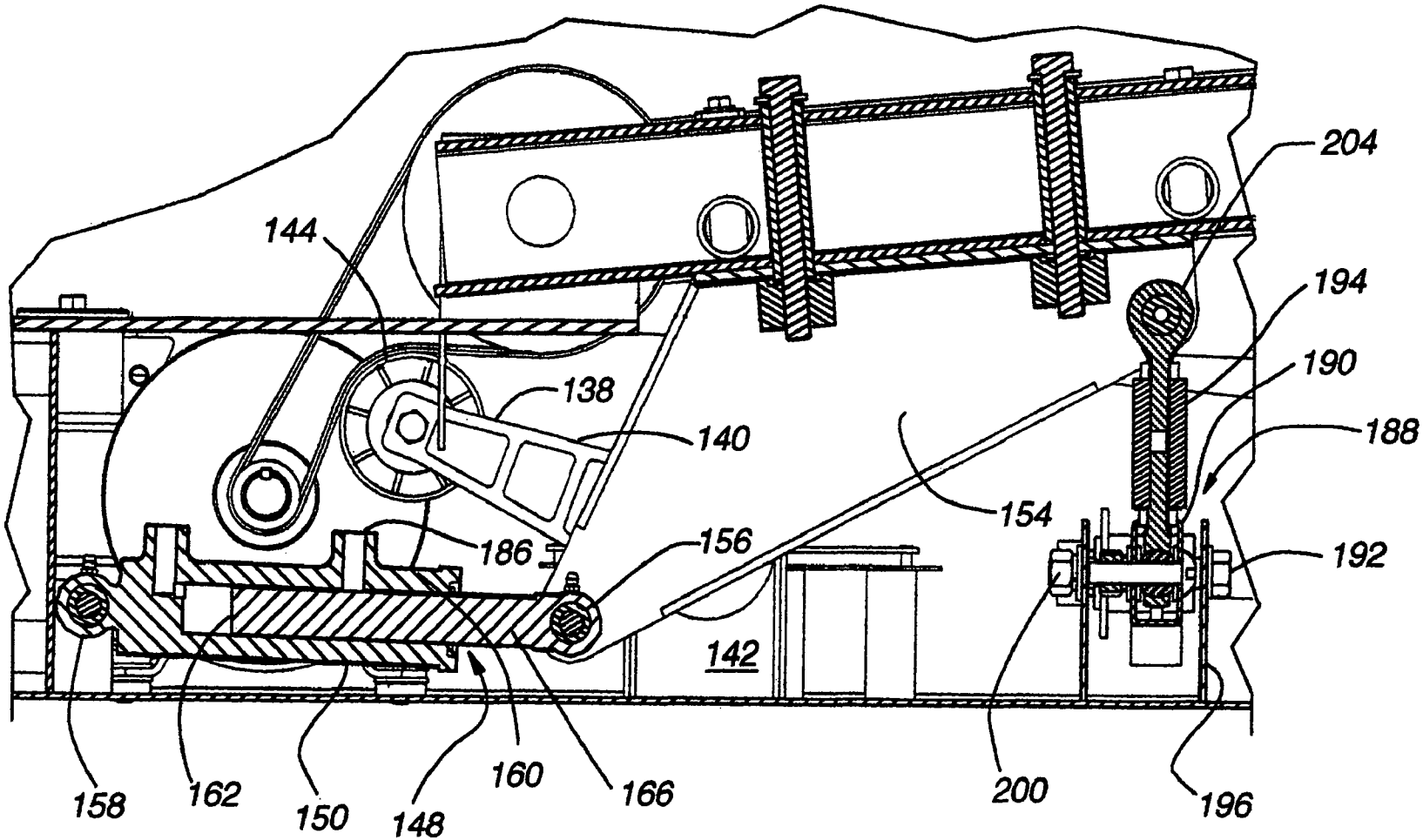
FIG. 28 is a side section view taken along line 28-28 of FIG. 11.

FIG. 28 is a side section view taken along line 28-28. Referring primarily to FIGS. 26, 27, and 28, in one particular implementation of the invention, a belt tensioner assembly 138 is employed to provide the proper tension on the drive belt 136. The belt tensioner assembly comprises a tensioner arm 140 rotatably coupled to a tensioner bracket 142 connected to the bottom panel 38. The tensioner arm rotatably supports a tensioner pulley 144 distally from the rotatably connection of the tensioner arm 140. The tensioner pulley engages the drive belt 136 between the drive pulley 128 and the motor shaft 134. The orientation of the tensioner arm may be adjusted to place the appropriate tension on the drive belt. During use, variable loads are placed on the tread belt, which in turn causes variable forces on the rear rollers. Typically, the tensioner arm is adjusted so that the drive belt does not slip on the drive pulley or motor axle (or motor pulley) due the variable forces imparted during use. Moreover, the belt tensioner assembly provides a convenient way to adjust drive belt tension should the drive belt stretch over time.

Alternatively, an elastic drive belt is employed, which eliminates the need for a tensioner. One example of a flexible belt that may be employed in embodiments conforming to the invention is the Hutchingon Flexonic™ belt.

A flywheel 146 may be secured to the outwardly extending end region of the motor shaft. During use, the tread belt 18 slides over the deck 20 with a particular kinetic friction dependant on various factors including the material of the belt and deck and the downward force on the belt. In some instances, the belt may slightly bind on the deck when the user steps on the belt, which is associated with an increased kinetic friction between the belt and deck. Besides the force imparted by the motor to rotate the belts, the flywheel secured to the motor shaft has an angular momentum force component that helps to overcome the increased kinetic friction and helps provide uniform tread belt movement.

As best shown in FIG. 22, each roller section 22 and the sleeve 124 coupling the rollers together, are rotatably supported on the rear axle by the radial ball bearings (114, 116). In one implementation, as discussed above, the rear axle includes a first section (first axle rod) and the second section (second axle rod), and the rollers and interconnecting collar are rotabably support by two radial ball bearings on each rod. By coupling the drive pulley to the roller, the drive pulley causes rotation of the rollers about the rear axle.

It is also possible to separate the roller rotation and power each roller through separate motors with a common motor control. In such an instance, motor speed would be coordinated by the controller to cause the tread belts to rotate at or nearly at the same pace. The motor or motors may be configured or commanded through user control to drive the endless belts in a forward direction (i.e., from the left side perspective, counterclockwise about the front and rear rollers) or configured to drive the endless belts in a rearward direction (i.e., from the left side perspective, clockwise about the front and rear rollers).

In one implementation, an AC motor is used to power the rollers. With an AC motor, the belt speed may be directly obtained from the AC motor controller. Related U.S. Application No. 60/548,811 titled "Dual Treadmill Exercise Device Having A Single Rear Roller" filed Feb. 26, 2004, which is hereby incorporated by reference herein, and filed on the same day as this application, describes an AC motor and control system that may be employed in one implementation of the present invention. Particularly, a belt speed control unit ("BSCU") controls the speed of the belts on the treadles based upon belt speed control signals received from a central processing unit ("CPU").

The CPU may be utilized to control various aspects of the operation and/or functions of the apparatus. More specifically, the CPU provides those output signals necessary to control the operation of the apparatus including, but not limited to, the driving of the tread belts and the resistive force applied to either treadle. Such output signals are desirably in a digital format, but, may also be provided as analog signals should a specific implementation so require. Further, the output signals are generally communicated over a wired medium, but, wireless connections may also be utilized to communicate any signals to/from the desired device, sensor, activator, apparatus or otherwise, which may be local to or remote from the control unit. Similarly, the CPU receives various input signals from sensors, users and others which assist the CPU in controlling the operation, features and functions of the apparatus, determining work performed by an exerciser using the apparatus, and other features and functions. Such input signals may also be communicated to the CPU via wired and/or wireless communication links.

In an exercise device employing a DC motor, a belt speed sensor (not shown) may be operably associated with the tread belt to monitor the speed of the tread belt. In one particular implementation, the belt speed sensor is implemented with a reed switch including a magnet and a pick-up. The reed switch is operably associated with the drive pulley to produce a belt speed signal. More particularly, the magnet is imbedded in or connected with the drive pulley, and the pick-up is connected with the main frame in an orientation to produce an output pulse each time the magnet rotates past the pick-up. Other orientations of the reed switch are possible. Moreover, other sensors or electronic elements may be employed to monitor, detect, or otherwise provide the belt speed.

Certain embodiments of the present invention may include a resistance structure operably connected with the treadles. As used herein the term "resistance structure" is meant to include any type of device, structure, member, assembly, and configuration that resists the pivotal movement of the treadles. The resistance provided by the resistance structure may be constant, variable, and/or adjustable. Moreover, the resistance may be a function of load, time, heat, or of other factors. Such a resistance structure may dampen the downward and/or upward movement of the treadles. The resistance structure may also impart a return force on the treadles such that if the treadle is in a lower position, the resistance structure will impart a force to move the treadle upward. Providing a resistance structure with a return force may be used in place of the interconnection member or in conjunction with the interconnection member. The term "shock" is sometimes used to refer herein to as one form of resistance structure, or to a spring (return force) element, or a dampening element that may or may not include a spring (return) force.

FIGS. 30-32 and 34 are partial isometric views of the rear of the exercise device with many components removed to illustrate one implementation of a resistance structure and its connection to the treadles. Also, as discussed in greater detail below, FIGS. 30-34 also highlight one implementation of an interconnection assembly, as well as other components. Referring to FIGS. 28, and 30-34, and others, in one particular configuration of the exercise device, a treadle resistance structure 148 is coupled between each treadle assembly (12, 14) and the frame 26 to support the front of the treadle assemblies above the frame and to resist the downward movement of each treadle. The resistance structure may be arranged at various locations between treadle frame and the main frame. In one particular arrangement shown herein, the resistance structure is located below and to the rear of the treadles. Arranged as such, the resistance structure, for the most part, is hidden from view under a panel. Additionally, it is unlikely that the user will inadvertently bump into or interfere with the resistance structure during operation of the device or mounting or dismounting the device.

Other possible resistance structures and arrangements of the same that may be employed in an exercise device conforming to aspects of the present invention, are illustrated in various applications incorporated by reference herein.

Figure 32:
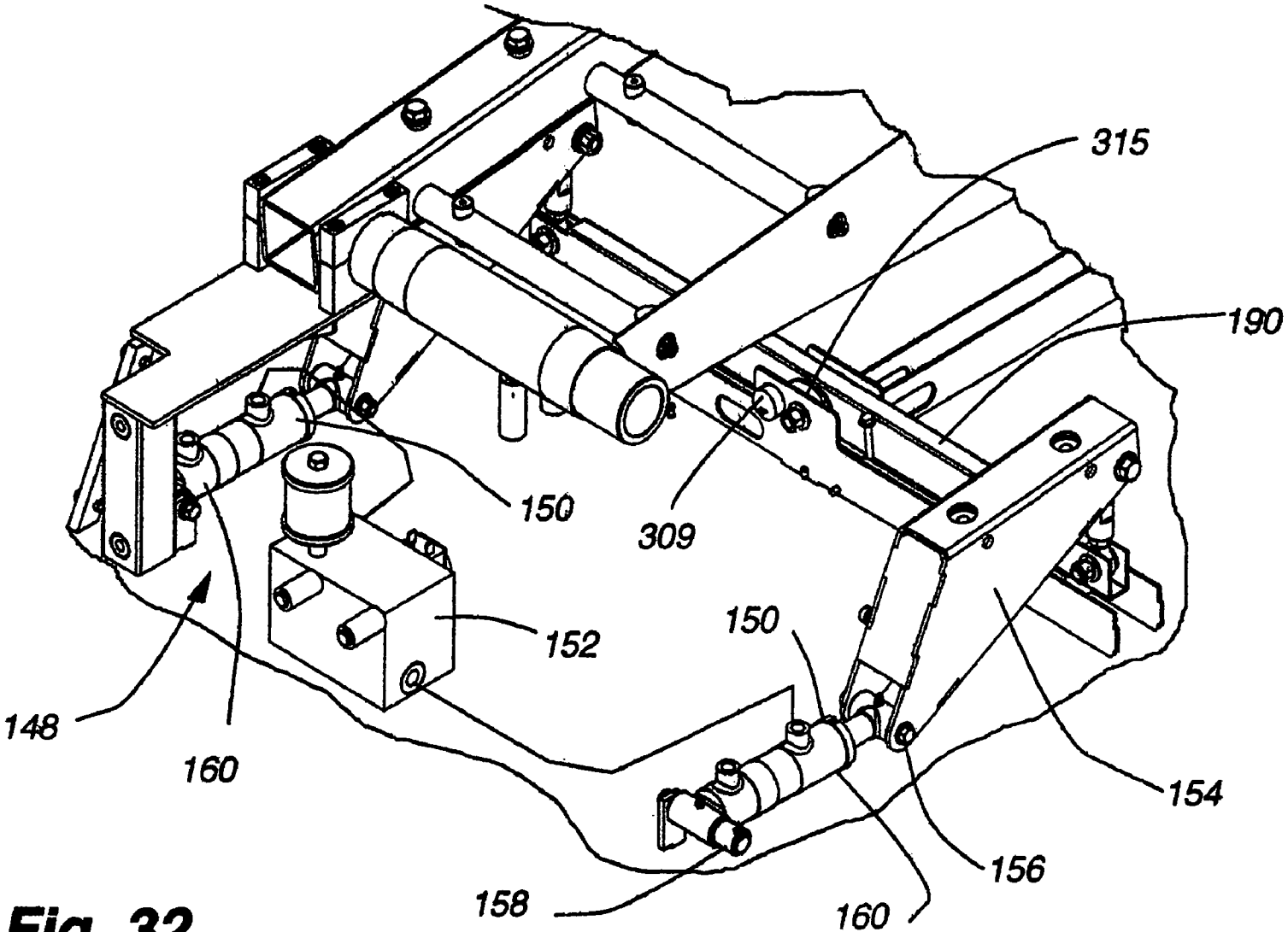
FIG. 32 is an isometric view similar to FIG. 31 with further components removed to further illustrate the interconnect structure and the hydraulic resistance structure.

The resistance structure 148 includes a first and second piston-cylinder assembly 150 operably coupled with a respective treadle assembly. The piston-cylinders are each operably coupled with a common valve assembly 152. As with many parts of the exercise device, the piston-cylinder 150 at the right side of the device and its connection to the frame and right treadle is very similar to the piston-cylinder connected between the frame and the left treadle. Thus, the right side piston-cylinder assembly and its interconnection with the right treadle and frame is discussed in detail. Referring first to FIGS. 28, 32, and others, a resistance bracket 154 is connected with the underside rear portion of the treadle assembly. The resistance bracket is generally triangularly shaped. One surface of the bracket is connected by two bolts to the bottom surface of the outside treadle frame member 54, just forward of the pivot support assembly 60. The bracket is arranged such that one point of the triangular shape is located generally below the rear axle. The point of the bracket below the rear axle defines an aperture 156 for pivotally supporting (at a front resistance pivot) a front portion of the right piston-cylinder. The rear portion of the right piston-cylinder is pivotally supported in a rear resistance pivot 158 adjacent the rear face of the frame.

The hydraulic piston-cylinder assemblies 150 generally defining a cylinder 160 holding hydraulic fluid with a piston 162 connected between each treadle and the frame. The hydraulic cylinders 154 are in fluid communication, such as with hoses 164, through the valve 152. Pivotal movement of the treadles activates the pistons in a back and forth motion. Through back and forth activation of the piston, hydraulic fluid is pushed from one cylinder to the other through the valve. Adjustment of the valve imparts a hydraulic resistance on the fluid flowing between the cylinders, which imparts a resistance to the pivotal movement of each treadle.

The rear of the piston-cylinder 150 is pivotally coupled to the frame at the rear pivot 158. A piston rod 166 supporting the piston within the cylinder extends outwardly of the front of the piston-cylinder. The end of the rod extending outwardly of the cylinder is pivotally connected at the front resistance pivot 156. Within the cylinder, a piston is connected with the piston rod. The hydraulic cylinders are welded cylinders with 1.5" bore and 2" stroke and #6 SAE O-ring ports. The fluid may be any conventional hydraulic fluid.

Figure 29:
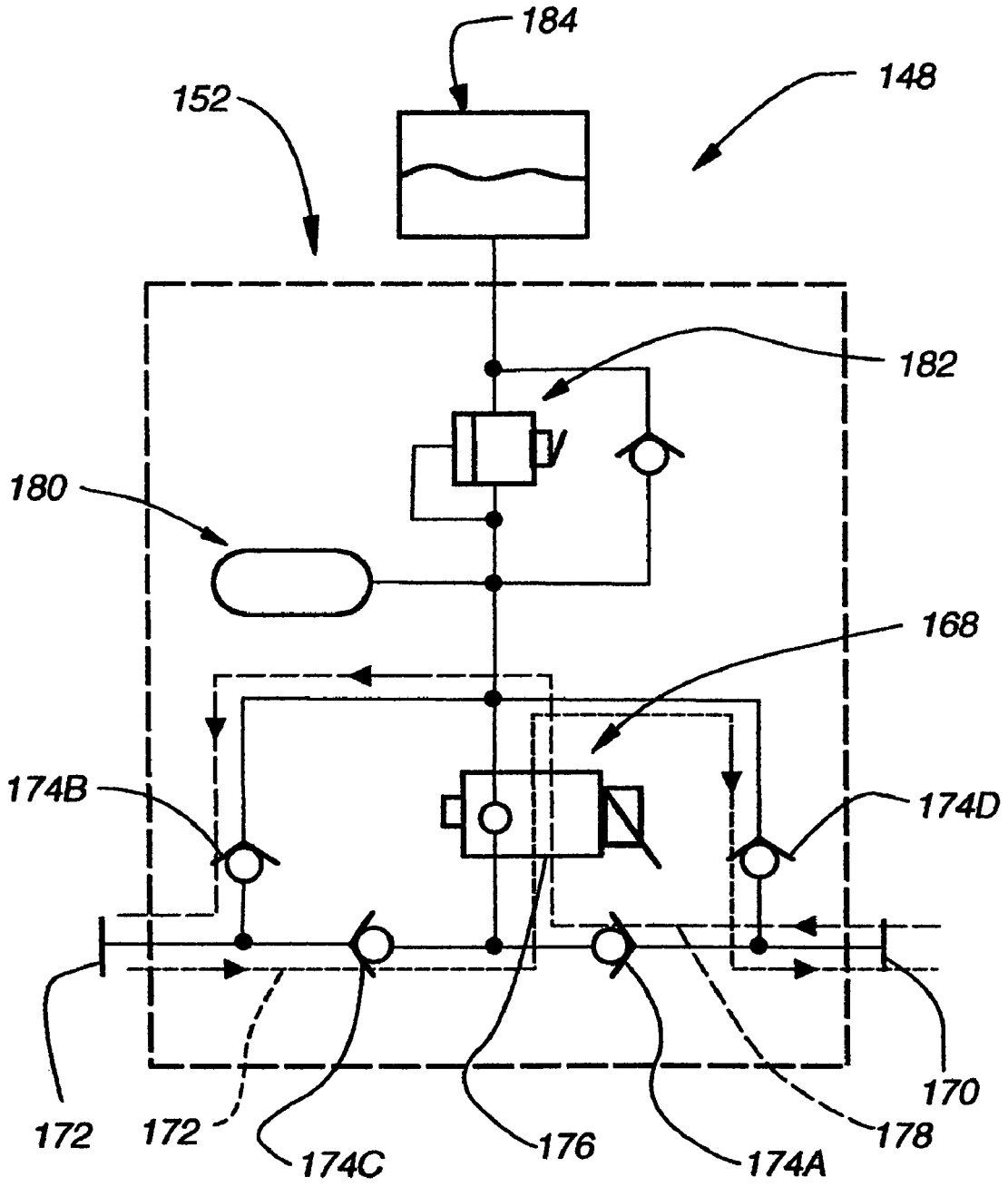
FIG. 29 is a schematic diagram of a valve assembly, in accordance with aspects of the present invention.

FIG. 29 is a schematic diagram of the valve assembly 152 fluidly coupling the piston-cylinders to control the hydraulic resistance of the resistance structure. The valve member comprises a proportional flow control valve 168 (which is mechanically or electrically adjustable), in fluid communication with a first input 170 and a second input 172. In one embodiment, the proportional valve is a two-way puppet type, normally closed, such as Hydra Force SP08-20-O-N-120E. One cylinder 160 is fluidly coupled, such as through a flexible hose, with the first input and the other cylinder is fluidly coupled with the second input. A plurality of ball valves (174A, 174B, 174C, 174D), which allow fluid flow in one direction and prevent fluid flow in the other direction, are in the flow path between the inputs and the proportional flow control valve. Particularly, a first 174A and a second 174B ball valve are arranged in a first flow path 176 that allows fluid to flow from the first input 170, through the proportional valve 168, and to the second input 172. A third 174C and a fourth 174D ball valve are arranged in a second flow path 178 that allows fluid to flow from the second input 172, through the proportional valve 168, and to the first input 170. Both flow paths are directed through the proportional valve; thus, adjustment of the proportional valve will impact the fluid flow resistance through both flow paths substantially the same. The valve assembly further includes a cavitation chamber 180, a thermal expansion compensator 182, and an overflow reservoir 184 coupled with the flow paths.

Each cylinder is coupled to a respective input (170, 172) of the valve assembly 152, and the hydraulic system is closed. When one treadles presses downward (or pulls upward) on the associated piston rod, the piston forces the hydraulic fluid in the cylinder through an outlet 136 to the associated valve assembly input. The hydraulic fluid flows through the appropriate flow path and out of the opposing valve assembly input. The outwardly flowing fluid passes into the opposing cylinder and acts against the piston therein to push the treadle upwardly (or pull the treadle downwardly). The proportional valve 168 may be open or closed respectively, to decrease or increase the fluid resistance in the flow paths, and thereby decrease or increase the effort required to actuate the treadles. Closing the valve completely will lock out the treadles so that they are prohibited from pivoting. With a resistance structure including a completely or substantially sealed hydraulic flow path between the treadles, such as is provided by the cylinder attached between the frame and each treadle and the fluid coupling the cylinders (either through a valve assembly or simply by fluidly coupling the outlet of one cylinder to the outlet of the other cylinder), the resistance structure may also provide an interconnection function of causing the displacement of one treadle to operate to displace the other treadle in the opposite direction. As such, it is possible to eliminate the mechanical interconnection assembly (discussed below), and still coordinate the reciprocation of the treadles.

Alternatively, a self-contained shock, such as is described in U.S. patent application Ser. No. 10/789,182 titled "Dual Deck Exercise Device" filed Feb. 26, 2004, may be arranged to extend between the left or outer frame member of the left treadle assembly and the left upright frame member. A second shock may be arranged to extend between the right or outer frame member of the right treadle assembly and the right upright frame member. In yet another alternative, the shocks may be connected to the front of the treadles and the underlying frame. The shocks may be combined with an internal or external spring. In such an implementation, the shock dampens and resists the downward force of the footfall to provide cushioning for the user's foot, leg and various leg joints such as the ankle and knee. The spring further provides a return force to help return the treadles to an upper orientation after the treadles have been depressed into a lower orientation by the user. In some configurations, a shock type resistance structure may also be adjustable to decrease or increase the downward stroke length of a treadle.

FIG. 32 is a section view taken along line 33-33 of FIG. 4. Referring now primarily to FIGS. 28, 32, 33, and 34, an interconnection assembly 188 is shown that coordinates the pivotal movement of one treadle with the other treadle. Generally speaking, the interconnection assembly causes the downward movement of one treadle 12 to accompany the upward movement of the other treadle 14 and vice versa. In one example, the interconnection assembly includes a teeter 190 bracket or arm pivotally supported at an interconnect axle 192. A portion of the teeter to one side of the axle is connected to one treadle and a portion of the teeter to the other side of the axle is connected to the other treadle. More particularly, a tie rod 194 is pivotally coupled at each end of the teeter bracket 18. Each tie rod is also pivotally connected to a front apex of a respective resistance bracket 154.

Figure 35A:
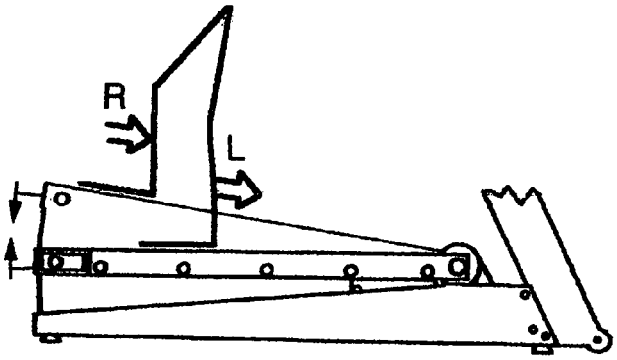
FIGS. 35A-35E illustrate the exercise device of FIG. 1 moving through half of a cycle wherein the right treadle moves from an upper position shown in FIG. 35A to a lower position shown in FIG. 35E while at the same time the left treadles moves from a lower position shown in FIG. 35A to an upper position shown in FIG. 35E.

More particularly, the teeter bracket 190 is pivotally supported on a teeter cross-member 196 extending between the left and right sides of the frame. As best shown in FIGS. 35 and 36, the teeter cross member defines a U-shaped cross section. Each upstanding portion of the U defines a pivot aperture for supporting the interconnect axle 192.

The left and right outer portions of the teeter arm include a first or left lower pivot pin 198 and a second or right lower pivot pin 200, respectively. The forward portion of the resistance brackets above the outside ends of the teeter bracket support a first or left upper pivot pin 202 and a second or right upper pivot pin 204. The tie rods 194, interconnecting the teeter with the treadles, are pivotally coupled between the upper and lower pivot pins at each side of the teeter. In one particular implementation, each tie rod defines a turnbuckle with an adjustable length. The turnbuckles are connected in a ball joint configuration with the upper and lower pivot pins.

The interconnection assembly interconnects the left treadle 12 with the right treadle 14 in such a manner that when one treadle, (e.g., the left treadle) is pivoted about the rear axle 102 downwardly then upwardly, the other treadle (e.g., the right treadle) is pivoted upwardly then downwardly, respectively, about the rear axle in coordination. Thus, the two treadles are interconnected in a manner to provide a stepping motion where the downward movement of one treadle is accompanied by the upward movement of the other treadle and vice versa. During such a stepping motion, whether alone or in combination with a striding motion, the teeter bracket 190 pivots or teeters about the interconnection axle 192.

Other possible interconnection assemblies and arrangements that may be employed in an exercise device conforming to the present invention are illustrated in various copending applications incorporated by reference herein.

It is possible to prohibit reciprocation of the treadles. Prohibiting reciprocation provides a conventional treadmill-type exercise rather than a climbing-like exercise provided by the combination of striding and stepping. In one implementation, treadle reciprocation is prohibited by completely closing the valve 168 in the fluid path between the hydraulic cylinders 160, which prevents the movement of the piston rods 166 and thereby prevents pivotal movement of the treadles.

Alternatively, in accordance with the teachings of various applications incorporated by reference herein, a mechanical (non-hydraulic) lockout assembly may be provided with an exercise device conforming to the present invention. Generally, the lock-out assembly comprises a pair of blocks that may be positioned under the treadles to block reciprocal movement of each treadle. Particularly, with such a lock-put assembly, the treadle assemblies may be locked out so as to not pivot about the rear axis. When locked out, the belts of the treadle assemblies collectively provide an effectively single non-pivoting treadmill-like striding surface. By adjusting the length of one or both of the turnbuckles 194 through rotation of the rod during assembly of the exercise device or afterwards, the orientation of the two treadles may be precisely aligned so that the two treadles belts, in combination, provide a parallel striding surface in the lock-out position.

Referring now to FIGS. 35A-43, the climbing-like exercise provided by the motion of the exercise device is described in more detail. A representative user (hereinafter the "user") is shown in forward facing use in FIGS. 35A-35E. The user is walking forward and the device is configured for climbing-type use, i.e., so the treadles reciprocate. The foot motion shown is representative of only one user. In some instances, the treadle may not move between the upper-most and lower-most position, but rather points in between. In some instances, the user may have a shorter or longer stride than that shown. In some instances, a user may walk backward, or may face backward, or may face backward and walk backward.

Figure 36:
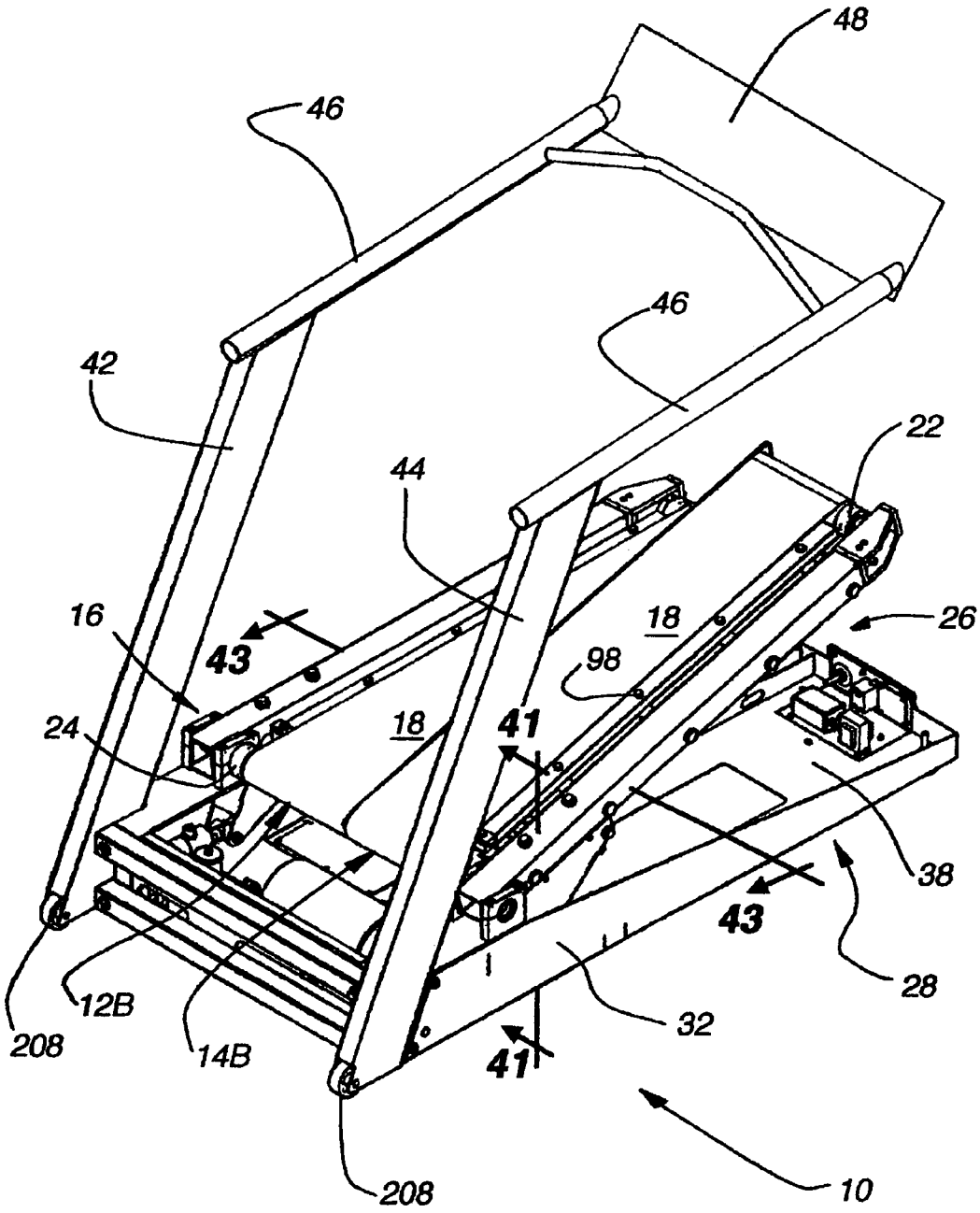
FIG. 36 is an isometric view of the exercise device of FIG. 1 with various features removed and further illustrating the right treadle in an upper pivotal orientation and a left treadle in a lower pivotal orientation.
Figure 37:
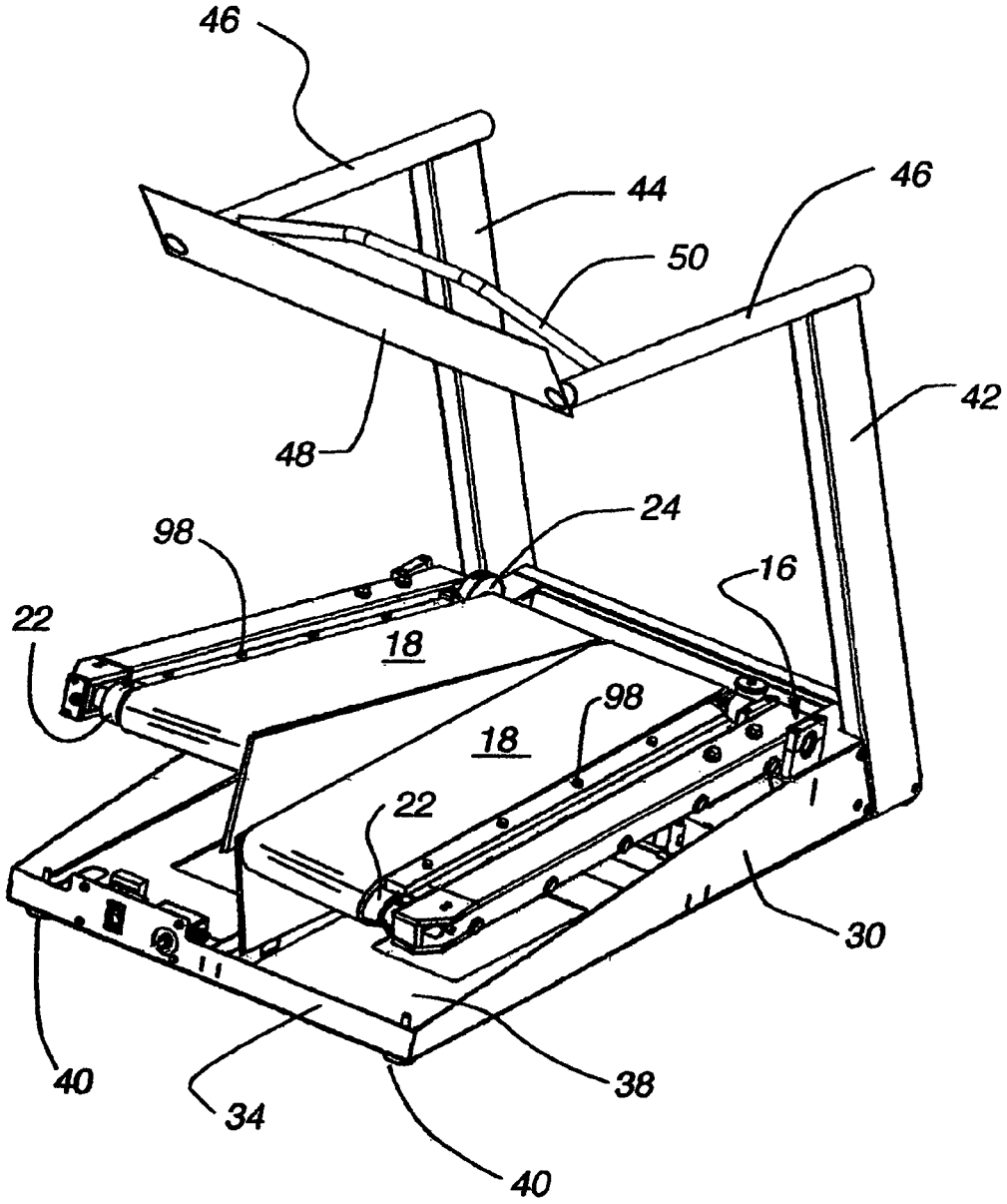
FIG. 37 is a front isometric view of the exercise device in the configuration as shown in FIG. 38.
Figure 38:
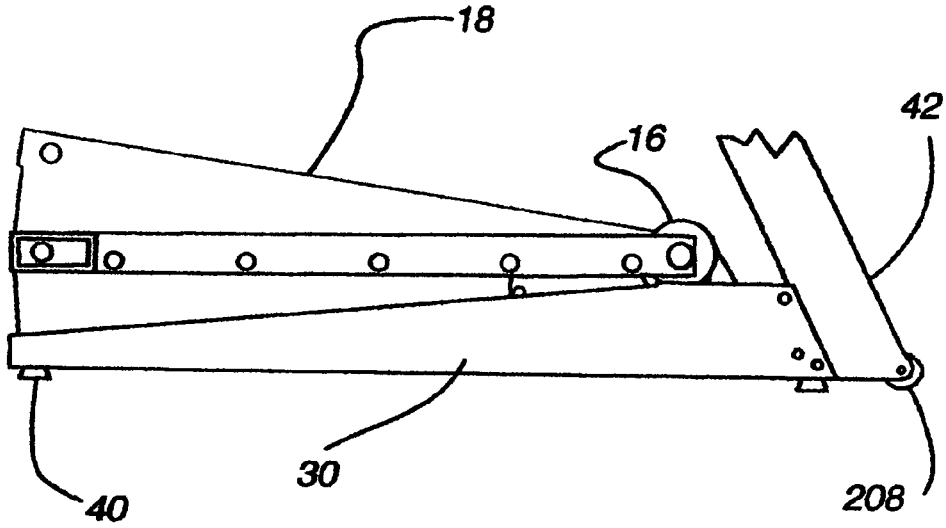
FIG. 38 is a left side view of the exercise device as shown in FIG. 36.
Figure 39:
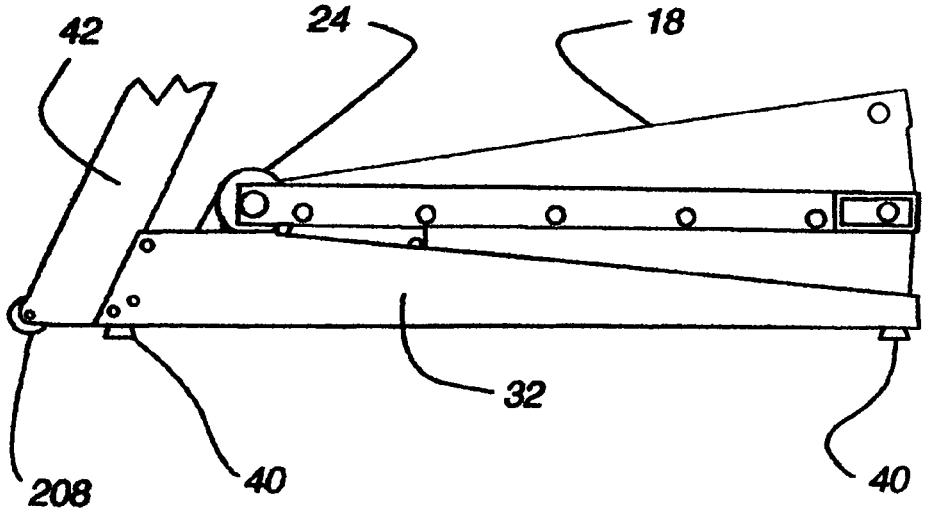
FIG. 39 is a right side view of the exercise device as shown in FIG. 36.
Figure 40:
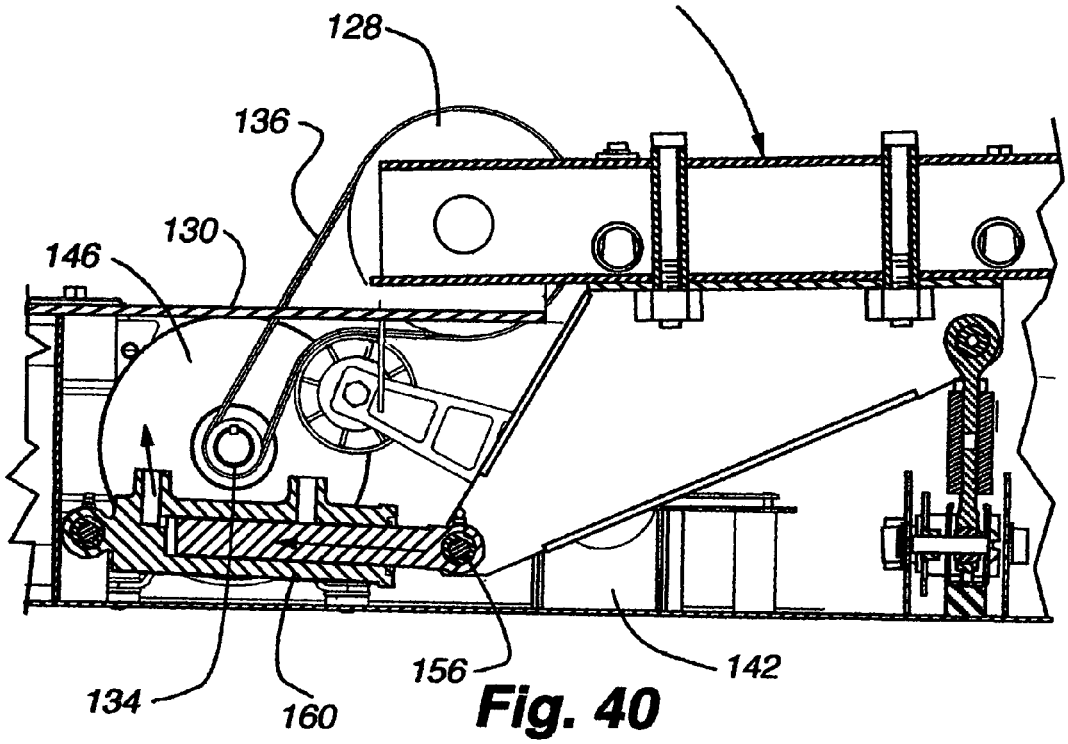
FIG. 40 is a section view taken along line 41-41 of FIG. 36, but with the right tread in a lower position rather than an upper position.
Figure 41:
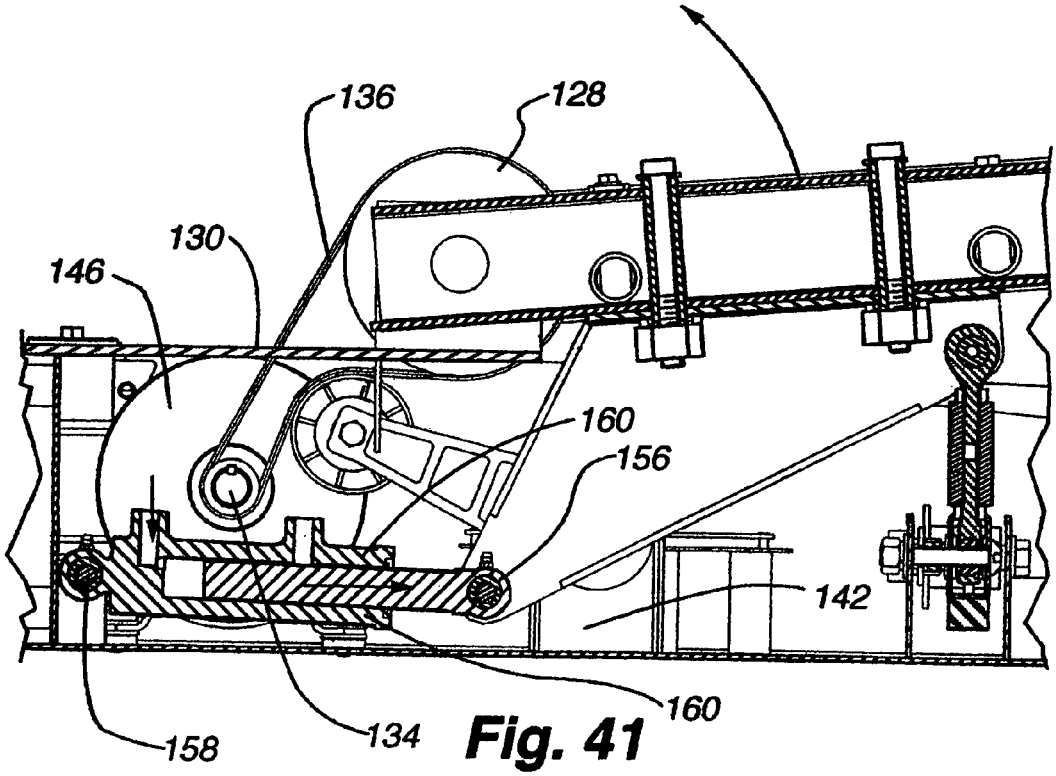
FIG. 41 is a section view taken along line 41-41 of FIG. 36.
Figure 42:
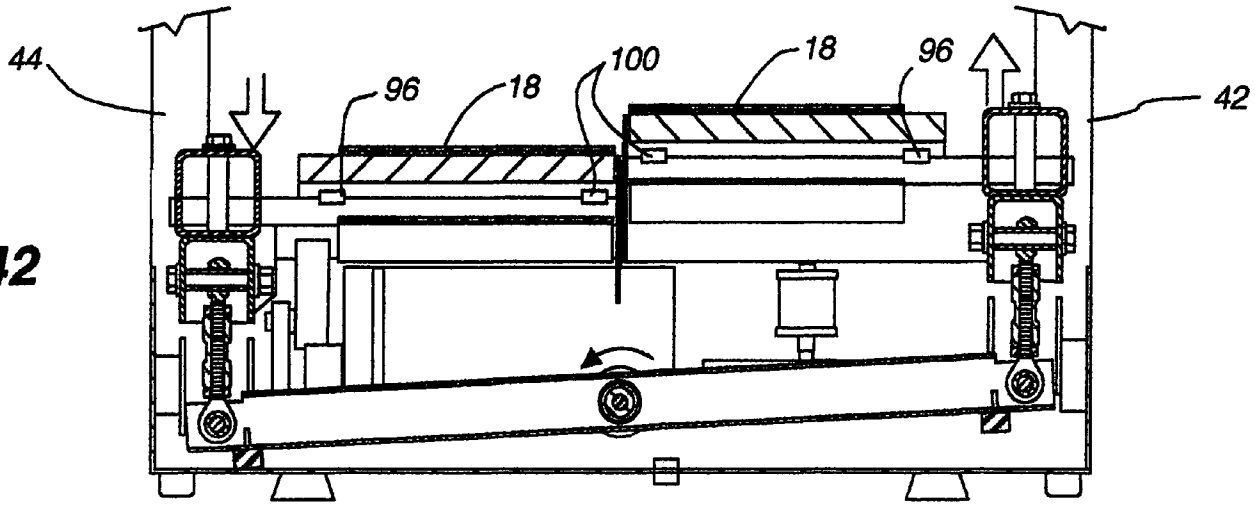
FIG. 42 is a representative section view taken along line 43-43 of FIG. 36 related to the orientation shown in FIG. 40.

FIG. 36 is a rear isometric view of the exercise device 10 with the left treadle 12 in a lower position and the right treadle 14 in an upper position. FIG. 37 is a front isometric view of the exercise device of FIG. 36. FIG. 38 is a left side view and FIG. 39 is a right side view of the device as shown in FIG. 36. FIG. 41 is a partial section view taken along line 41-41 of FIG. 36, and FIG. 40 is a representative section view. Referring to FIGS. 36-39, 41, 42, and 35A, the left side of the teeter arm is pivoted downwardly and the right side of the teeter arm is pivoted upwardly. In FIG. 35A, the user is shown with his right foot forward and on the front portion of the right tread belt 18R. In the orientation of the user shown in FIG. 35A, during forward facing climbing-type use, the user's left leg will be extended downwardly and rearwardly with the majority of the user's weight on the left treadle. The user's right leg will be bent at the knee and extended forwardly so that the user's right foot is beginning to press down on the right treadle 14. From the orientation shown in FIG. 35A, the user will transition his weight to a balance between the right leg and the left leg, and begin to press downwardly with his right leg to force the right treadle downwardly. Due to the movement of the belts, both feet will move rearwardly from the position shown in FIG. 35A.

Figure 35B:
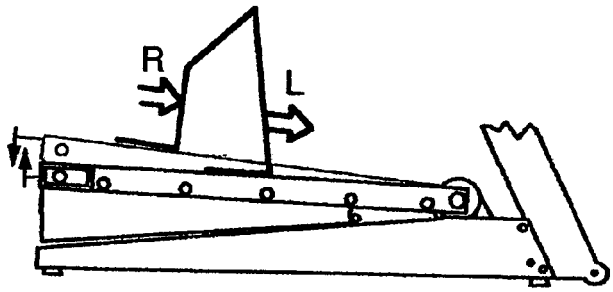

FIG. 35B shows the orientation of the device and the user in a position after that shown in FIG. 35A. The right treadle 14 is being pressed downwardly, which, via the interconnection structure 188 and/or the resistance structure 148, causes the left treadle 12 to begin to rise. The user's right foot has moved rearwardly and downwardly from the position shown in FIG. 35A. The user's left foot has moved rearwardly (from the belts) and upwardly (from the treadle) from the position shown in FIG. 35A.

Figure 35C:
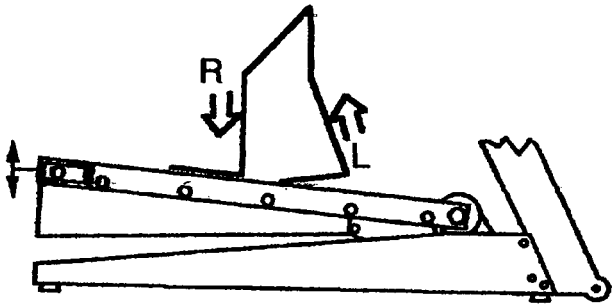

FIG. 35C shows the right treadle 14 about midway through its upward stroke, and the left treadle 12 about midway through its downward stroke. As such, the treadle assemblies are nearly at the same level above the frame and the endless belts 18 are also at the same level. As shown in FIG. 35C, the user's right foot and leg have moved rearwardly and downwardly from the position shown in FIG. 35B. The user's left foot has moved rearwardly and upwardly from the position shown in FIG. 35B. At this point, the user has begun to lift the left foot from the left tread belt in taking a forward stride; thus, the left heel is lifted and the user has rolled onto the ball of the left foot. Typically, more weight will now be on the left treadle 12 than the right treadle 14.

Figure 35D:
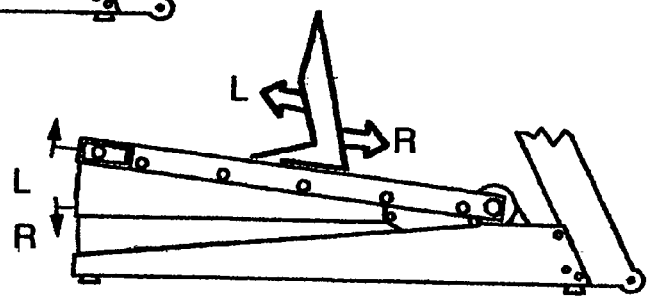
Figure 35E:
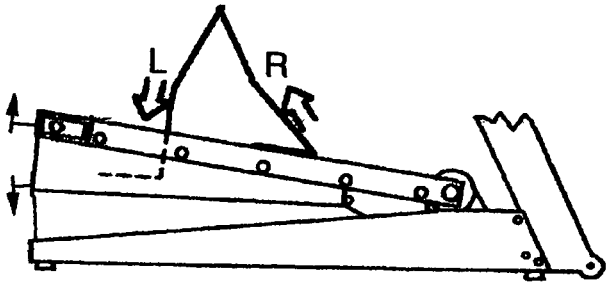

After the orientation shown in FIG. 35C, the right treadle continues it downward movement and the left treadle continues its upward movement to the orientation of the device as shown in FIG. 35D. In FIG. 35D, the left treadle 12 is higher than the right treadle 14, and the interconnect arm 190 is pivoted about the interconnect pivot axis 192 such that its right side is lower than its left side. In this position, the user's right leg continues to move rearward and downward. The user has lifted the left leg off the left treadle and is moving it forward. At about the upper position of the left treadle, the user will step down with his left foot on the front portion of the treadle belt. All of the user's weight is on the right treadle until the user places his left foot on the left treadle. The user continues to provide a downward force on the right treadle forcing the left treadle up.

Figure 43:
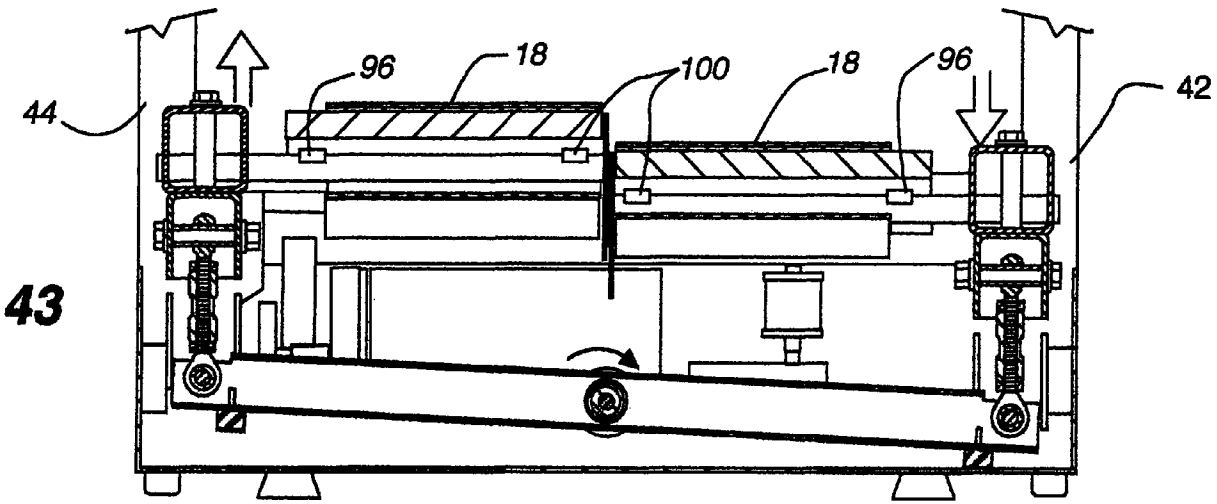
FIG. 43 is a section view taken along line 43-43 of FIG. 36.

FIGS. 40, 43, and 35F illustrate the right treadle 14 in about its lowest position, and show the left treadle 12 in about its highest position. At this point, the user has stepped down on the front of the left treadle and has begun pressing downward with the left leg. The user is also beginning to lift the right leg. The downward force on the left treadle will be transferred through the FIGS. 35A-35E represent half a cycle of the reciprocating motion of the treadles, i.e., the movement of the left treadle 12 from a lower position to an upper position and the movement of the right treadle 14 from an upper position to a lower position. A complete climbing-type exercise cycle is represented by the movement of one treadle from some position and back to the same position in a manner that includes a full interconnection structure to the right treadle to cause the right treadle to begin to rise upward stroke of the treadle (from the lower position to the upper position) and a full downward stroke of the treadle (from the upper position to the lower position). For example, a step cycle referenced from the lower position of the left treadle (the upper position of the right treadle) will include the movement of the left treadle upward from the lower position to the upper position and then downward back to its lower position. In another example, a step cycle referenced from the mid-point position of the left treadle (see FIG. 35B) will include the upward movement of the treadle to the upper position, the downward movement from the upper position, past the mid-point position and to the lower position, and the upward movement back to the mid-point position. The order of upward and downward treadle movements does not matter. Thus, the upward movement may be followed by the downward movement or the downward movement may be followed by the upward movement.

Figure 31:
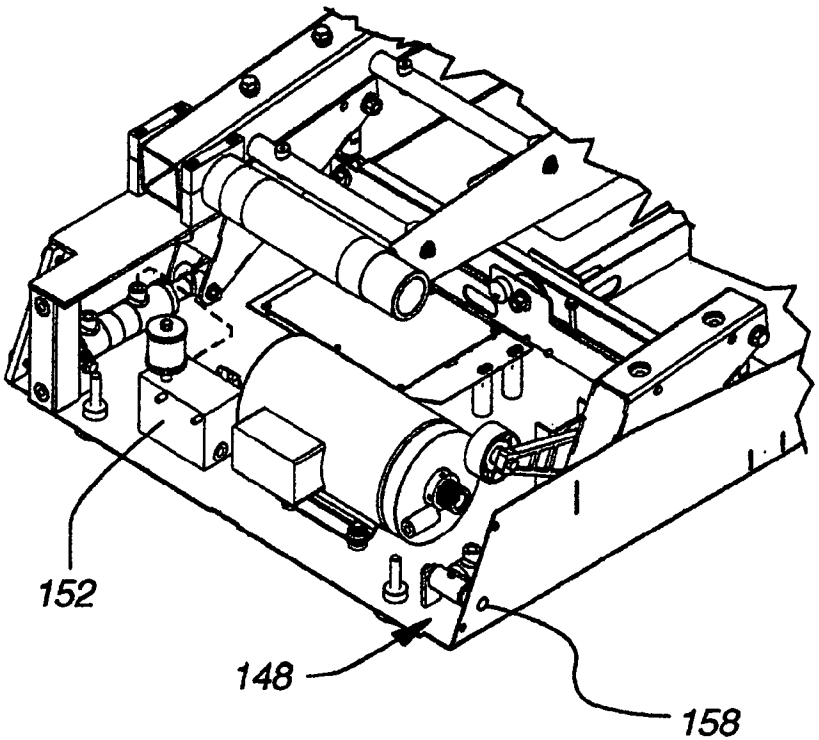
FIG. 31 is a rear isometric view similar to FIG. 30 with additional components removed to illustrate the interconnect structure and the hydraulic resistance structure.
Figure 30:
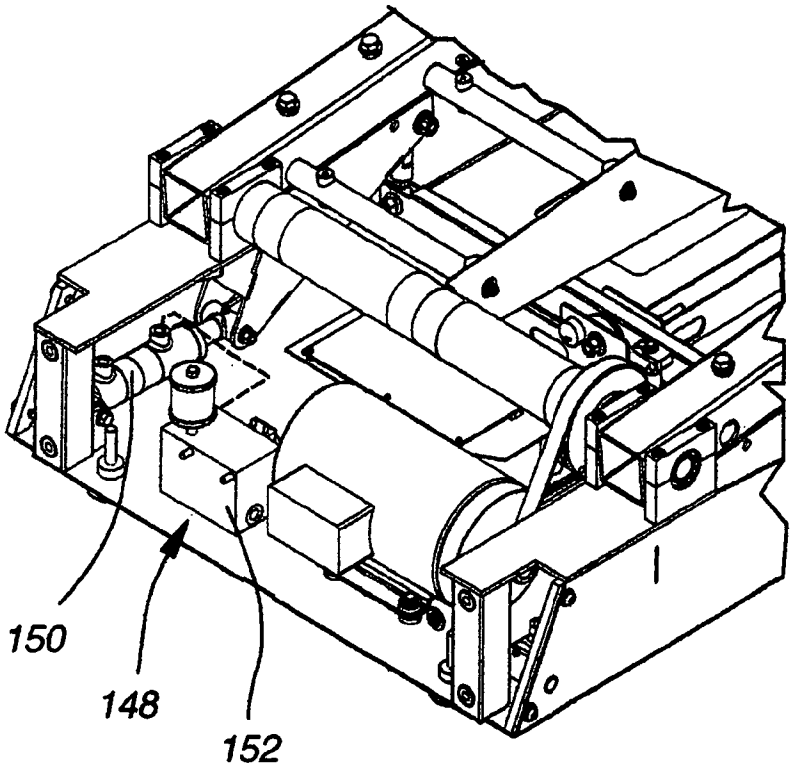
FIG. 30 is a close-up rear isometric view of the exercise device of FIG. 1, with many components removed to illustrate an interconnection structure and a hydraulic resistance structure.

Referring to FIGS. 30-32, and others, in one implementation of the invention, a step sensing apparatus is operably associated with the treadles or interconnection structure to provide signals associated with the step rate (i.e., the frequency of reciprocation), the depth of each step, and other functions. The step sensing apparatus comprises a treadle position sensor ("TPS") which suitably detects the relative position of the treadles at any given time and communicates signals to the CPU indicative of the treadle movement and/or position. More particularly, an encoder, such as a Grayhill Series 63K optical encoder, is coupled with the interconnect cross member bracket adjacent the interconnect axle. The encoder includes a pin with a small gear wheel. The gear wheel is operably connected with the interconnect axle so that rotation of the axle actuates the small gear wheel to rotate the encoder axle, which in turn generates a signal as a function of the speed and radial displacement of the interconnect axle. To provide a finer step gradation, a larger gear wheel may be connected with the interconnect axle and arranged to engage the small gear wheel on the encoder. In one particular example, there is a 6:1 gear ratio between the large gear and the small gear.

Alternatively, in one particular configuration, the exercise device includes a step sensor, which provides an output pulse corresponding with each downward stroke of each treadle. The step sensor is implemented with a reed switch including a magnet and a pick-up. The magnet is connected to the rocker arm. The magnet is oriented so that it swings back and forth past the pick-up, which is connected with the rocker cross member. The reed switch triggers an output pulse each time the magnet passes the pick-up. Thus, the reed switch transmits an output pulse when the right treadle is moving downward, which corresponds with the magnet passing downwardly past the pick-up, and the reed switch also transmits an output pulse when the left treadle is moving upward, which corresponds with the movement to the magnet upwardly past the pick-up. The output pulses are used to monitor the oscillation and stroke count of the treadles as they move up and down during use. The output pulses, alone or in combination with the belt speed signal, may be used to provide an exercise frequency display and may be used in various exercise related calculations, such as in determining the user's calorie burn rate.

Figure 33:
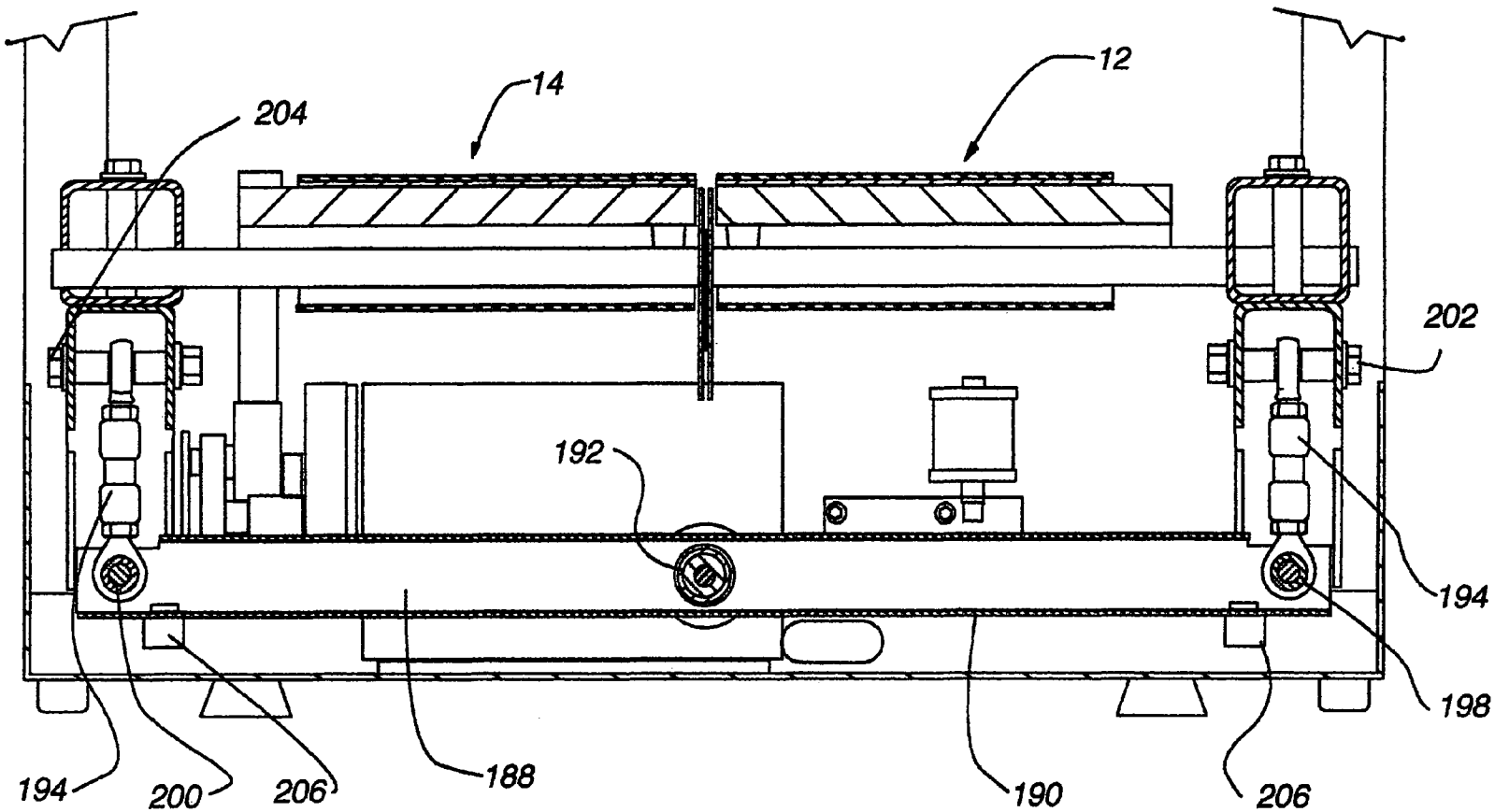
FIG. 33 is a section view taken along line 33-33 of FIG. 4.
Figure 34:
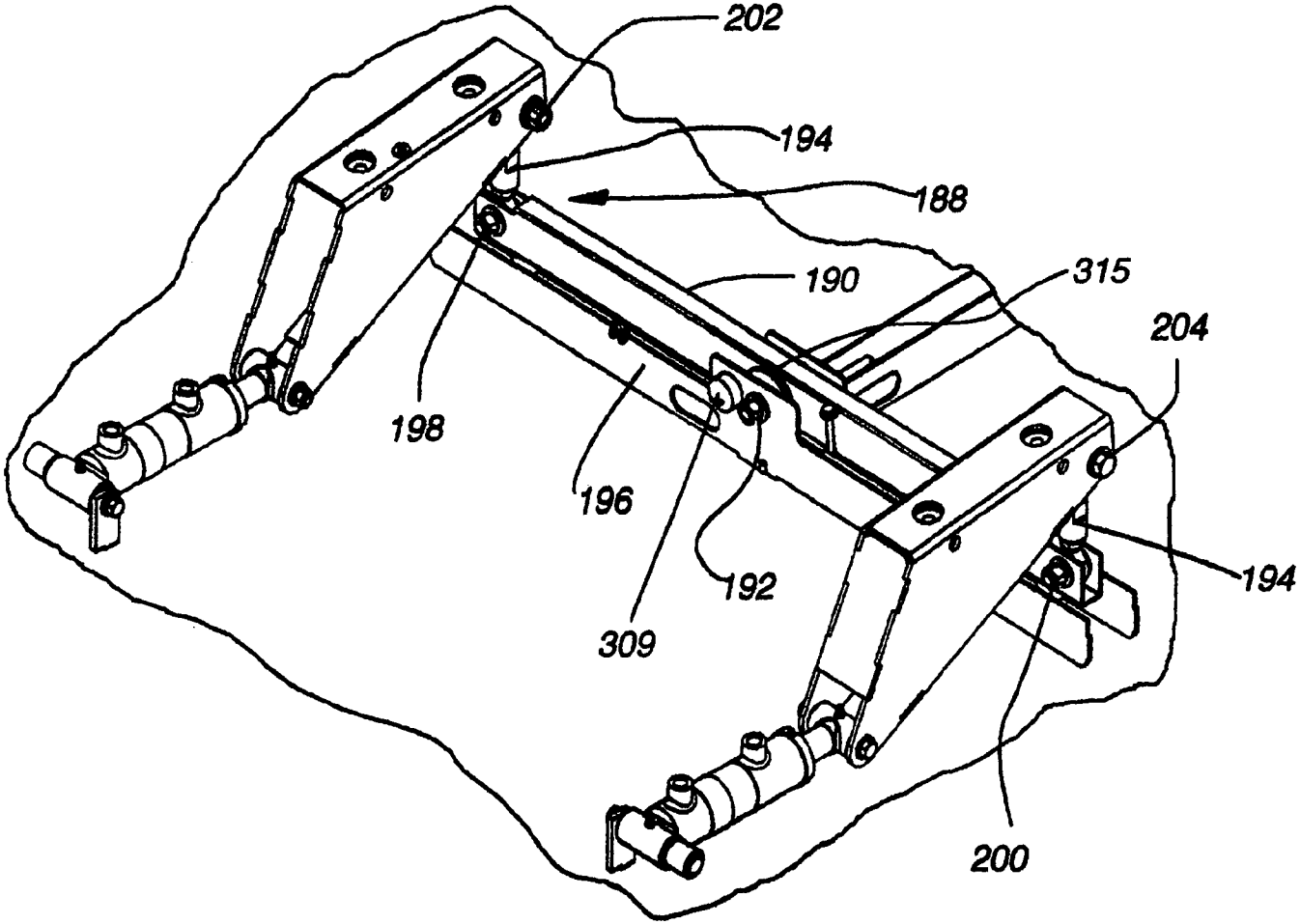
FIG. 34 is an isometric view of the interconnection structure along with other components.

As best shown in FIG. 33, in one particular implementation, bottom-out bumpers 206 are connected to the bottom surface of the ends of the teeter. The bumper may be fixed to the teeter to cushion the treadle should it bottom out at the bottom of a stroke. The block may be fabricated with a rubber, polyurethane, or flexible resilient polymer material.

As mentioned above, the exercise device may be configured in a "lock-out" position by closing the valve. In the lock-out position, the treadle assemblies do not pivot upward and downward. In one particular lock-out orientation, the treadle assemblies are pivotally fixed so that the tread belts are level and at about a 10% grade with respect to the rear of the exercise device. Thus, in a forward facing use, the user may simulate striding uphill, and in a rearward facing use the user may simulate striding downhill.

To mount the device, the user may simply step up onto the treadles and begin exercising. Alternatively, the user may step onto a platform (not shown) supported between the shelves and extending rearwardly from the rear rollers. It also possible to provide mounting platforms extending outwardly form the outside of each treadle assembly, such as is taught in various co-pending applications incorporated herein. The mounting surface may be knurled or have other similar type features to enhance the traction between the user's shoe or foot and the mounting surface. The platform includes a single foot platform extending rearwardly from and at about the same level as the rear portion of the treadles.

A pair of wheels 208 are support at the bottom of the uprights at the rear of the device. The bottom panel at the front of the device (see FIG. 9) defines a pair of handle cutouts 210 at either outside end of the device. The handles are elongate apertures, but other handle structures may be used. By lifting the front of the device, the wheels are pivoted downward to engage the surface that the device is resting on. In this manner, the user may roll the exercise device to a different location. Alternatively, a wheel or wheels may be provided at the front of the device and the handles located in the back panel (see FIG. 11) used to lift and move the device. Although two wheels are shown, one wheel or more wheels, slide plates, rollers, or other devices may be used to ease movement of the device.

Figure 44:
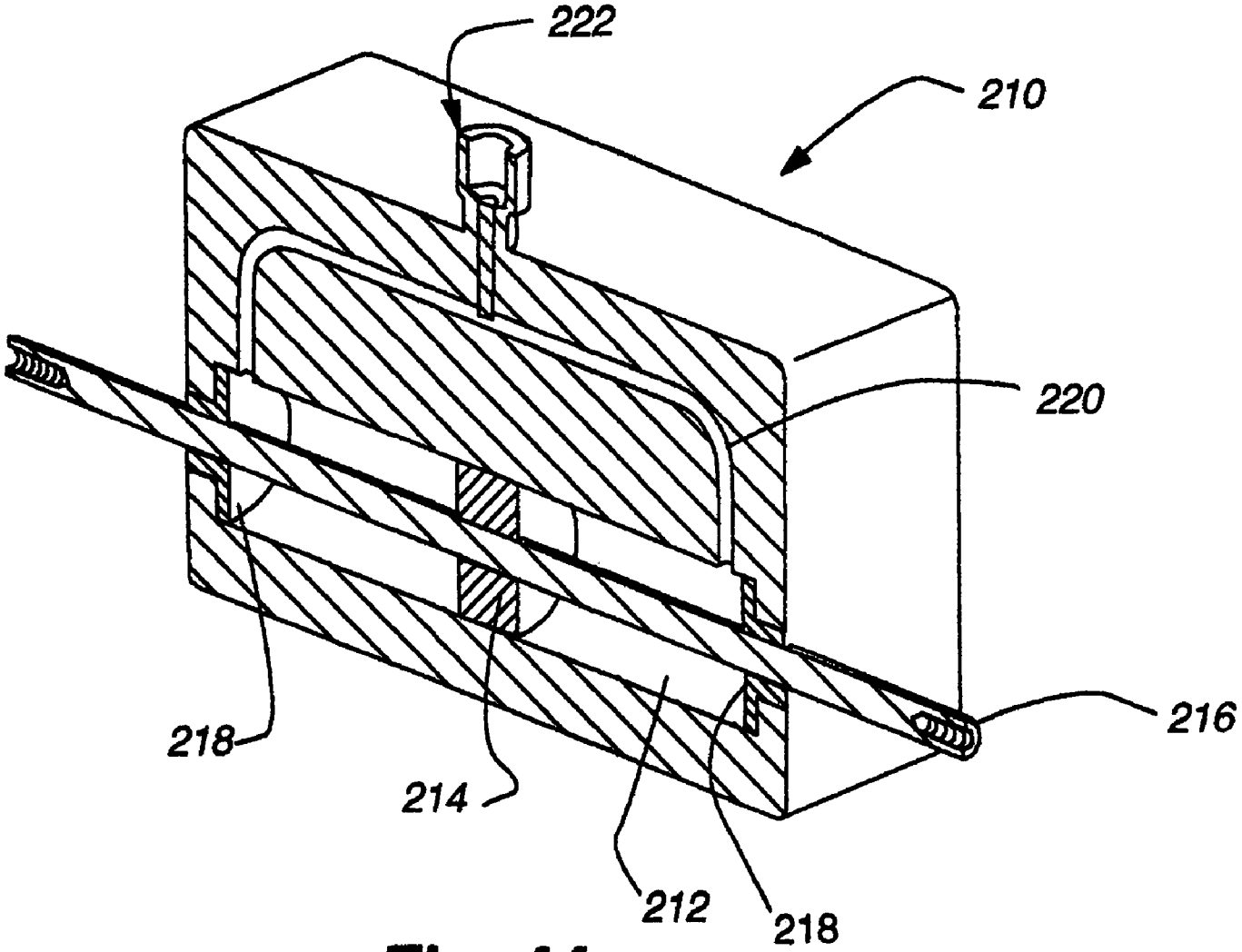
FIG. 44 is an isometric section view of a piston-cylinder valve resistance structure arrangement.
Figure 45:
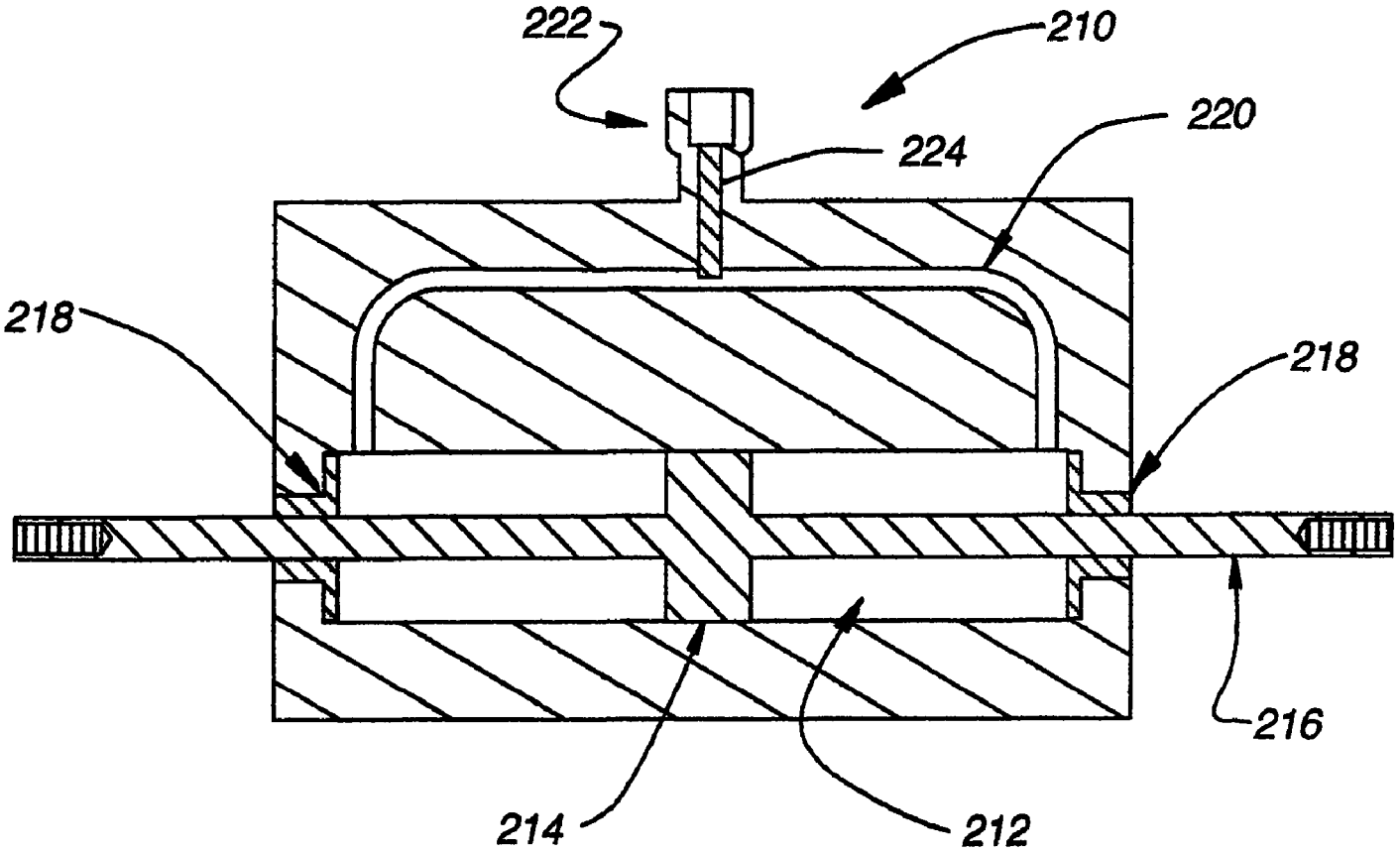
FIG. 45 is a side section view of the piston-cylinder valve arrangement of FIG. 44.
Figure 46:
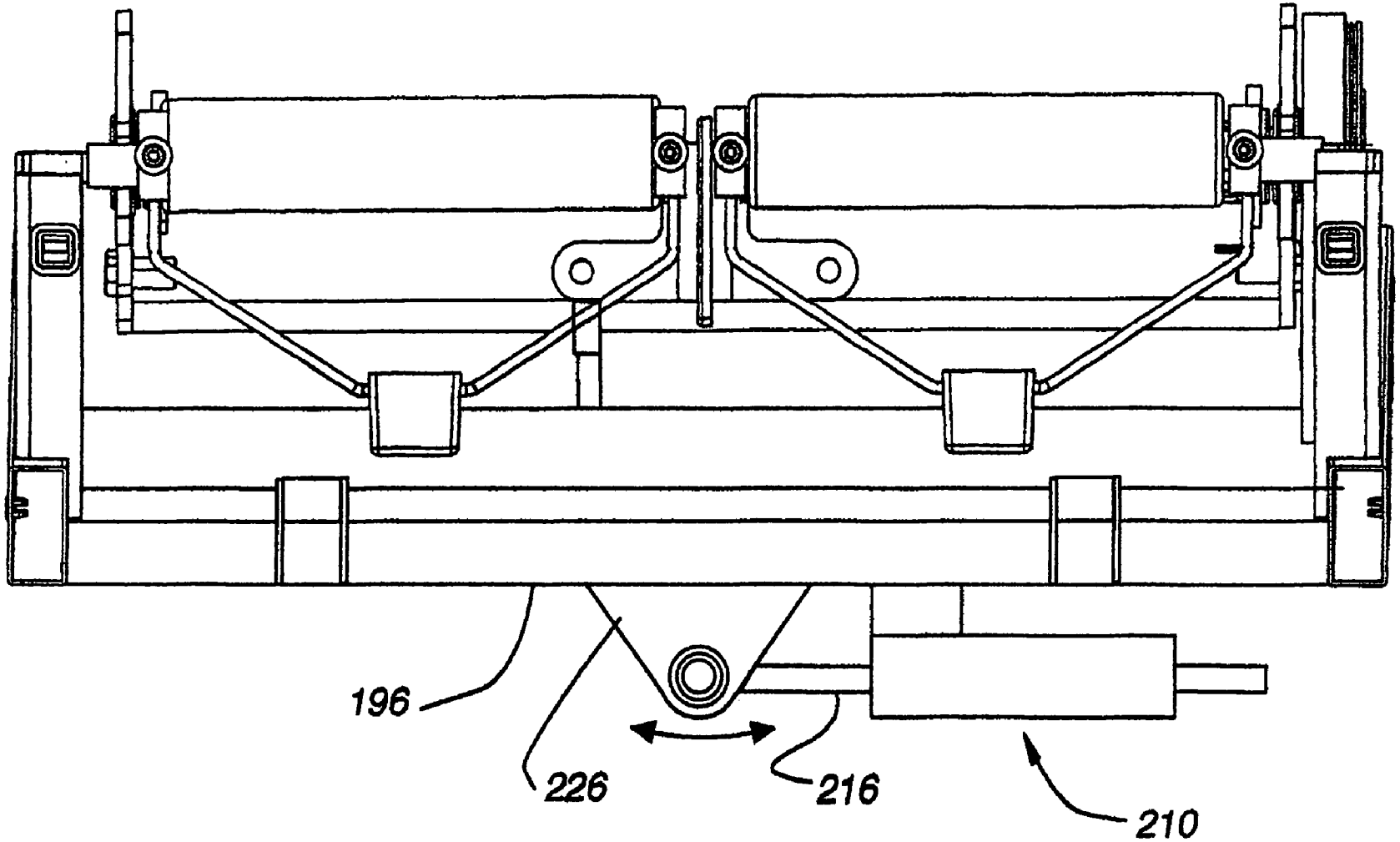
FIG. 46 is a front view of an exercise device having the piston-cylinder valve arrangement of FIG. 44 coupled with an axle of an interconnect assembly.
Figure 47:
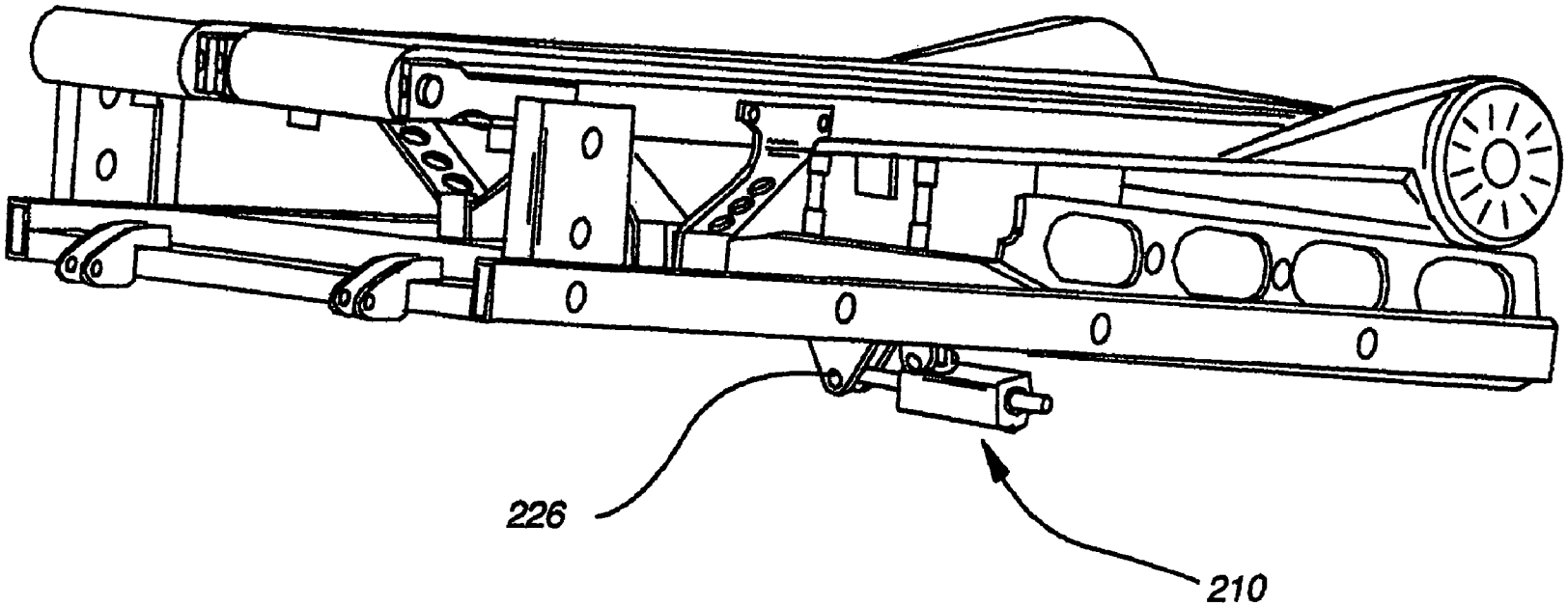
FIG. 47 is an isometric view of the exercise device of FIG. 46.
Figure 48:
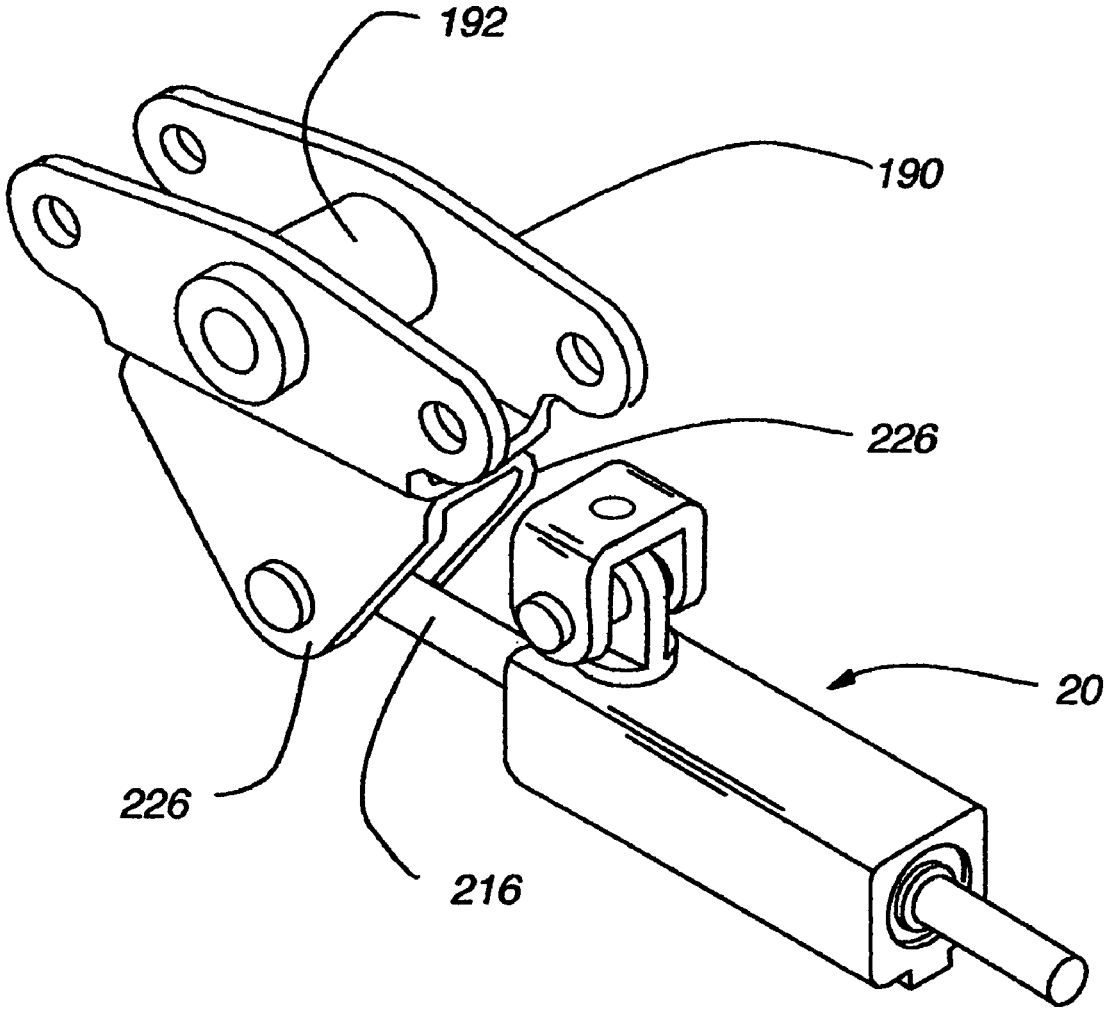
FIG. 48 is a close-up isometric view of the piston-cylinder valve arrangement of FIG. 44 coupled with an axle of an interconnect assembly as shown in FIG. 47.

FIGS. 44-48 illustrate an alternative hydraulic resistance structure 210, in accordance with aspects of the present invention. FIG. 44 is a representative isometric section view of the alternative hydraulic resistance structure. FIGS. 46-48 illustrate the hydraulic dampening structure coupled with the interconnect assembly 188. Referring first to FIGS. 44 and 45, the hydraulic resistance structure includes a cylinder 212 formed in a steel block. A piston 214 supported on a piston rod 216 is positioned within the cylinder. The rod extends outward through holes in each end of the cylinder. O-rings or other sealing devices 218 prevent hydraulic fluid within the cylinder from leaking out from either cylinder port during use. A fluid channel 220 provides a fluid flow path between regions of the cylinder to each side of the piston. A valve assembly 222 is positioned at a point along the channel.

During use of the exercise device, the piston 214 moves back and forth within the cylinder 212. The back and forth movement of the piston drives fluid through the channel 220 between the areas of the cylinder to either side of the piston. For example, when the piston is moving from left to right, fluid is forced from the area of the cylinder to the right of the piston through the channel into the area of the cylinder to the left of the piston. Right to left movement of the piston causes fluid flow in the opposite direction. The valve adjustment assembly includes a pin 224 that may be adjustably positioned within the channel 220. The pin may be moved from a position that completely blocks the channel to a position that does not impede fluid flow within the channel. Depending on the positioning of the pin, fluid flow through the channel is obstructed imparting a variable resistance force on the movement of the piston within the cylinder.

Referring to FIGS. 46-48, the resistance structure 210 is shown coupled between tines 226 extending from the lower portion of the teeter member 190. The teeter member treadle assemblies and other portions illustrated in FIG. 48 is meant for use in non-monoarm exercise device embodiments, such as disclosed in various applications incorporated by reference herein. Tines may be coupled in the same manner to the teeter shown in FIG. 32 and others. One end of the piston rod is pivotally coupled between the tines. Further, the cylinder body is pivotally coupled to the frame rail 196 that supports the teeter bracket. As the teeter pivots about its axle while the treadles pivot up and down, the tines move in an arcuate path pulling and pushing on the piston rod. Pivotally coupled with the teeter frame rail, the cylinder body is able to move slightly up and down to account for the vertical component of the tines' 226 arcuate path. The piston-cylinder arrangement 210 imparts a resistance force to the teetering movement of the teeter, which resists the pivotal movement of the treadles. Adjustment of the valve 222 increases or decreases the resistance imparted by the piston-cylinder arrangement.

Figure 49:
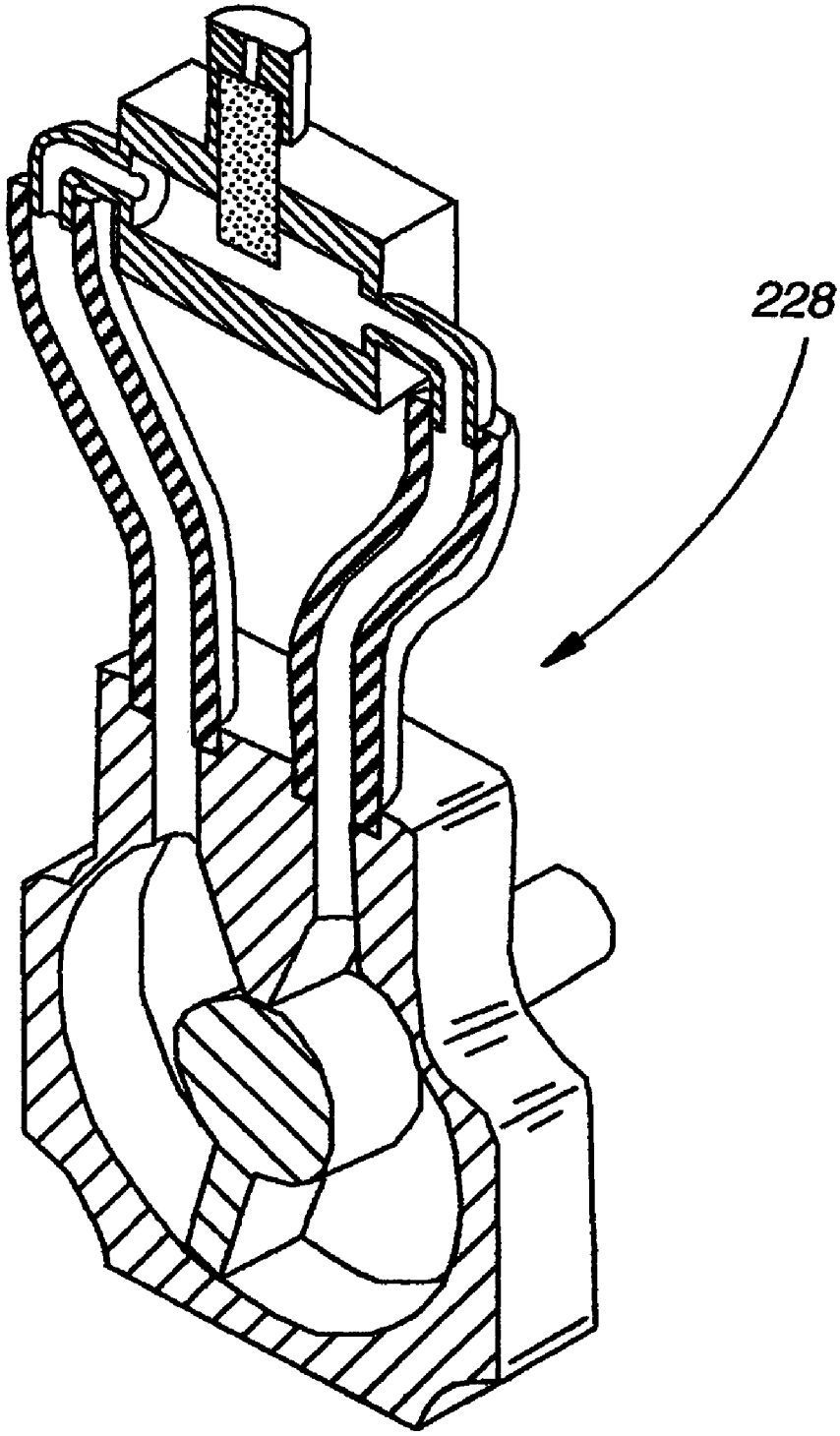
FIG. 49 is a isometric section view of an alternative piston-cylinder arrangement.
Figure 50:
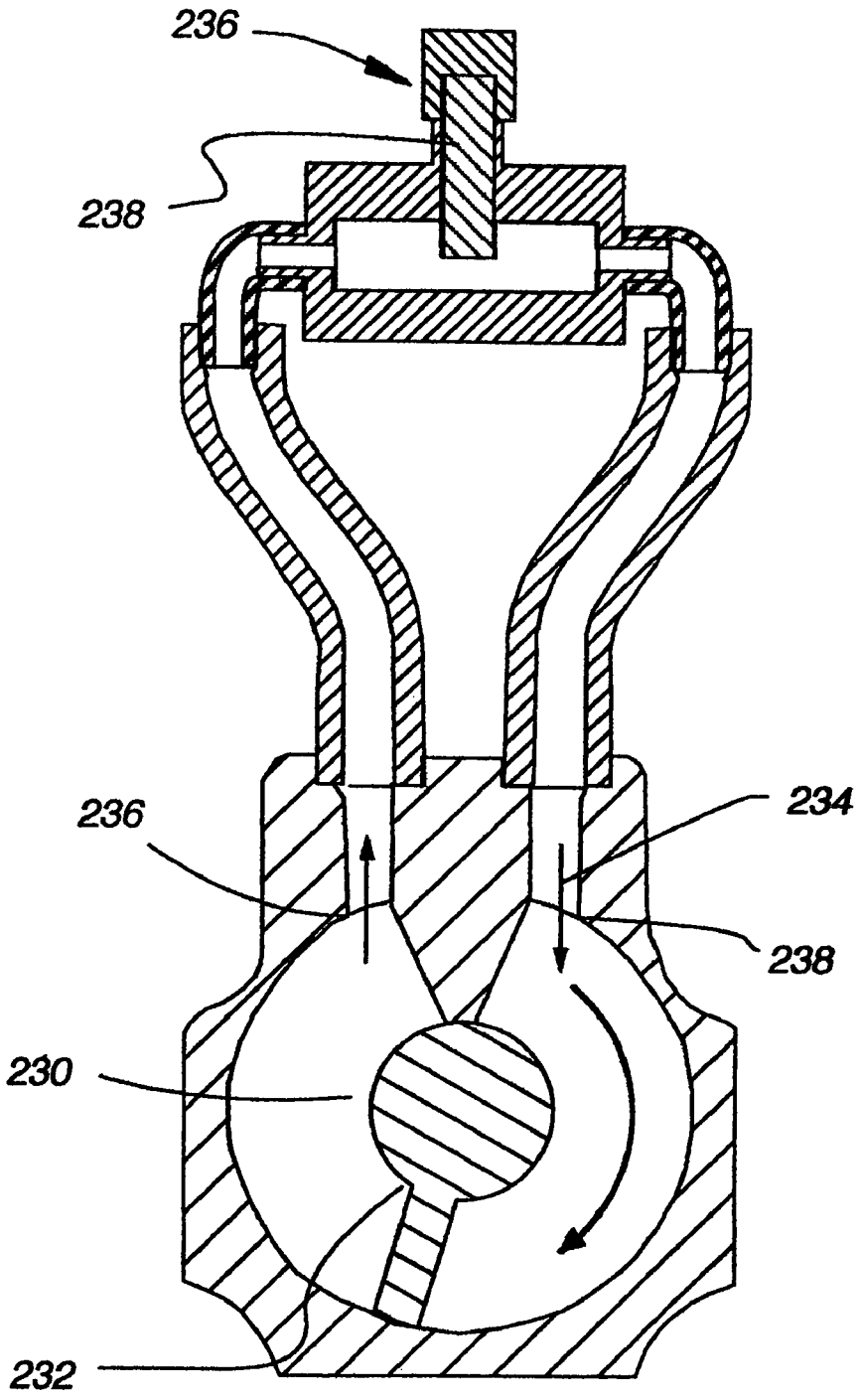
FIG. 50 is a front section view of the alternative piston-cylinder arrangement of FIG. 49.
Figure 51:
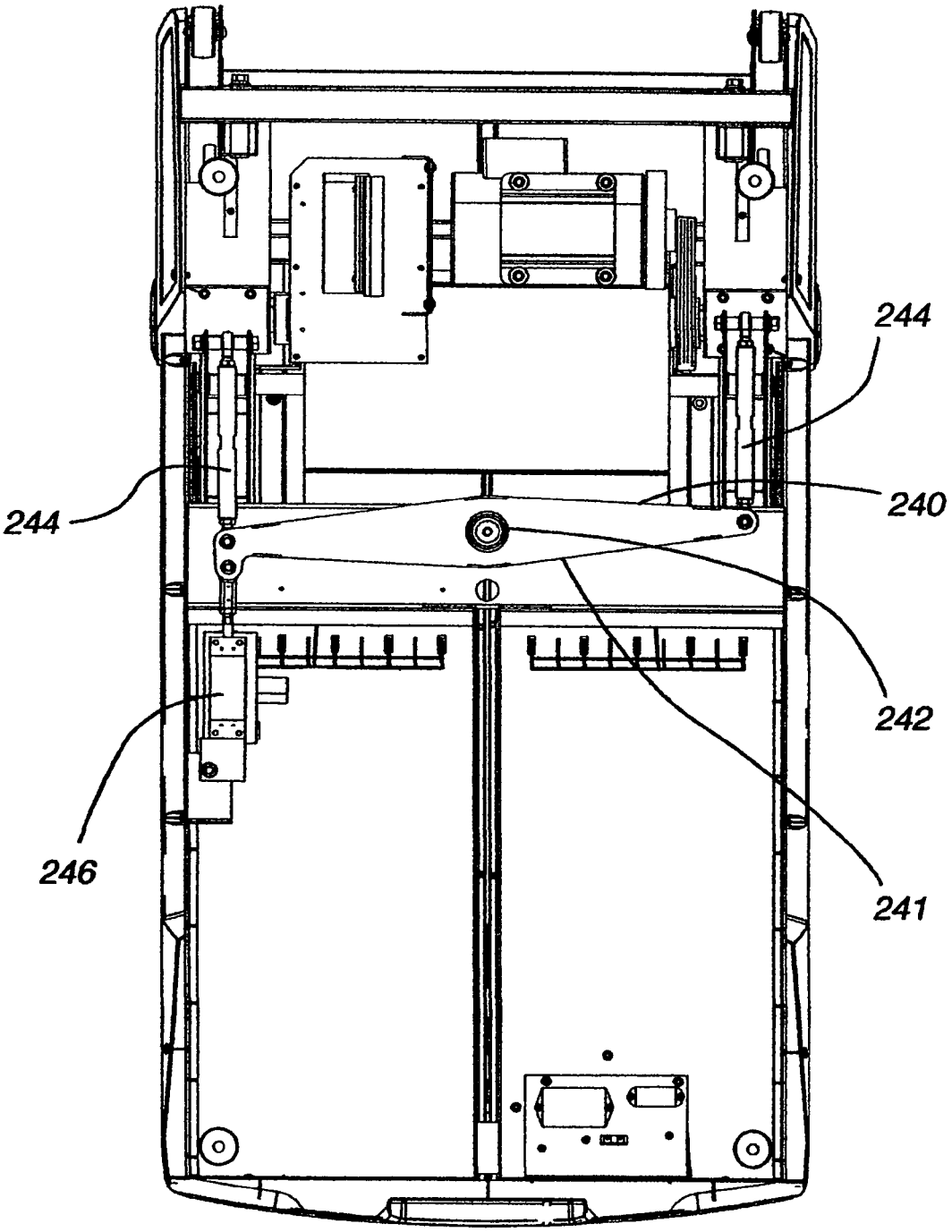
FIG. 51 is a bottom view of an exercise device employing an alternative interconnection assembly and piston-cylinder valve resistance structure arrangement.
Figure 52:
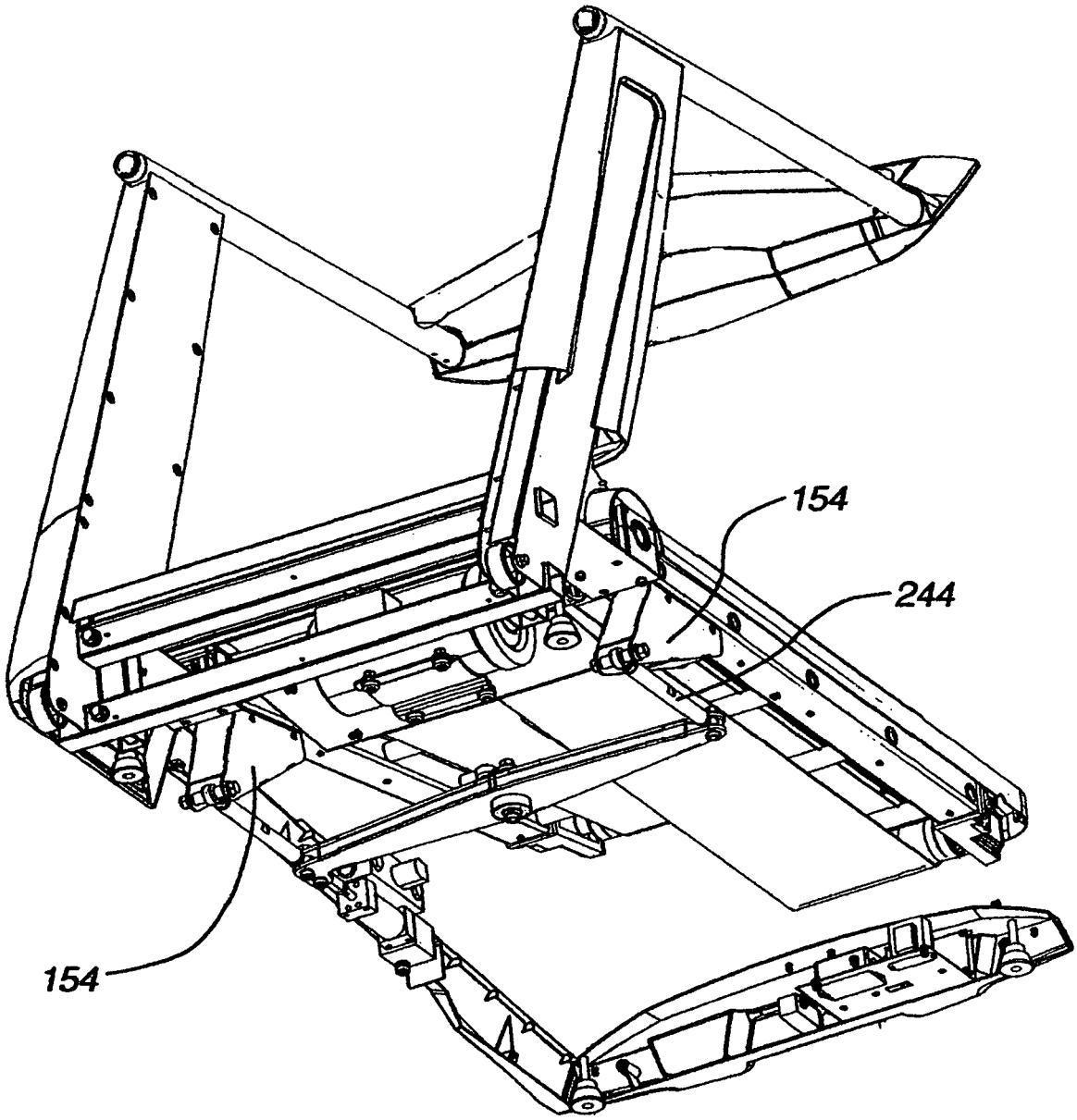
FIG. 52 is a bottom isometric view of the exercise device of FIG. 51.
Figure 53:
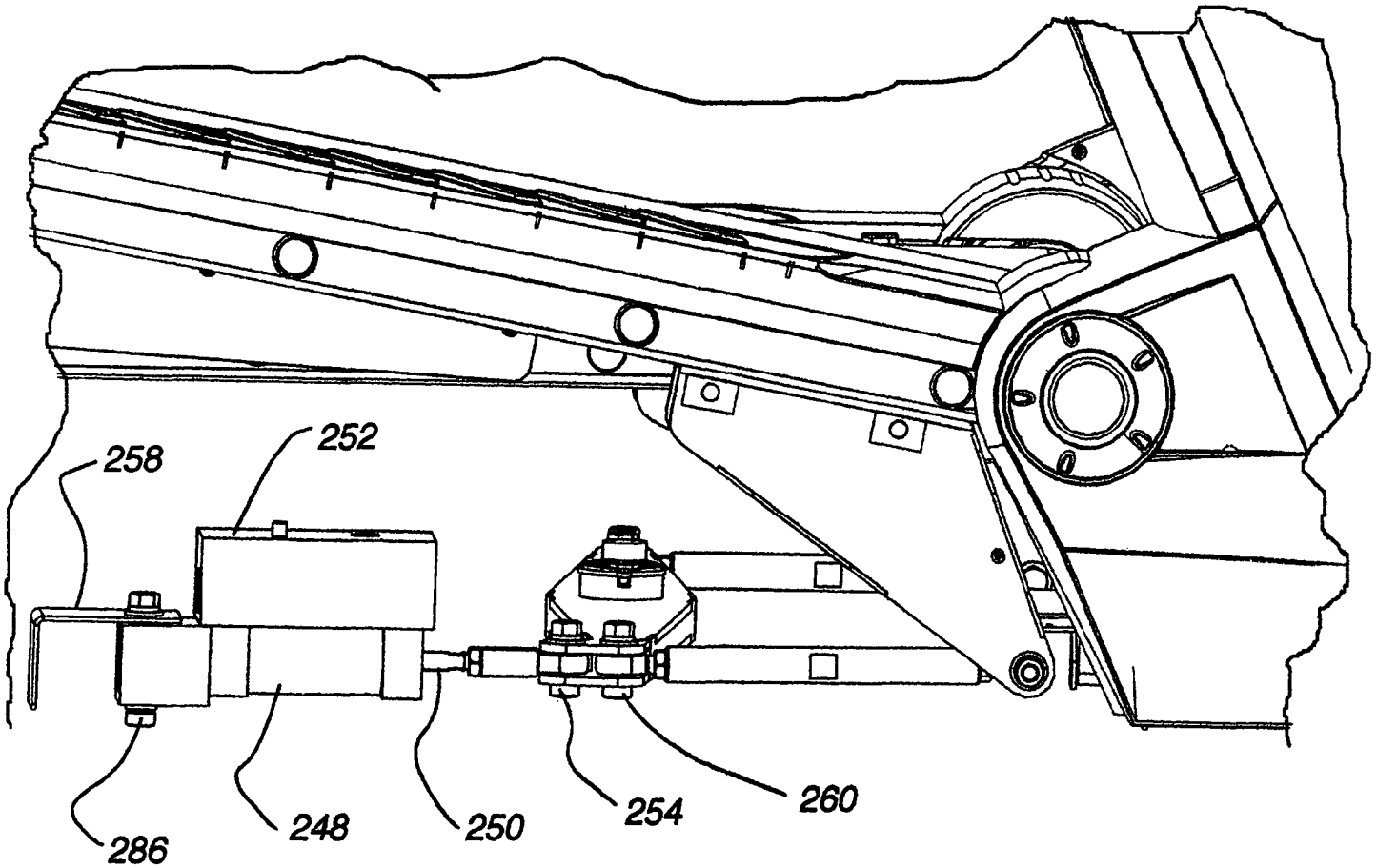
FIG. 53 is a left side isometric view of the exercise device of FIG. 51.
Figure 54:
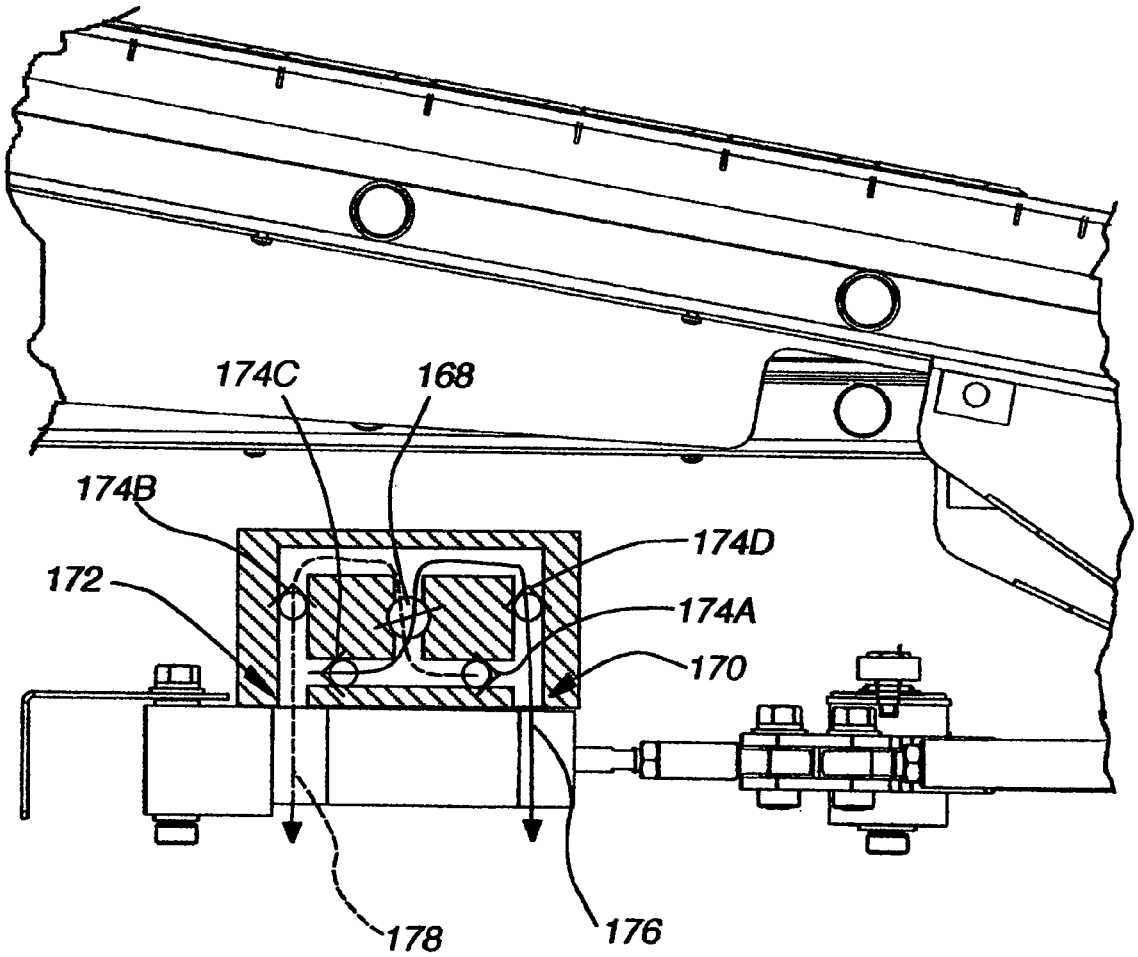
FIG. 54 is a left side view similar to FIG. 53, and further illustrating a schematic representation of the internal valve members of a valve assembly.

FIGS. 49-50 illustrate a second alternative hydraulic resistance structure 228 that may be coupled with the interconnect assembly 188. FIG. 49 is an isometric section view of the hydraulic resistance assembly and FIG. 50 is a front isometric view of the hydraulic resistance assembly. The hydraulic resistance assembly includes a substantially circular fluid cylinder 230. A piston vane 232 is arranged to rotate within the circular cylinder. Further, the piston vane is coupled with the teeter axle 192; thus, pivoting movement of the teeter axle imparts a pivoting or rotational movement on the piston vane. At the top of the circular cylinder a fluid flow path 234 is provided between each section of the cylinder to either side of the vane. The cylinder 230 does not form a complete circle. One end of the channel to one side of the vane is coupled with an input 236 to the fluid channel 234 and the other side of the cylinder at the other side of the vane is coupled with a second input 238 the other end of the fluid channel. As such, rotation of the piston vane pushes fluid through one or the other input, and flows back into the cylinder through the other input. For example, when the piston vane rotates in a clockwise direction, fluid flows in a clockwise path through the fluid channel, out input 236 to the left of the vane. Fluid flows through the channel 234 and into the cylinder 230 through input 238. Conversely, when the vane rotates in a counterclockwise direction, fluid flows through the channel in a counterclockwise direction between the section of the cylinder to the right of the vane, out port 238, through the channel 234, through input 236, and into the section of the cylinder to the left of the vane. The piston-cylinder arrangement of FIGS. 49-50 is a closed system like the cylinder-piston arrangement of FIGS. 44-48.

An adjustable valve member 236 is located in the fluid flow path 234 between each section of the cylinder 230. The valve includes a pin 238 that may be imposed in the fluid channel to varying degrees, between a fully closed position and a fully opened position. In the fully closed position, the fluid flow path is completely blocked and in the fully opened position the fluid flow path is completely open. In the embodiment of FIGS. 49-50, completely closing the valves 222 or 236 performs a lock out function that fixes the treadles (12, 14) in the orientation corresponding to when the valve was closed. Referring again to FIG. 50, the valve imparts a variable resistance on the fluid flow between the cylinder chambers. As such, by adjusting the valve a varying amount of resistance may be imposed upon the teeter 190 which in turn imposes a variable resistance on the pivotal motion of the treadles.

FIGS. 51-54 illustrate one implementation of an exercise device conforming to aspects of the present invention. The exercise device shown in FIGS. 51-54 includes an alternative interconnect assembly arrangement, and an alternative resistance structure coupled with the interconnect assembly. The interconnect assembly 240 includes a teeter arm arranged to pivot in a horizontal plane about a vertical interconnect axle space 242. The teeter arm is pivotally coupled to a frame rail disposed below the teeter arm. To not unnecessarily hide from view the interconnect structure 240, the frame rail is not shown in FIGS. 51-54. Other components of the exercise device are also not shown in FIGS. 51-54 to not unnecessarily hide from view various features of the interconnect assembly and the valve alternative resistance structure.

One end region of the teeter arm is connected with the respective resistance bracket 154. The other end region of the teeter arm is also coupled with the respective resistance bracket 154. In one example, a tie rod 244 is pivotally coupled to one end of the teeter arm. The opposing end of the tie rod is coupled with the respective resistance bracket. A similar tie rod arrangement couples the other end of the teeter arm to the respective resistance bracket, in one implementation. Pivotal actuation of a treadle 12 causes the associated resistance bracket 154L to pivot back and forth. The back and forth movement of the resistance bracket pulls and pushes on the respective end of the teeter arm causing an opposite movement of the other end of the teeter arm as the teeter arm pivots about the vertical interconnect axle space 242. As such, downward pivotal movement of one treadle 12 is accompanied by upward pivotal movement of the opposing treadle 14, and vice versa. As mentioned above, the teeter arm is arranged to pivot in a substantially horizontal plane. In early embodiments discussed herein, the teeter arm is arranged to pivot in a substantially vertical plane. It is possible to orient the interconnect axle in various planes to position the teeter arm to pivot in planes between horizontal and vertical, i.e., angular planes.

An alternative resistance structure 246 is coupled along a length of the teeter arm to either side of the interconnect axle. In the example shown in FIGS. 51-54, the alternative resistance structure is coupled with the left end region of the teeter arm; however, the resistance structure can be coupled along any portion of the teeter arm to either side of the interconnect axle 242. The alternative resistance structure 246 includes a cylinder 248 body housing a piston coupled to a piston rod 250 adapted to reciprocate within the cylinder. One end of the piston rod is pivotally coupled with an end region of the interconnect teeter arm 241. The cylinder includes a flow path to and from a valve assembly housing 252 coupled in fluid communication with the cylinder 248. The valve assembly housing 252 illustrated and discussed in more detail below, includes the same valve assembly structure as illustrated and described with respect to FIG. 29. Both the front and the rear of the alternative resistance structure are pivotally coupled. A front pivot 254 is provided at the outwardly extending end of the piston rod 250. A coupling ring 260 pivotally couples the front pivot with the pivot at which the teeter arm is coupled with the tie rod. At the front of the resistance structure 246, a rear pivot 256 is provided. A bracket arm 258 is attached to a cross member (not shown), and a forward upper extending tine of the bracket pivotally supports the rear of the resistance structure 246. The combination of the pivotal front pivot 254 and rear pivot 256 allows the resistance structure to appropriately pivot with the teeter arm during its back and forth movement to not put undue lateral stresses on the piston rod 250.

Figure 55:
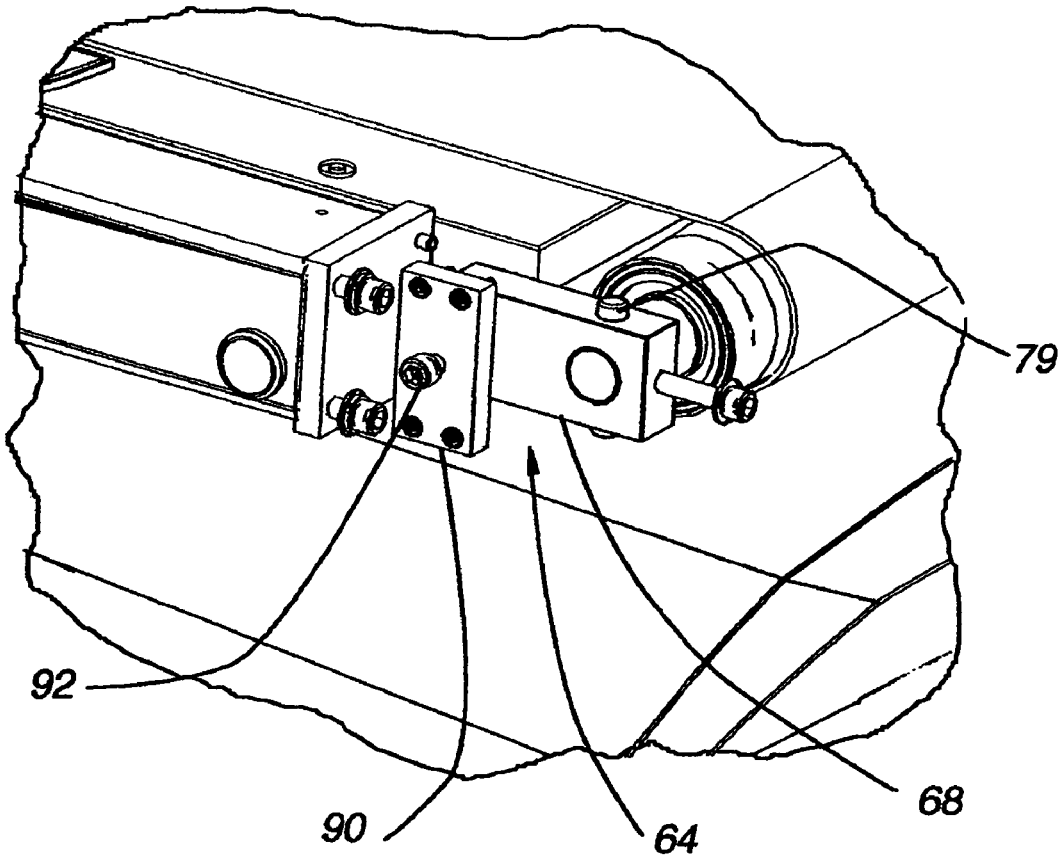
FIG. 55 is a partial isometric view of the front section of the right treadle highlighting a front roller adjustment assembly.

FIG. 55 illustrates an alternative belt adjustment assembly 64. The belt adjustment assembly is substantially similar to the assembly described above. However, the tensioner plate 68 includes upper and lower pivot pins 79 (only upper is shown) rather than the tongue 78. The angular adjustment plate 90 supports an angular adjustment bolt 92 adapted to butt into the tensioner plate and pivot it about the pivot pin 79. Rather than being supported in channels (like the tongues), the pins are pivotally supported in pivot apertures defined in the lower 70 and upper 72 plates (not shown). As such, the tensioner plate pivots about the pivot pins. The rearward belt tension against the roller acts to pivot the tensioner plate outward against the bolt 92. The bolt may be tightened inwardly to pivot the roller frontward, or may be loosened outwardly to allow the roller to pivot rearward.

Figure 56:
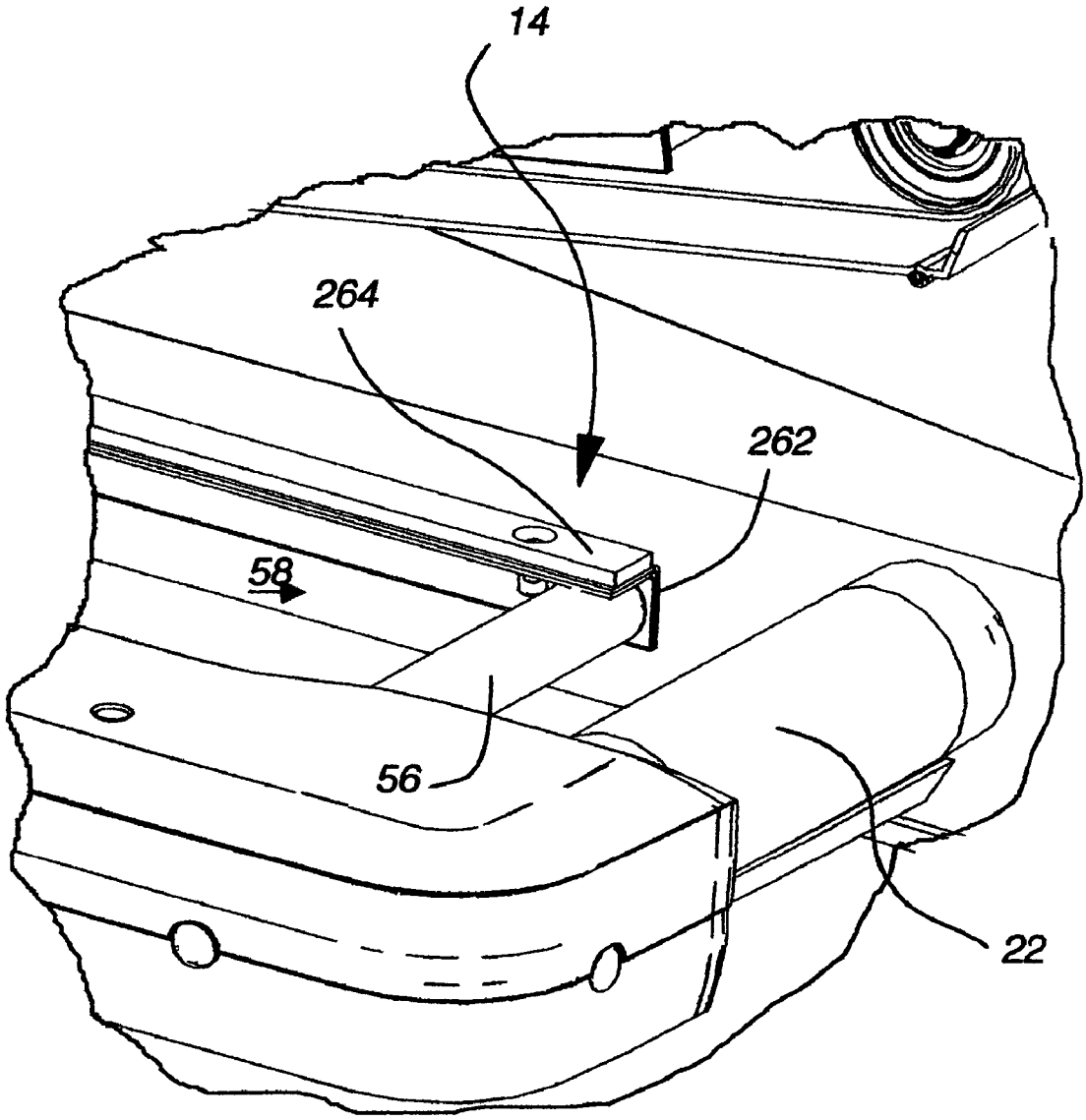
FIG. 56 is a partial isometric view of the front section of the right treadle highlighting a deck and shield support assembly.

FIG. 56 illustrates an alternative structure for coupling the tread deck with the deck supports 56. In this implementation, an elongate bracket 262 defining an L-shape is welded to outside of each deck support. The L-bracket is welded to each deck support, but is not otherwise supported at an end or elsewhere. The shields 58 are bolted or otherwise secured to the downwardly extending face of the L-bracket. A rubber strip 264 is attached to the top of the L-bracket. The strip isolates the deck from the frame, and also provides some degree of deck suspension.

Although preferred embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, such joinder references do not necessarily infer that two elements are directly connected and in fixed relation to each other. It is intended that all matter contained in the above description or shown in the accompanying drawings shall be interpreted as illustrative only and not limiting.

In the implementations of the invention shown herein, radial ball bearing are used in various locations, such as to support the rear rollers. It is possible to use other arrangements, such as collars, sleeves, lubricant, and the like to rotatably support various members. In some instances, square tubes are employed, such as for the treadle assemblies; however, it is possible to use solid frame members, cylindrical tubes, and the like.

Changes in detail or structure may be made without departing from the spirit of the invention as defined in the appended claims.

The invention claimed is:

1. An exercise apparatus comprising:

a frame structure;

a first treadle assembly including a first frame including a first outer support member, a first belt disposed about a front roller and a rear roller and defining a first surface movable relative to the frame, a first inner shield extending below a bottom surface of the first belt, and at least one deck support member connected between the first outer support member and the first inner shield, the first treadle assembly pivotally supported on the frame structure at a rear of the first frame; and a second treadle assembly including a first frame including a second outer support member, a second belt disposed about a front roller and a rear roller and defining a second surface movable relative to the frame, a second inner shield extending below a bottom surface of the second belt, and at least one deck support member connected between the second outer support member and the second inner shield, the second treadle assembly pivotally supported on the frame structure at a rear of the second frame.

2. The exercise apparatus of claim 1 further comprising:

an interconnection assembly operable coupled between the first treadle assembly and the second treadle assembly.

3. The exercise apparatus of claim 2 wherein the interconnection assembly comprises a teeter arm arranged to pivot about a first pivot point.

4. The exercise device of claim 3 wherein the teeter arm defines a first portion and a second portion to either side of the first pivot point, the first portion coupled with the first treadle assembly and the second portion coupled with the second treadle assembly.

5. The exercise device of claim 4 wherein the interconnection assembly further comprises:

a first rod pivotally connected between the first portion of the teeter arm and the first treadle assembly; and a second rod pivotally connected between the second portion of the teeter arm and the second treadle assembly.

6. The exercise device of claim 5 wherein the first rod comprises a turnbuckle and the second rod comprises a turnbuckle.

7. The exercise device of claim 1 comprising:

a resistance structure operably positioned between the first treadle assembly and the second treadle assembly.

8. The exercise device of claim 7 wherein the resistance structure comprises:

a first piston-cylinder assembly operably coupled between the frame structure and the first treadle assembly.

9. The exercise device of claim 8 wherein the resistance structure comprises:

a second piston-cylinder assembly operably coupled between the frame structure and the second treadle assembly.

10. The exercise device of claim 9 wherein the resistance structure comprises:

an adjustable valve assembly hydraulically coupling the first piston-cylinder assembly with the second piston-cylinder assembly.

11. The exercise device of claim 3 wherein the teeter is arranged to pivot in a substantially vertical plane and further comprises:

a piston-cylinder assembly coupled between the teeter and the frame structure.

12. The exercise apparatus of claim 1 further comprising:

a first shock connected between the frame structure and the first treadle assembly; and a second shock connected between the frame structure and the second treadle assembly.

13. The exercise apparatus of claim 1 wherein the first treadle assembly comprises:

a plurality of cantilever deck support members coupled with the treadle frame member; and a deck supported on the cantilever deck support members.

14. The exercise apparatus of claim 1 wherein the first roller is supported by the first outer support member in a cantilever arrangement.

15. The exercise apparatus of claim 13 wherein the first inner shield is connected with the plurality of support members of the first treadle assembly.

* * * * *

UNITED STATES PATENT AND TRADEMARK OFFICE

CERTIFICATE OF CORRECTION

PATENT NO. : 7,645,214 B2
APPLICATION NO. : 11/065891
DATED : January 12, 2010
INVENTOR(S) : Andrew P. Lull It is certified that error appears in the above-identified patent and that said Letters Patent is hereby corrected as shown below:

Title page, Item (56), References Cited, U.S. PATENT DOCUMENTS:

Delete "5,232,471A 08/1993 Chen et al." and insert --5,232,421 A 08/1993 Chen et al.--

Signed and Sealed this

Twentieth Day of April, 2010

David J. Kappos

David J. Kappos
*Director of the United States Patent and Trademark Office*